US007673985B2

(12) United States Patent
Sasa

(10) Patent No.: US 7,673,985 B2
(45) Date of Patent: Mar. 9, 2010

(54) INK-JET RECORDING APPARATUS PROVIDED WITH PLATEN AND MOVABLE SUPPORT SECTION FOR SUPPORTING RECORDING PAPER

(75) Inventor: Masahiko Sasa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 393 days.

(21) Appl. No.: 11/420,462

(22) Filed: May 25, 2006

(65) Prior Publication Data

US 2006/0268087 A1 Nov. 30, 2006

(30) Foreign Application Priority Data

May 25, 2005 (JP) ..... 2005-152963
Oct. 31, 2005 (JP) ..... 2005-315928
Dec. 28, 2005 (JP) ..... 2005-379602

(51) Int. Cl.
*B41J 2/01* (2006.01)

(52) U.S. Cl. ..... 347/104; 347/101

(58) Field of Classification Search ..... 347/104; 400/23, 29, 649, 654, 655, 656
See application file for complete search history.

(56) References Cited

U.S. PATENT DOCUMENTS 5,303,018 A * 4/1994 Terada et al. ..... 399/299
5,757,407 A * 5/1998 Rezanka ..... 347/102
5,874,979 A * 2/1999 Ohyama ..... 347/104
5,940,092 A 8/1999 Kashimura et al.
6,179,419 B1 * 1/2001 Rasmussen et al. ..... 347/104
6,239,817 B1 5/2001 Meyer
6,471,351 B1 10/2002 Ishikawa et al.
6,659,603 B2 * 12/2003 Kida et al. ..... 347/104
7,086,729 B2 8/2006 Yoshikaie
7,093,931 B2 8/2006 Ishii et al.
2002/0154203 A1 10/2002 Tanaka (Continued)

FOREIGN PATENT DOCUMENTS

JP 1997234916 A 9/1997

(Continued)

OTHER PUBLICATIONS

Japanese Patent Office, Notice of Reasons for Rejection in Japanese Patent Application No. 2005-152963 (counterpart to the above-captioned U.S. patent application) mailed Jun. 24, 2008.

*Primary Examiner*—Manish S Shah
(74) *Attorney, Agent, or Firm*—Baker Botts L.L.P.

(57) ABSTRACT

An ink-jet recording apparatus is provided, which makes it possible to perform borderless recording at a high speed. A platen 42 has a groove 116 which covers an entire ink discharge area of a recording head. A plurality of movable ribs 104 are provided in the groove 116. The movable ribs 104 are allowed to slide from first positions to second positions in synchronization with the transport of a recording paper 146. The first positions are positioned between mutually adjoining first fixed ribs 102, and the second positions are positioned between mutually adjoining second fixed ribs 103. The movable ribs 104 protrude upwardly from an upper surface 109 of the platen 42. The movable ribs 104 reliably support the recording paper fed to the position over the groove 116.

26 Claims, 44 Drawing Sheets

U.S. PATENT DOCUMENTS

2002/0191064 A1 12/2002 Ishikawa et al.

FOREIGN PATENT DOCUMENTS

JP 2001080145 A 3/2001
JP 2000118058 A 4/2002
JP 2002307769 A 10/2002
JP 2003-285487 A 10/2003
JP 2005-007691 A 1/2005

* cited by examiner

INK-JET RECORDING APPARATUS PROVIDED WITH PLATEN AND MOVABLE SUPPORT SECTION FOR SUPPORTING RECORDING PAPER

CROSS REFERENCE TO RELATED APPLICATION

The present application claims priority from Japanese Patent Application Nos. 2005-152963, filed on May 25, 2005; 2005-315928, filed on Oct. 31, 2005; and 2005-379602, filed on Dec. 28, 2005, the disclosures of which are incorporated herein by reference in its entirety.

BACKGROUND OF THE INVENTION

1. Field of the Invention

The present invention relates to an ink-jet recording apparatus for recording an image on the recording paper by discharging ink droplets from a recording head. In particular, the present invention relates to an ink-jet recording apparatus including a movable support section provided for a platen.

2. Description of the Related Art

An ink-jet recording apparatus includes a recording head in which a large number of nozzles are provided in an aligned manner. The recording paper, on which an image is to be recorded, is transported to the position under the recording head. The recording head discharges ink droplets from the nozzles at the predetermined timing while being moved in the primary or main scanning direction (direction perpendicular to the transport direction of the recording paper). Accordingly, the image is recorded on the recording paper. In recent years, the ink-jet recording apparatus is provided with the function to record an image on the recording paper, for example, as if a photograph print is produced. The image recording of this type is performed without providing any blank space or margin at the edge of the recording paper, which is referred to as so-called "borderless recording".

When the borderless recording is performed, the recording head discharges the ink to the outside of the recording paper while exceeding the edge of the recording paper. For example, in the case of the borderless recording performed at the forward end and the backward end of the recording paper, the recording paper is positioned with respect to the recording head so that parts of the large numbers of nozzles are arranged outside the edge of the recording paper. The ink droplets are discharged from the nozzles onto the platen arranged under the recording paper. The platen is provided with a groove which is disposed at an upper portion and which extends in the main scanning direction. An ink-absorbing member is provided in the groove. Accordingly, the ink droplets are absorbed by the ink-absorbing member. Therefore, the image is recorded on the entire recording paper without forming any blank space at the edge of the recording paper, and the back surface of the recording paper is not dirtied by the ink discharged onto the platen (see, for example, U.S. Pat. No. 6,239,817 B1 corresponding to Japanese Patent Application Laid-open No. 2000-118058).

In recent years, it is demanded for the ink-jet recording apparatus to realize the high speed image recording. In order to realize the high speed image recording, it has been hitherto intended to allow the recording head to have a large size, for the following reason. That is, when the recording head is large-sized, then the number of nozzles aligned in the transport direction of the recording paper is increased, and the high speed recording can be performed. However, in order to satisfactorily perform the borderless recording as described above, it is necessary that the widthwise dimension (dimension in the transport direction of the recording paper) of the groove provided for the platen is also set to be large as the recording head is large-sized.

When the borderless recording is performed as described above, the recording paper is arranged over the groove provided for the platen. Therefore, if the groove width is large, then the recording paper is warped downwardly in the vertical direction, and the recording paper is deformed such that the recording paper falls into the groove. If the recording paper is warped as described above, then the distance is changed between the nozzle of the recording head and the surface of the recording paper, and there is such a possibility that any recording defect may arise.

In order to dissolve the inconvenience as described above, the following conventional technique is known. That is, a printing paper support member is provided in the groove of the platen, and the printing paper support member is rotated while following the transport of the recording paper. Accordingly, the printing paper support member supports the recording paper advanced to the position over the groove. The portion, which supports the recording paper, is moved in the widthwise direction of the groove. Therefore, the recording paper is supported by the printing paper support member even when the recording paper is transported over the groove of the platen (see, for example, U.S. Patent Application Publication No. US 2002/191064 A1 corresponding to Japanese Patent Application Laid-open No. 2001-80145 and U.S. Patent Application Publication No. US 2002/154203 A1 corresponding to Japanese Patent Application Laid-open No. 2002-307769).

However, the conventional printing paper support member is rotated about the center of a predetermined rotation center shaft (see U.S. Patent Application Publication No. US 2002/191064 A1). Therefore, the forward end of the printing paper support member (portion to make contact with the recording paper) approaches the recording head, and then the forward end is separated therefrom. For this reason, the printing paper is not necessarily supported in parallel to the recording head at all times. In order to solve this problem, it is appropriate that the radius of rotation of the printing paper support member is set to be sufficiently large. However, in this case, a new problem arises such that the ink-jet recording apparatus is consequently large-sized. Another technique is known, in which the surface of the printing paper support member for supporting the recording paper is formed to be circular arc-shaped about the center of the rotation center shaft. However, in this case, the point for supporting the recording paper is consequently fixed. The end of the recording paper to be transported is not supported at all times. That is, when the surface for supporting the recording paper is formed to be circular arc-shaped, then the recording paper is supported at only the support point, and the portions corresponding to those other than the support point (areas disposed frontwardly and rearwardly with respect to the support point) are consequently warped. As a result, there is such a possibility that any recording defect may arise in the same manner as described above.

The relative positional relationship between the recording paper to be transported and the nozzle, especially the distance between the recording paper and the nozzle is important in order to vividly record the image by means of the ink-jet recording apparatus. In order that the distance is maintained to be constant, it is necessary to avoid the floating of the recording paper to be transported from the platen. The cause of the floating of the recording paper is principally the initial deformation (for example, bending and curvature) of the recording paper to be transported. However, it is also considered that the cause is the cockling phenomenon of the recording paper during the recording. In order to restrict the distance between the recording paper and the nozzle to be within a constant range, it is conceived that a guide member is installed on the platen in order to suppress the floating of the recording paper.

Some ink-jet recording apparatuses, which are available in recent years, are provided with, for example, the function to record the image as if a photograph print is produced. The image recording of this type is performed without providing any blank space at the edge of the recording paper, which is referred to as so-called "borderless recording". In contrast to the borderless recording, the recording, in which the blank space is provided, is referred to as "bordered recording". When the bordered recording is performed, a thin paper sheet having a relatively large size, which includes, for example, the regenerated paper and the regular paper of the A4 size, is used in many cases. For this reason, the deformation of the recording paper is apt to arise during the recording. Therefore, when the bordered recording is performed, any large deformation of the recording paper is avoided by providing the guide member as described above. As a result, the recording paper does not undergo, for example, the so-called paper jam and the stain or dirt which would be otherwise brought about by the interference with the recording head, and thus the vivid bordered recording is realized.

However, when the borderless recording is performed, the recording head discharges the ink to the outside of the recording paper while exceeding the edge of the recording paper. Therefore, when the borderless recording is performed, if the guide member is arranged on the platen, then the vivid borderless recording is inhibited. That is, in order to realize the vivid bordered recording, the guide member should be arranged on the platen so that the distance between the recording paper and the recording head is maintained to be within a constant range by restricting the floating of the recording paper from the platen. However, when the borderless recording is performed, it is feared that the guide member may intercept the ink droplets discharged from the recording head toward the recording paper. In this situation, an inconvenience arises such that it is difficult to perform the vivid borderless recording. On the other hand, when the borderless recording is performed, a thick paper sheet such as the glossy paper for the photograph is generally used in many cases. The deformation of the recording paper is hardly caused during the recording. Therefore, it is considered that the necessity of the guide member is low when the borderless recording is performed.

SUMMARY OF THE INVENTION

A first object of the present invention is to provide an ink-jet recording apparatus which makes it possible to perform the satisfactory borderless recording at a high speed by reliably supporting, on a platen, the end of the recording paper to be transported. A second object of the present invention is to provide an ink-jet recording apparatus which makes it possible to perform the bordered recording and which makes it possible to vividly record an image without intercepting ink droplets discharged to an edge of the recording paper when the borderless recording is performed.

According to the present invention, there is provided an ink-jet recording apparatus including:

a platen which supports recording paper;

a recording head which is arranged opposingly to the platen and which records an image on the recording paper transported onto the platen, by discharging ink droplets; and a movable support section which slidably moves in a transport direction on the platen and supports the recording paper while following the recording paper which is being transported.

The recording paper, which is transported onto the platen, is supported by the platen. The recording head is arranged opposingly to the platen. The recording head discharges the ink droplets while being moved in the main scanning direction. Accordingly, the image is recorded on the recording paper. The recording paper, which is transported onto the platen, is further transported in the transport direction. In this situation, the movable support section makes the sliding movement in the transport direction while supporting the recording paper. That is, the end of the recording paper is always supported by the movable support section. Accordingly, the recording paper is not warped in the transport direction. As a result, the distance between the recording paper and the recording head is maintained to be constant.

Further, when the recording paper is transported on the platen, the movable support section supports the recording paper. Therefore, even if any groove having a large groove width is formed between the first printing paper support section and the second printing paper support section, then the recording paper is not warped, and the recording paper does not enter the groove. Accordingly, the distance between the recording paper and the recording head is maintained to be constant, and the high image quality printing is realized. The groove described above can cover the entire ink discharge area of the recording head even when the recording head is large-sized, because the groove width can be set to be large as described above. As a result, the high speed of the borderless recording is realized as well.

The platen may include a frame which has an upper surface extending in the transport direction; a first printing paper support section which is provided to protrude on an upstream side of the upper surface in the transport direction; and a second printing paper support section which is provided to protrude on a downstream side of the upper surface in the transport direction so that a groove, which extends in a main scanning direction, is formed between the first printing paper support section and the second printing paper support section. Further, the movable support section may be provided slidably in the transport direction between a position adjacent to the first printing paper support section and a position adjacent to the second printing paper support section so that the movable support section follows the recording paper which is being transported in the transport direction.

In this arrangement, the recording paper, which is transported to the platen, is firstly supported by the first printing paper support section. Further, the recording paper is transported on the first printing paper support section, and the recording paper is fed toward the second printing paper support section. The groove is formed between the first printing paper support section and the second printing paper support section. The groove is formed at a position lower than those of the first printing paper support section and the second printing paper support section. For this reason, especially when the borderless recording is performed, the ink droplets may be discharged from the recording head while exceeding the edge of the recording paper. The ink droplets, which are discharged while exceeding the edge of the recording paper, are received by the groove. Therefore, an ink-absorbing member (typically a sheet-shaped sponge) may be laid on the bottom of the groove. The end of the recording paper, which is transported on the first printing paper support section, passes over the groove. In this situation, the movable support section is allowed to slide in the transport direction while following the recording paper to be transported. That is, the movable support section supports the recording paper to be transported, while making the sliding movement from the position adjacent to the first printing paper support section in the main scanning direction to the position adjacent to the second printing paper support section in the main scanning direction. Therefore, the end of the recording paper is always supported by the movable support section, which does not enter the groove. As a result, the distance between the recording paper and the recording head is maintained to be constant.

The first printing paper support section may have a plurality of first fixed ribs which are provided to protrude on a portion of the upper surface disposed on the upstream side in the transport direction and which are aligned in the main scanning direction; the second printing paper support section may have a plurality of second fixed ribs which are provided to protrude on a portion of the upper surface disposed on the downstream side in the transport direction and which are aligned in the main scanning direction; and the movable support section may have a plurality of movable ribs which are provided slidably between first positions at which the movable ribs are positioned between first fixed ribs included in the first fixed ribs and disposed adjacently to one another in the main scanning direction and second positions at which the movable ribs are positioned between second fixed ribs included in the second fixed ribs and disposed adjacently to one another in the main scanning direction. The movable ribs are ribs which extend in the transport direction. The shape of the movable rib may be, for example, rectangular. When the first printing paper support section, the second printing paper support section, and the movable support section are constructed of the ribs as described above, the contact area is decreased between the recording paper and the first printing paper support section, the second printing paper support section, and the movable support section. Therefore, the recording paper can be smoothly transported. Further, the first printing paper support section, the second printing paper support section, and the movable support section are structured extremely simply.

A width of the groove may be set to be wider than an ink discharge area of the recording head. The term "width of the groove" means the width in the transport direction of the recording paper, which is the width in the direction (subsidiary or secondary scanning direction) perpendicular to the main scanning direction. Accordingly, even when the ink droplets are discharged from all of the nozzles of the recording head when the recording paper is not arranged on the platen, all of the discharged ink droplets are landed on the bottom surface of the groove. Therefore, when the borderless recording is performed, the image can be recorded on the end of the recording paper without applying any complicated control to the recording head, although the ink droplets are discharged from all of the nozzles of the recording head. In other words, if the width of the groove is narrower than the ink discharge area of the recording head, the following operation is required. That is, when the forward end of the recording paper is subjected to the borderless recording, the ink droplets should be discharged from only the nozzles disposed on the upstream side of the recording head. As the recording paper is transported, the ink droplets should be successively discharged from the nozzles disposed on the downstream side as well. The complicated control is required for the recording head. However, in the case of the present invention, it is unnecessary to perform the complicated control as described above. The image can be recorded on the end of the recording paper by discharging the ink droplets from all of the nozzles as described above. That is, the borderless recording is performed at a high speed without applying any complicated control in relation to the discharge of the ink droplets from the nozzles. Further, the cross-sectional shape of the nozzle is not necessarily a perfect circle, and any minute dust adheres to the surface of the nozzle in some cases. Therefore, the ink droplets are sometimes discharged in slightly oblique directions without being discharged straight in the downward direction from the nozzles. Even in such situations, the ink droplets are not adhered to the outside of the groove, because the width of the groove is set to be wider than the ink discharge area of the recording head. As a result, the back surface of the recording paper is prevented from being dirtied by the ink.

Chamfering processing may be applied to a corner portion of the movable support section disposed on the upstream side in the transport direction. In this arrangement, even when the end of the recording paper having passed across the first printing paper support section abuts against the corner portion of the movable support section disposed on the upstream side in the transport direction, the end of the recording paper is smoothly guided by the upper surface of the movable support section. Therefore, the smooth transport of the recording paper is not inhibited by the provision of the movable support section.

The ink-jet recording apparatus may further include a movable rib-driving mechanism which arranges the movable ribs at the first positions when the recording paper is transported to an end of the frame disposed on the upstream side in the transport direction and which allows the movable ribs to slide in the transport direction while supporting an end of the recording paper as the recording paper is transported. Owing to the provision of the movable rib-driving mechanism, when the recording paper is transported to the platen, then the movable ribs are once moved to receive the recording paper to the upstream side in the transport direction, and the movable ribs slide to the downstream side in the transport direction while supporting the end of the recording paper in accordance with the transport of the recording paper. Accordingly, the end of the recording paper is always supported by the movable support section, which does not enter the groove. As a result, the distance between the recording paper and the recording head is reliably maintained to be constant.

The movable rib-driving mechanism may include: an input member which is subjected to sliding movement in the main scanning direction by the recording head; a rotary plate which is rotatably supported by a predetermined rotation center shaft provided on the frame and which is rotated around the rotation center shaft in a predetermined direction on the basis of the sliding movement of the input member; and a swinging member which has a central portion swingably supported by a predetermined swinging movement center shaft provided on the frame, a proximal end engaged with an engaging section provided for the rotary plate, and a forward end to be moved in the transport direction on a virtual plane parallel to the upper surface about a center of the swinging movement center shaft on the basis of rotation of the rotary plate; and wherein the movable support section may be attached to the forward end of the swinging member. The recording head is subjected to the reciprocating motion in the main scanning direction. The input member is displaced in the main scanning direction in accordance with the motion of the recording head. Specifically, for example, every time when the recording head makes the reciprocating motion, the recording head presses the input member. Accordingly, the input member is allowed to slide. When the input member is allowed to slide, the rotary plate is rotated in the predetermined direction. The central portion of the swinging member is provided on the frame by the aid of the swinging movement center shaft, and the proximal end of the swinging member is engaged with the engaging section provided for the rotary plate. Therefore, the swinging member makes the swinging movement about the center of the swinging movement center shaft in accordance with the rotation of the rotary plate. The movable ribs are attached to the forward end of the swinging member. Therefore, the movable ribs are allowed to slide in the transport direction in accordance with the swinging movement of the swinging member.

The ink-jet recording apparatus may further include a rotation-restricting member which effects restriction for the rotary plate to prevent the rotary plate from rotating in a direction opposite to the predetermined direction, the rotary plate being released from the restriction by allowing the input member to slide to a predetermined restriction release position; and a spring member which is attached to the rotary plate and which accumulates strain energy depending on an angle of rotation of the rotary plate in the predetermined direction. In this arrangement, the input member and the rotation-restricting member constitute a ratchet mechanism which rotates the rotary plate in only the predetermined direction and which restricts the rotation in the direction opposite to the predetermined direction. Therefore, every time when the recording head makes the reciprocating motion, the rotary plate is rotated in the predetermined direction. Accordingly, the spring member is strained, and the strain energy is accumulated. However, when the input member is allowed to slide to the predetermined restriction release position on the basis of the sliding movement of the recording head, then the rotary plate is released from the restriction of rotation, and the free rotation of the rotary plate is permitted. That is, the rotary plate is released from the restriction of rotation, and the strain energy, which is accumulated in the spring member, is released. Therefore, the rotary plate is rotated in the direction opposite to the predetermined direction.

Specifically, the movable ribs are arranged, for example, between the first fixed ribs and the second fixed ribs (at the central portion of the groove) in the normal state. After that, the movable ribs are allowed to slide in the transport direction in accordance with the reciprocating motion of the recording head. However, when the rotary plate is released from the restriction of rotation as described above, the movable ribs are arranged between the first fixed ribs and the second fixed ribs again. As described above, the movable ribs are arranged between the first fixed ribs and the second fixed ribs in the normal state. Therefore, when the borderless recording is not performed, the movable ribs may be fixed at the positions between the first fixed ribs and the second fixed ribs.

The ink-jet recording apparatus according to the present invention may further include a movable support section-driving member. The movable support section, which supports the recording objective medium transported in the transport direction perpendicular to the main scanning direction on the platen arranged under the recording head that makes the reciprocating movement in the main scanning direction, is allowed to slide in the transport direction by the movable support section-driving member while following the recording objective medium. The movable support section-driving member may include a rotary plate section which is rotatably supported by a predetermined rotation center shaft and which is engaged with an engaging section provided for the movable support section; and a guide groove which is provided on an engaging surface of the rotary plate section engaged with the engaging section of the movable support section and which guides the engaging section of the movable support section in the transport direction between an end of the platen disposed on an upstream side in the transport direction and an end of the platen disposed on a downstream side in the transport direction as the rotary plate section is rotated about a center of rotation of the rotation center shaft.

The recording objective medium (typically the recording paper), which is transported onto the platen, is transported in the transport direction while being supported by the platen. The recording head, which is arranged over the platen, discharges the ink droplets while making the sliding movement in the main scanning direction, and thus the image is recorded on the recording objective medium. In this arrangement, the movable support section-driving member may be driven and rotated about the center of the rotation center shaft.

The engaging section of the movable support section is engaged with the guide groove which is formed on the engaging surface of the rotary plate section. Therefore, when the rotary plate section is rotated in accordance with the rotation of the movable support section-driving member, the engaging section of the movable support section is smoothly moved in the transport direction between the end of the platen on the upstream side in the transport direction and the end on the downstream side in the transport direction. That is, the movable support section is allowed to slide in the transport direction while following the recording objective medium to be transported. Therefore, the end of the recording objective medium is always supported by the movable support section. As a result, the distance between the recording objective medium and the recording head is maintained to be constant. Even when the borderless recording is performed, the high image quality recording is realized.

The rotation center shaft may be arranged to extend in the direction perpendicular to both of the main scanning direction and the transport direction. In this arrangement, the rotation center shaft is arranged in the direction perpendicular to the surface of the platen on which the recording objective medium is placed. Therefore, the rotary plate section, which constitutes the movable support section-driving member, may be rotated in a state of being arranged in parallel to the surface of the platen for supporting the recording objective medium. Accordingly, the movable support section-driving member, which has the rotary plate section, may be arranged in a compact form in the vicinity of the platen.

The movable support section may be driven by a motor for transporting the recording objective medium positioned on the platen in the transport direction. In this arrangement, the recording objective medium is transported in the transport direction by means of the motor. In this situation, the movable support section-driving member is driven and rotated about the center of the rotation center shaft by means of the motor. As described above, the movable support section-driving member is driven by using the driving source of the motor which is provided to transport the recording objective medium positioned on the platen. Therefore, the rotation of the rotary plate section is smooth as well, and hence the smooth sliding movement of the movable support section is realized.

The rotary plate section may be formed to have a disk-shaped form in which the rotation center shaft penetrates through a central portion thereof. When the rotary plate section is formed to be disk-shaped, the structure of the movable support section-driving member is simplified. Further, the mechanism, which is provided to drive the movable support section-driving member, can be designed in a compact form as well.

The guide groove may be formed along a predetermined locus curve so that the engaging section of the movable support section is allowed to slide toward the end disposed on the upstream side in the transport direction when the recording objective medium is transported to the end of the platen disposed on the upstream side in the transport direction, while the engaging section of the movable support section is allowed to slide toward the downstream side in the transport direction while supporting an end of the recording objective medium accompanying transport of the recording objective medium. In this arrangement, the movable support section is once allowed to slide to receive the recording objective medium to the upstream side in the transport direction. After that, the movable support section is allowed to slide to the downstream side in the transport direction while supporting the end of the recording objective medium in accordance with the transport of the recording objective medium. Accordingly, the end of the recording objective medium is always supported by the movable support section. Therefore, the distance between the recording objective medium and the recording head is reliably maintained to be constant.

The predetermined locus curve may be an Archimedes' spiral. In this arrangement, the engaging section of the movable support section is moved in the radial direction from the center of the rotary plate at a velocity corresponding to the velocity of rotation in accordance with the rotation of the rotary plate section. Therefore, the movable support section smoothly follows at a constant velocity corresponding to the velocity of transport of the recording objective medium, and it is possible to make the synchronization with the recording objective medium to be transported. Accordingly, for example, when the rotary plate section is driven by the motor, and the high resolution recording is performed, then the feed amount (line feed width) of the recording objective medium is set to be small. In such a situation, the angle of rotation of the rotary plate section is decreased corresponding thereto, and the amount of movement of the movable support section is decreased as well. On the contrary, when the low resolution recording is performed, the feed amount (line feed width) of the recording objective medium is set to be large. In such a situation, the angle of rotation of the rotary plate section is increased corresponding thereto, and the amount of movement of the movable support section is increased as well.

The Archimedes' spiral may be formed bilaterally symmetrically in relation to a center of a virtual reference axis which passes through a center of the rotary plate section and which is formed on the engaging surface. In this arrangement, the movable support section is once allowed to slide to receive the recording objective medium to the upstream side from the predetermined initial position. The movable support section is continuously allowed to slide to the downstream side in the transport direction while supporting the end of the recording objective medium in accordance with the transport of the recording objective medium. Further, the movable support section is continuously allowed to slide to the upstream side in the transport direction to return to the initial position. Therefore, the movable support section is correctly arranged at the predetermined initial position at all times.

The ink-jet recording apparatus according to the present invention may further include a restricting member which restricts a distance between the recording head and the recording paper to be transported so that the distance is within a constant range by overlapping with an edge of the recording paper in the transport direction; and a retracting mechanism which retracts the restricting member in a direction perpendicular to the transport direction so that the restricting member does not overlap with the edge when borderless recording is performed.

The predetermined image is recorded on the recording paper such that the recording paper is transported onto the platen, and the ink droplets are discharged while allowing the recording head to slide in the direction (i.e., the main scanning direction) perpendicular to the transport direction of the recording paper. In general, when the image is recorded, it is important that the distance between the recording paper and the recording head is maintained to be constant, for the following reason. That is, the ink droplets, which are discharged from the recording head, are extremely fine and minute. Therefore, if the distance is increased, then the ink is diffused in a form of fog or mist, and the image is ambiguous. If the distance is decreased, the ink is blurred. As a result, it is impossible to perform the vivid image recording. The cause of the change of the distance between the recording paper and the recording head includes the deformation (initial deformation) such as the bending already caused at the point of time at which the recording paper is transported onto the platen, and the cockling phenomenon caused during the image recording.

When the bordered recording is performed, the regular paper is generally used as the recording paper. In particular, when the recording paper is a thin paper sheet having a relatively large size such as the regular paper of the A4 size, the edge of the recording paper in the transport direction tends to float over the platen, due to the cause of the cockling phenomenon which arises during the recording. On the other hand, the borderless recording is usually performed as a recording mode to print the photograph image. In this case, the recording paper is a thick paper sheet such as the glossy paper for the photograph in many cases. In the case of the thick paper sheet as described above, for example, the bending is hardly caused, and the cockling phenomenon is hardly caused as well. Therefore, the end of the recording paper in the transport direction tends to hardly float over the platen.

When the bordered recording is performed, the restricting member is overlapped with the edge of the recording paper. Therefore, even if the recording paper to be transported causes the initial deformation, and even if the recording paper undergoes the occurrence of the cockling phenomenon during the recording, then the distance between the recording paper and the recording head is regulated or restricted to be within a constant range. When the borderless recording is performed, the restricting member is retracted, for example, in the direction perpendicular to the transport direction. Therefore, the restricting member is not overlapped with the recording paper transported on the platen. Therefore, when the borderless recording is performed, the ink droplets, which are discharged from the recording head, reliably arrive at the edge of the recording paper without being intercepted. As described above, when the borderless recording is performed, the floating of the recording paper from the platen is hardly caused. Therefore, the situation, in which the restricting member is not overlapped with the recording paper, does not result in the decrease in the image quality.

The restricting member may have a slender flat plate which is arranged between the platen and an ink discharge surface of the recording head and which extends in the transport direction. A portion of the slender flat plate, which is disposed on an upstream side of a movement area of the recording head in the transport direction may be bent obliquely upwardly so that the portion extends upwardly as compared with the ink discharge surface.

The restricting member is constructed of the slender flat plate. Therefore, an advantage is obtained such that the structure of the restricting member is extremely simple. Further, the slender flat plate is bent as described above. Owing to this fact, when the initial deformation of the recording paper transported onto the platen is large, for example, even when the deformation is caused to such an extent that the recording paper makes contact with the recording head, then the recording paper is guided by the slender flat plate, and the recording paper is reliably inserted into the space between the restricting member and the platen. Therefore, even when the recording paper is bent and curved, then the contact between the recording paper and the recording head is avoided, and the vivid bordered recording is realized.

The platen may include a frame which has an upper surface for placing the recording paper thereon. Further, the retracting mechanism may include an input member which is allowed to slide in the direction perpendicular to the transport direction by the recording head; a rotary plate which is supported rotatably by a predetermined rotation center shaft provided on the frame and which is rotated around the rotation center shaft in a predetermined direction on the basis of sliding movement of the input member; and a sliding member to which the restricting member is connected, which is engaged with an engaging section provided for the rotary plate, and which is allowed to slide in the direction perpendicular to the transport direction on the basis of rotation of the rotary plate.

The recording head is subjected to the reciprocating movement in the main scanning direction, and the input member is displaced in the main scanning direction in accordance with the motion of the recording head. Specifically, for example, every time when the recording head makes the reciprocating motion, the recording head presses the input member. Accordingly, the input member is allowed to slide. When the input member is allowed to slide, the rotary plate is rotated in the predetermined direction. The sliding member is allowed to slide in the main scanning direction in accordance with the rotation of the rotary plate. The restricting member is connected to the sliding member. Therefore, when the sliding member makes the sliding movement, the restricting member is displaced in the main scanning direction. That is, the restricting member is allowed to slide in the direction perpendicular to the transport direction so that the overlap as described above is not caused.

The restricting members may be formed as a plurality of restricting members arranged opposingly in the direction perpendicular to the transport direction. That is, it is preferable that a pair of the restricting members are arranged opposingly in the main scanning direction. The retracting mechanism may include a rack and pinion mechanism which is provided between a pair of sliding members connected to the restricting members respectively.

A pair of the opposing edges are overlapped with the restricting members, because the pair of the restricting members are arranged opposingly. Accordingly, when the bordered recording is performed, the distance between the recording paper and the recording head is reliably regulated to be within a constant range, even when the cockling phenomenon arises as described above. Further, the pair of the sliding members are connected to one another by the aid of the rack and pinion mechanism. Therefore, the respective restricting members are retracted while being equivalently separated from each other in the directions perpendicular to the transport direction. Therefore, the overlap between the restricting members and the recording paper transported on the platen is reliably avoided.

The retracting mechanism may further include a rotation-restricting member which effects restriction for the rotary plate to prevent the rotary plate from rotating in a direction opposite to the predetermined direction, the rotary plate being released from the restriction by allowing the input member to slide to a predetermined restriction release position; and a spring member which is attached to the rotary plate and which accumulates strain energy depending on an angle of rotation of the rotary plate in the predetermined direction.

The input member and the rotation-restricting member constitute a ratchet mechanism which rotates the rotary plate in only the predetermined direction and which restricts the rotation in the direction opposite to the predetermined direction. Therefore, every time when the recording head makes the reciprocating motion, the rotary plate is rotated in the predetermined direction, and the spring member is strained. Accordingly, the strain energy is accumulated in the spring member. However, when the input member is allowed to slide to the predetermined restriction release position on the basis of the sliding movement of the recording head, the rotary plate is released from the restriction of rotation. That is, the free rotation of the rotary plate is permitted. Therefore, the strain energy, which is accumulated in the spring member, is released, and the rotary plate is rotated in the direction opposite to the predetermined direction. When the rotary plate is rotated in the direction opposite to the predetermined direction, the restricting members are restored to the initial positions. That is, when the recording paper is transported on the platen, the edges of the recording paper are overlapped with the restricting members.

The retracting mechanism may further include a slide guide member which guides sliding movement of the sliding member. The sliding member is allowed to slide smoothly by the aid of the slide guide member. Therefore, the restricting member is operated smoothly as well.

The retracting mechanism may further include an actuator which retracts the restricting member in a direction perpendicular to a surface of the recording paper which is being transported.

DESCRIPTION OF THE PREFERRED EMBODIMENTS

The present invention will be explained in detail below with reference to the drawings appropriately on the basis of preferred embodiments. The embodiments of the present invention are described merely by way of example. It goes without saying that the embodiments may be appropriately changed within a range without changing the gist or essential characteristics of the present invention.

First Embodiment

Figure 1:
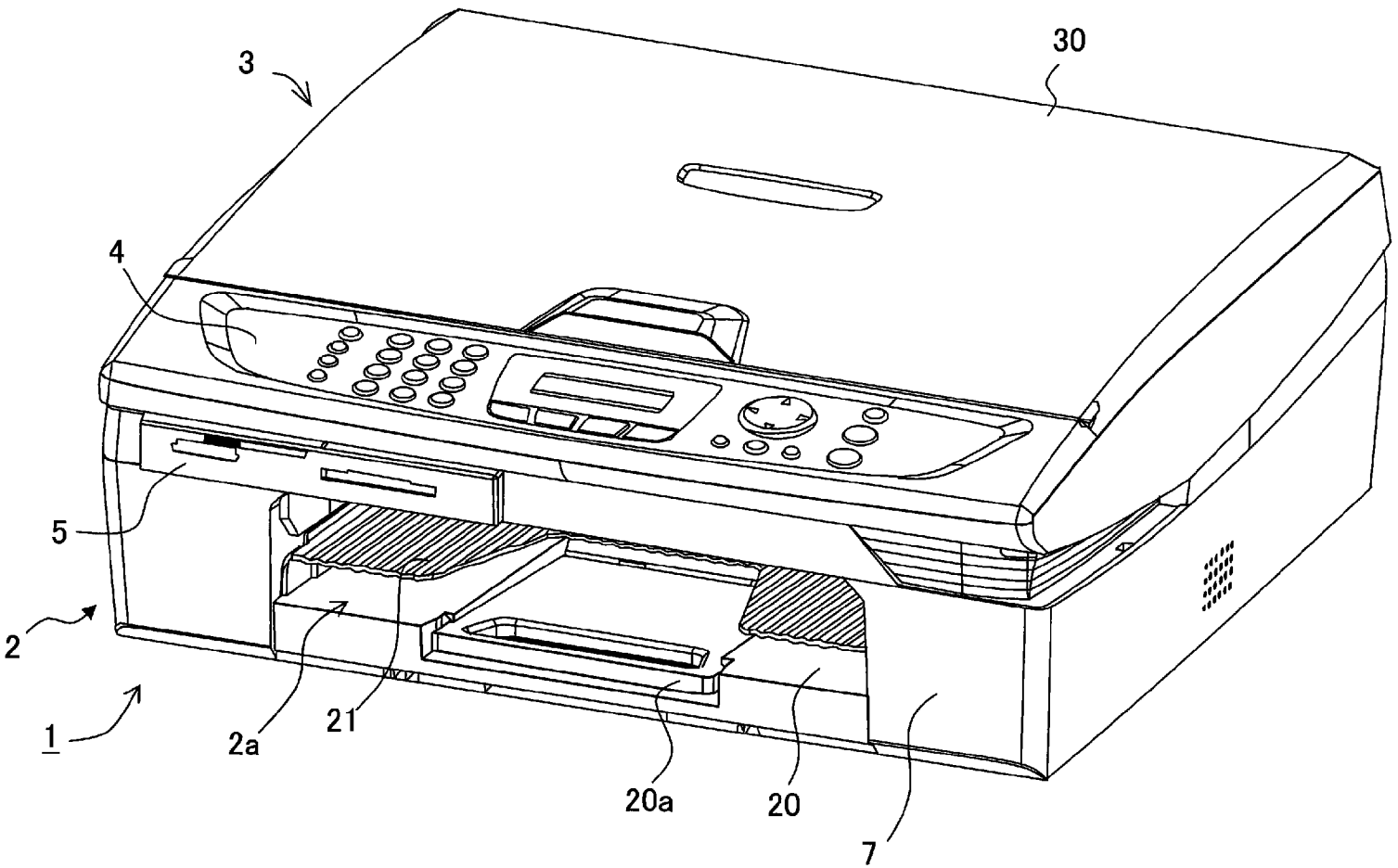
FIG. 1 shows a perspective view illustrating an appearance of a multifunction machine according to a first embodiment of the present invention.
Figure 2:
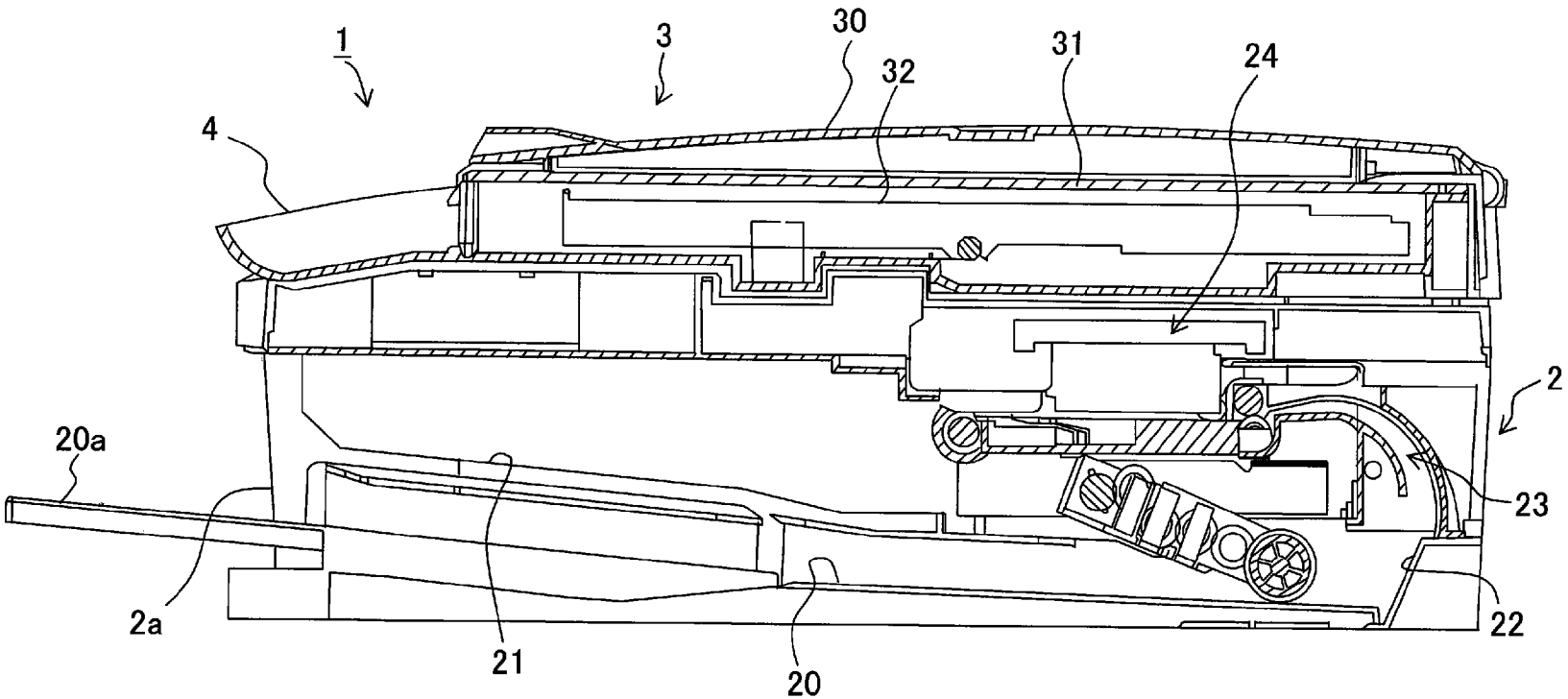
FIG. 2 shows a vertical sectional view illustrating the multifunction machine according to the first embodiment of the present invention.

FIG. 1 shows a perspective view illustrating an appearance of a multifunction machine 1 incorporated with a movable support section-driving member (rotary plate 125 described later on) according to a first embodiment of the present invention. FIG. 2 shows a vertical sectional view illustrating the internal structure of the multifunction machine 1.

The multifunction machine 1 is a multi function device (MFD) integrally including a printer section 2 which is composed of an ink-jet recording unit disposed at the lower portion, and a scanner section 3 which is disposed at the upper portion. The multifunction machine 1 has the printer function, the scanner function, the copy function, and the facsimile function. Any function other than the printer function may be omitted from the multifunction machine 1. For example, the multifunction machine 1 may be constructed as a single function printer from which the scanner section 3 is omitted. This embodiment has the following feature as described later on (see FIG. 9). That is, the printer section 2 includes a platen 42 which supports the recording paper (recording objective medium), a movable support section 88 which is provided for the platen 42, and an interlocking mechanism 105 which allows the movable support section 88 to slide corresponding to the transport of the recording paper. Further, the interlocking mechanism 105 is provided with the rotary plate 125 (see FIG. 12). Accordingly, the movable support section 88 is allowed to slide in synchronization with the transport of the recording paper.

When the ink-jet recording apparatus according to the present invention is embodied as a multifunction apparatus, then the multifunction apparatus may be of the small type such as the multifunction machine 1 shown in this embodiment, or the multifunction apparatus may be provided with a plurality of paper feed cassettes and/or an auto document feeder (ADF). The printer section 2 of the multifunction machine 1 is principally connected to an external information apparatus such as a computer to record images and documents on the recording paper on the basis of the printing data including the image data and the document data transmitted from the computer or the like. A digital camera or the like can be connected to the multifunction machine 1 to record, on the recording paper, the image data outputted from the digital camera or the like. Various storage media such as a memory card can be charged into the multifunction machine 1 to record, on the recording paper, the image data or the like recorded on the storage media as well.

As shown in FIG. 1, the multifunction machine 1 has an approximately rectangular parallelepiped-shaped external shape of the wide width thin type in which the lateral width and the depth are larger than the height. The lower portion of the multifunction machine 1 is the printer section 2. The printer section 2 has an opening 2*a* which is formed at the front. A paper feed tray 20 and a paper discharge tray 21 are provided at the two stages, i.e., the upper and lower stages at the inside of the opening 2*a*. The recording paper is stored in the paper feed tray 20. The recording paper accommodated therein includes those of various sizes of not more than the A4 size including, for example, the postcard size and the B5 size. The paper feed tray 20 is provided with a slide tray 20*a*. When the slide tray 20*a* is drawn, if necessary, the tray surface is expanded (see FIG. 2). Accordingly, the paper feed tray 20 can accommodate, for example, the recording paper of the legal size. The recording paper, which is accommodated in the paper feed tray 20, is fed into the printer section 20 to record a desired image thereon, and the recording paper is discharged to the paper discharge tray 21.

The upper portion of the multifunction machine 1 is the scanner section 3 which is constructed as a so-called flat bed scanner. As shown in FIGS. 1 and 2, a platen glass 31 and an image sensor 32 are provided under a manuscript cover 30 which is provided openably/closably as a top plate of the multifunction machine 1. A manuscript, from which the image is to be read, is placed on the platen glass 31. The image sensor 32, which has the main scanning direction coincident with the depth direction of the multifunction machine 1 (left and right directions in FIG. 2), is provided under the platen glass 31 so that the image sensor 32 is capable of performing the reciprocating movement in the widthwise direction of the multifunction machine 1 (direction perpendicular to the paper surface of FIG. 2).

An operation panel 4, with which the printer section 2 and the scanner section 3 are operated, is provided at an upper front portion of the multifunction machine 1. The operation panel 4 includes various operation buttons and a liquid crystal display section. The multifunction machine 1 is operated on the basis of the operation instruction supplied from the operation panel 4. When the multifunction machine 1 is connected to the external computer, the multifunction machine 1 is also operated on the basis of the instruction transmitted from the computer by the aid of a printer driver or a scanner driver. A slot section 5 is provided at an upper-left front portion of the multifunction machine 1 (see FIG. 1). Various small-type memory cards as storage media can be charged into the slot section 5. When the predetermined operation is performed with the operation panel 4, the image data, which is stored in the small-type memory card charged into the slot section 5, is read. The information about the read image data is displayed on the liquid crystal display section of the operation panel 4. An arbitrary image is recorded on the recording paper by the printer section 2 on the basis of the display.

An explanation will be made below about the internal structure of the multifunction machine 1, especially about the structure of the printer section 2.

As shown in FIG. 2, the paper feed tray 20 is provided on the bottom side of the multifunction machine 1, and a separating inclined plate 22 is provided on the deep side of the paper feed tray 20. The separating inclined plate 22 separates the sheets of the recording paper fed from the paper feed tray 20 while being stacked so that the recording paper, which is disposed at the uppermost position, is guided upwardly. A printing paper transport passage 23 extends from the separating inclined plate 22 upwardly, and then it was bent toward the front side to extend from the back side to the front side of the multifunction machine 1. The printing paper transport passage 23 passes along an image-recording unit 24, and it arrives at a paper discharge tray 21. Therefore, the recording paper, which is accommodated in the paper feed tray 20, is guided so that the recording paper makes the U-turn from the lower side to the upper side by the aid of the printing paper transport passage 23, and the recording paper arrives at the image-recording unit 24. The image is recorded thereon by the image-recording unit 24, and then the recording paper is discharged to the paper discharge tray 21.

Figure 3:
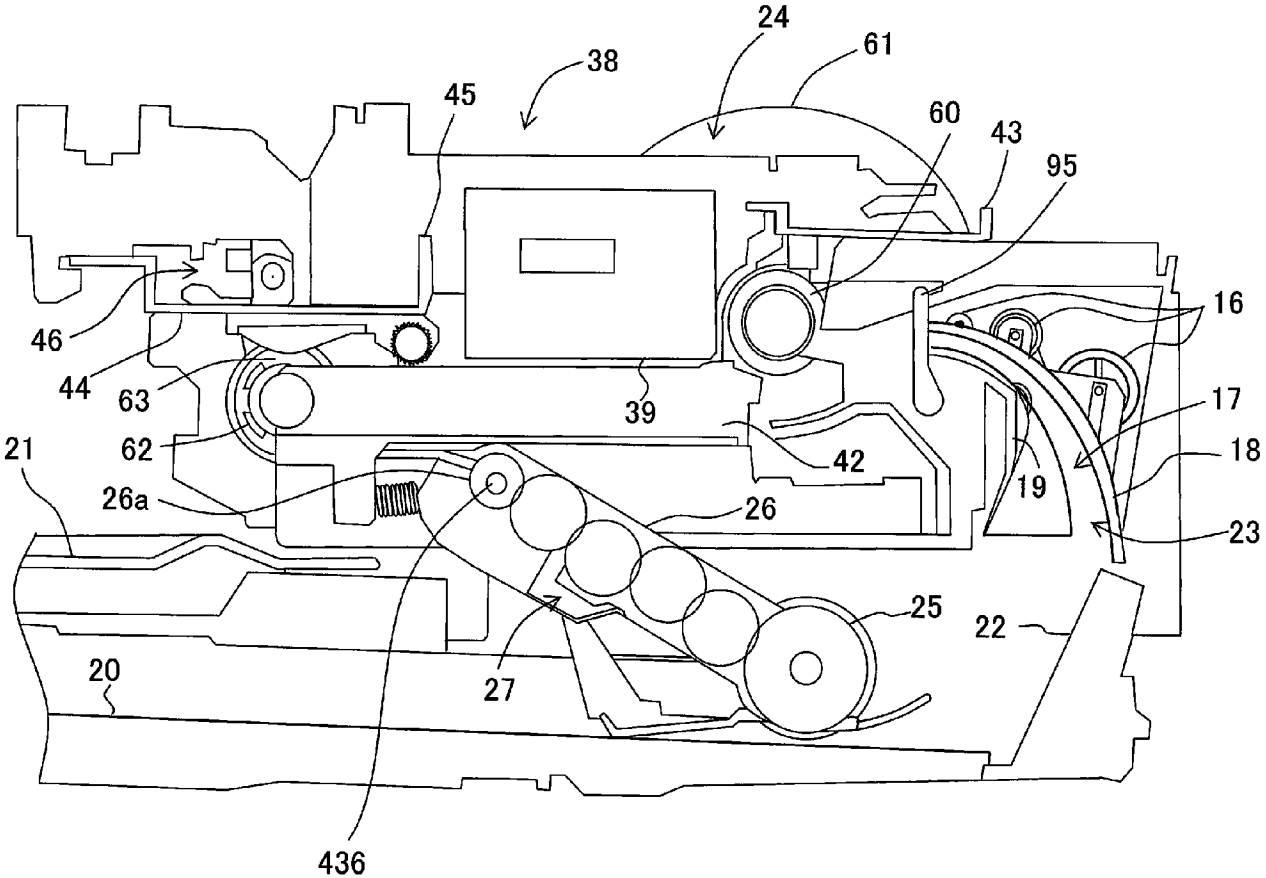
FIG. 3 shows a partial magnified sectional view illustrating the multifunction machine according to the first embodiment of the present invention.

FIG. 3 shows a partial magnified sectional view illustrating the principal structure of the printer section 2.

As shown in FIG. 3, a paper feed roller 25 is provided on the upper side of the paper feed tray 20. The recording paper, which is stacked on the paper feed tray 20, is supplied by the paper feed roller 25 to the printing paper transport passage 23. The paper feed roller 25 is rotatably supported at the forward end of a paper feed arm 26. The paper feed roller 25 is driven and rotated by means of an LF motor 71 (see FIG. 5) as a driving source by the aid of a driving force-transmitting mechanism 27. The driving force-transmitting mechanism 27 has a plurality of gears, which is constructed by meshing the plurality of gears with each other.

The paper feed arm 26 is supported by a base shaft 26*a*. The paper feed arm 26 is provided rotatably about the rotary shaft of the base shaft 26*a*. Accordingly, the paper feed arm 26 is capable of making upward and downward movement so that the paper feed arm 26 can make contact and separation with respect to the paper feed tray 20. However, the paper feed arm 26 is urged by the self-weight or by a spring or the like, and thus the paper feed arm 26 is urged to make rotation downwardly so that the paper feed arm 26 makes contact with the paper feed tray 20. The paper feed arm 26 is retracted upwardly when the paper feed tray 20 is inserted or extracted. Further, the paper feed arm 26 is supported by a proximal end shaft 436. The paper feed arm 26 is rotatable about the proximal end shaft 436. Accordingly, the paper feed arm 26 is capable of making the swinging movement in the vertical direction about the swinging movement center of the proximal end shaft 436. When the paper feed arm 26 is rotated downwardly, the paper feed roller 25, which is rotatably supported at the forward end thereof, makes contact under pressure with the recording paper disposed on the paper feed tray 20. When the paper feed roller 25 is rotated in this state, the recording paper, which is disposed at the uppermost position, is fed to the separating inclined plate 22 by means of the frictional force exerted between the recording paper and the roller surface of the paper feed roller 25. The recording paper is guided upwardly while the forward end thereof is allowed to abut against the separating inclined plate 22. The recording paper is supplied into the printing paper transport passage 23. When the sheet of the recording paper, which is disposed at the uppermost position, is fed by the paper feed roller 25, a sheet of the recording paper, which is disposed just thereunder, is fed together in some cases due to the action of the friction and/or the static electricity. However, such a sheet of the recording paper is stopped by the abutment against the separating inclined plate 22.

The printing paper transport passage 23 is formed and comparted by the outer guide surface and the inner guide surface which are opposed to one another at a predetermined spacing distance, except for the portion at which the image-recording unit 24 and associated components are arranged. For example, the outer guide surface is constructed by the surface of the frame of the multifunction machine 1 on the back surface side of the multifunction machine 1, and the inner guide surface is constructed by the surface of a guide member fixed in the frame. A curved section 17 of the printing paper transport passage 23, which is disposed on the back surface side of the multifunction machine 1, is constructed such that an outer guide member 18 and an inner guide member 19 are fixed to the apparatus frame. Rotary rollers or runners 16 are provided for the printing paper transport passage 23, especially at portions at which the printing paper transport passage 23 is bent. The rotary rollers 16 are provided rotatably while the axial direction resides in the widthwise direction of the printing paper transport passage 23. Roller surfaces of the rotary rollers 16 are exposed with respect to the outer guide surface. Therefore, the recording paper is smoothly transported even at the portions at which the printing paper transport passage 23 is bent.

As shown in FIG. 3, the image-recording unit 24 is arranged over the printing paper transport passage 23. The image-recording unit 24 is provided with a carriage 38 which carries an ink-jet recording head 39 and which makes the reciprocating movement in the main scanning direction (as well as the platen 42). Inks of respective colors of cyan (C), magenta (M), yellow (Y), and black (Bk) are supplied to the ink-jet recording head 39 via ink tubes 41 (see FIG. 4) from ink cartridges which are arranged independently from the ink-jet recording head 39 in the multifunction machine 1. The inks of respective colors are selectively discharged as minute ink droplets from the ink-jet recording head 39 during the reciprocating movement of the carriage 38. Accordingly, the image is recorded on the recording paper transported on the platen 42. The ink cartridges are not shown in FIGS. 3 and 4.

Figure 4:
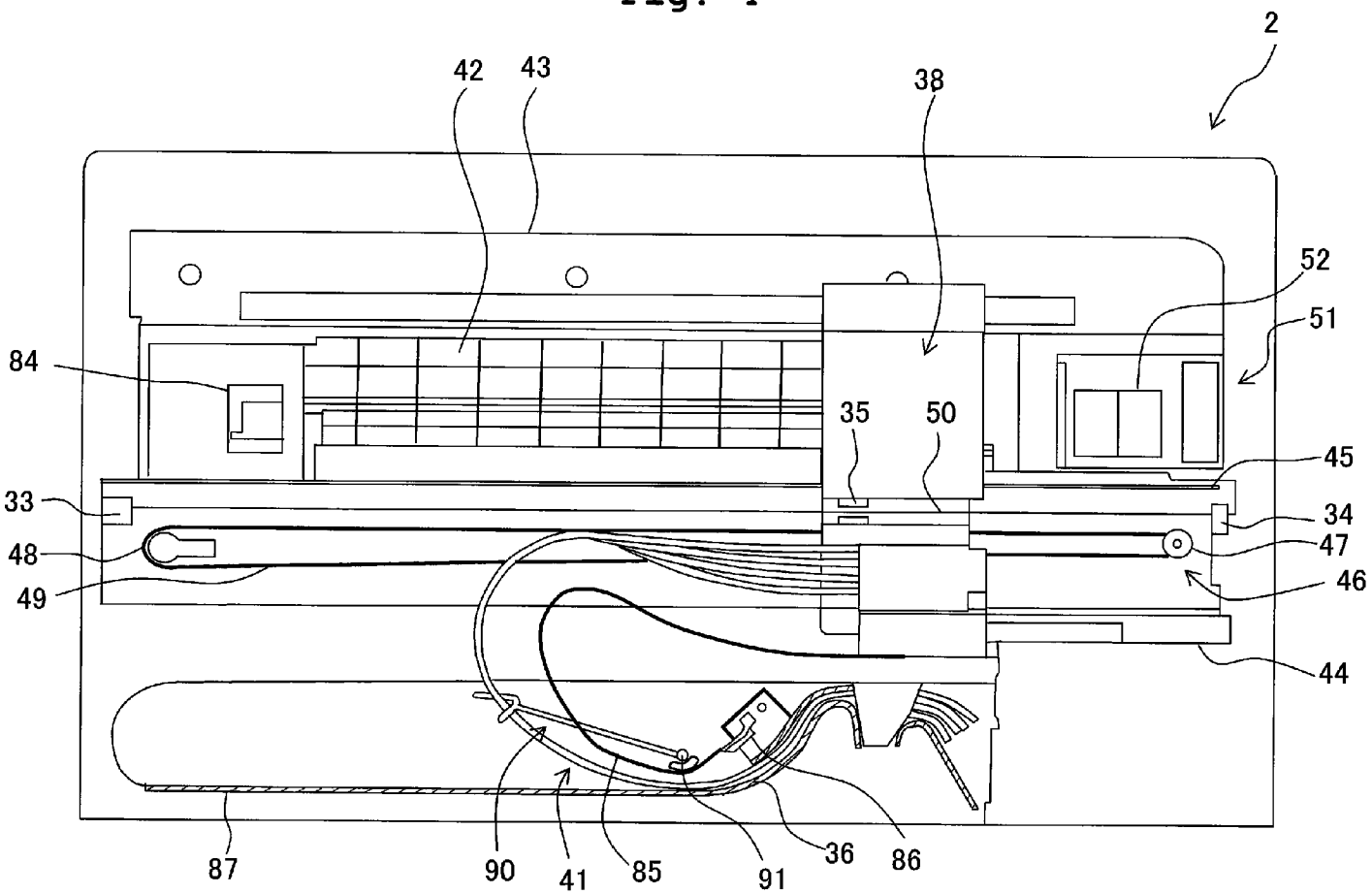
FIG. 4 shows a plan view illustrating a printer section of the multifunction machine according to the first embodiment of the present invention.
Figure 5:
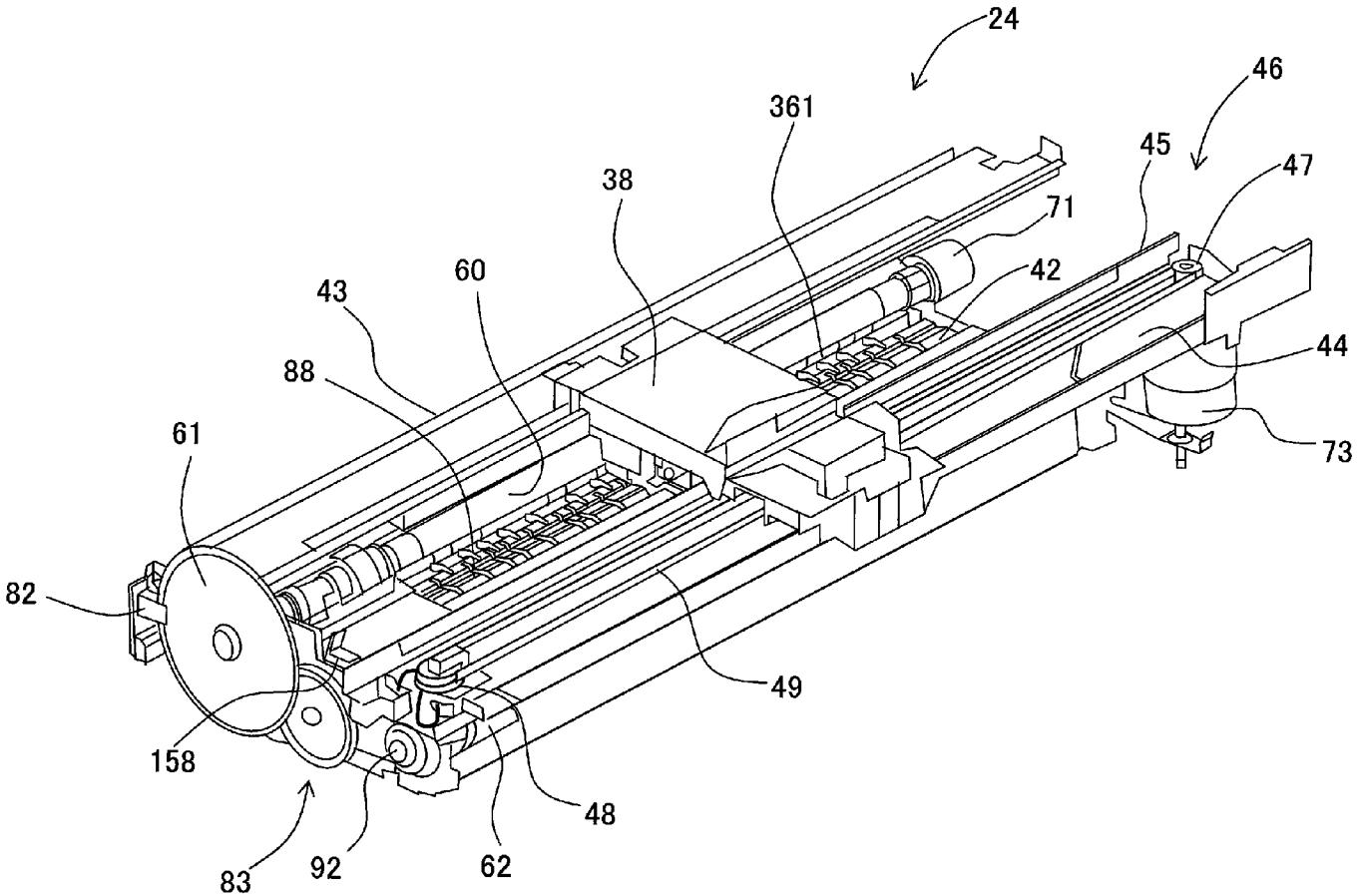
FIG. 5 shows a perspective view illustrating the printer section of the multifunction machine according to the first embodiment of the present invention.

FIG. 4 shows a plan view illustrating the principal structure of the printer section 2, which principally illustrates the structure of the printer section 2 over an area from a substantially central portion to the back surface side of the apparatus. FIG. 5 shows the principal structure of the printer section 2, which illustrates the structure of the image-recording unit 24.

As shown in FIGS. 4 and 5, a pair of guide rails 43, 44 are arranged over the printing paper transport passage 23. The guide rails 43, 44 are opposed to one another while being separated from each other by a predetermined distance in the transport direction of the recording paper (direction directed from the upper side to the lower side in FIG. 4). Further, the guide rails 43, 44 are provided to extend in the direction (left and right directions in FIG. 4) perpendicular to the transport direction of the recording paper. The guide rails 43, 44 are provided in the casing of the printer section 2, which constitute a part of the frame for supporting the respective members for constructing the printer section 2. The carriage 38 is placed so that the carriage 38 is capable of making the sliding movement in the direction perpendicular to the transport direction of the recording paper while the carriage 38 spans or rides over the guide rails 43, 44. When the guide rails 43, 44 are aligned substantially horizontally in the transport direction of the recording paper as described above, then the height of the printer section 2 is lowered, and the thin type apparatus is realized.

The guide rail 43, which is arranged on the upstream side in the transport direction of the recording paper, has a flat plate-shaped form in which the length in the widthwise direction (left and right directions in FIG. 4) of the printing paper transport passage 23 is longer than the reciprocating movement range of the carriage 38. The guide rail 44, which is arranged on the downstream side in the transport direction of the recording paper, has a flat plate-shaped form in which the length in the widthwise direction of the printing paper transport passage 23 is approximately the same as the length of the guide rail 43. The end of the carriage 38, which is disposed on the upstream side in the transport direction, is placed on the guide rail 43. The end of the carriage 38, which is disposed on the downstream side in the transport direction, is placed on the guide rail 44. The carriage 38 is subjected to the sliding movement in the longitudinal direction of the respective guide rails 43, 44.

An edge 45 of the guide rail 44, which is disposed on the upstream side in the transport direction, is bent substantially perpendicularly in the upward direction. The carriage 38, which is carried by the guide rails 43, 44, slidably interposes the edge 45 by means of interposing members such as a pair of rollers. Accordingly, the carriage 38 is positioned in the transport direction of the recording paper. Further, the carriage 38 is capable of making the sliding movement in the direction perpendicular to the transport direction of the recording paper. In other words, the carriage 38 is slidably carried on the guide rails 43, 44. The carriage 38 makes the reciprocating movement in the direction perpendicular to the transport direction of the recording paper on the basis of the edge 45 of the guide rail 44. Although not shown, a lubricant such as grease is applied to the edge 45 in order to smoothly perform the sliding movement of the carriage 38.

A belt drive mechanism 46 is arranged on the upper surface of the guide rail 44. The belt drive mechanism 46 is constructed such that an endless annular timing belt 49, which has teeth provided inside, is stretched between a driving pulley 47 and a driven pulley 48 which are provided in the vicinity of the both ends in the widthwise direction of the printing paper transport passage 23 respectively. The driving force is transmitted from a CR motor 73 (see FIG. 5) to the shaft of the driving pulley 47. The timing belt 49 performs the rounding motion in accordance with the rotation of the driving pulley 47. The timing belt 49 is not limited to the endless annular type. Other than the above, a type in which both ends of an ended belt are secured to the carriage 38 may also be adopted.

The carriage 38 is secured to the timing belt 49 on the bottom surface side thereof. Therefore, the carriage 38 makes the reciprocating movement on the guide rails 43, 44 on the basis of the edge 45, on the basis of the rounding motion of the timing belt 49. The ink-jet recording head 39 is carried on the carriage 38 as described above. The ink-jet recording head 39 is subjected to the reciprocating movement while the main scanning direction is the widthwise direction of the printing paper transport passage 23.

As shown in FIG. 4, an encoder strip 50 of a linear encoder 77 (see FIG. 8) is arranged on the guide rail 44. The encoder strip 50 has a band-shaped form composed of transparent resin. A pair of support sections 33, 34 are formed at the both ends of the guide rail 44 in the widthwise direction (reciprocating movement direction of the carriage 38) so that the pair of support sections 33, 34 rise from the upper surface thereof. The encoder strip 50 has the both ends which are fastened by the support sections 33, 34, and the encoder strip 50 is spanned along the edge 45. Although not shown in FIG. 4, a plate spring is provided for one of the support sections 33, 34. The end of the encoder strip 50 is fastened by the plate spring. The tensile force acts on the encoder strip 50 in the longitudinal direction by means of the plate spring to avoid any occurrence of looseness. Further, when any external force is exerted on the encoder strip 50, then the plate spring is elastically deformed, and the encoder strip 50 is flexibly bent or warped.

A pattern, in which light-transmitting sections for transmitting the light and light-shielding sections for shielding the light are alternately arranged at predetermined pitches in the longitudinal direction, is formed on the encoder strip 50. An optical sensor 35, which is a transmission type sensor, is provided at a position corresponding to the encoder strip 50 on the upper surface of the carriage 38. The optical sensor 35 makes the reciprocating movement in the longitudinal direction of the encoder strip 50 together with the carriage 38 to detect the pattern of the encoder strip 50 during the reciprocating movement. The ink-jet recording head 39 is provided with a head control board for controlling the ink discharge. The head control board outputs a pulse signal on the basis of a detection signal obtained by the optical sensor 35. The position of the carriage 38 is judged on the basis of the pulse signal, and the reciprocating movement of the carriage 38 is controlled thereby. In FIGS. 4 and 5, the head control board is covered with a head cover of the carriage 38, which is not shown in the drawings.

As shown in FIGS. 3 and 4, the platen 42 is arranged under the printing paper transport passage 23 while being opposed to the ink-jet recording head 39. The platen 42 is arranged to range over a central portion along which the recording paper passes, of the reciprocating movement range of the carriage 38. The width of the platen 42 is sufficiently larger than the maximum width of the recording paper capable of being transported. The both ends of the recording paper always pass over the platen 42. A movable support section 88 (see FIG. 5) is provided for the platen 42 as described in detail later on. The movable support section 88 is movable in the transport direction while following the recording paper transported on the platen 42 so that the end of the recording paper is always supported.

As shown in FIG. 4, a maintenance unit, which includes, for example, a purge mechanism 51 and a waste ink tray 84, is arranged in the range in which the recording paper does not pass, i.e., without the image-recording range defined by the ink-jet recording head 39. The purge mechanism 51 sucks and removes bubbles and foreign matters from nozzles 53 (see FIG. 6) of the ink-jet recording head 39. The purge mechanism 51 includes a cap 52 which covers the nozzles 53 of the ink-jet recording head 39, a pump mechanism which is connected to the ink-jet recording head 39 by the aid of the cap 52, and a moving mechanism which makes contact and separation of the cap 52 with respect to the nozzles 53 of the ink-jet recording head 39. In FIG. 4, the pump mechanism and the moving mechanism are disposed under the guide frame 44, which are not shown in the drawing.

When the bubbles or the like are sucked and removed from the ink-jet recording head 39, the carriage 38 is moved so that the ink-jet recording head 39 is positioned over the cap 52. The cap 52 is moved upwardly in this state, and the cap 52 is allowed to make tight contact with the lower surface of the ink-jet recording head 39 so that the nozzles 53 are tightly closed. When the interior of the cap 52 is allowed to have a negative pressure by means of the pump mechanism, the inks are sucked from the nozzles 53 of the ink-jet recording head 39. The bubbles and the foreign matters contained in the nozzles 53 are sucked and removed together with the inks.

The waste ink tray 84 is employed to receive the empty discharge of the inks from the ink-jet recording head 39 called "flashing" in order to remove the bubbles or the like from the ink-jet recording head 39. The waste ink tray 84 is formed within the reciprocating movement range of the carriage 38 and without the image recording range on the upper surface of the platen 42. A felt is laid in the waste ink tray 84. The ink, which is subjected to the flashing, is absorbed and retained by the felt. The maintenance is performed, for example, to avoid the drying and remove the bubble and the mix color ink from the interior of the ink-jet recording head 39 by using the maintenance unit as described above.

As shown in FIG. 1, a door 7 is provided openably/closably at the front of the casing of the printer section 2. When the door 7 is opened, the cartridge-installing section is exposed to the front side of the apparatus, and the ink cartridges can be installed and withdrawn. Although not shown, the cartridge-installing section is comparted into four accommodating chambers corresponding to the ink cartridges. The ink cartridges, which retain the inks of the respective colors of cyan, magenta, yellow, and black, are accommodated in the respective accommodating chambers. The four ink tubes 41, which correspond to the inks of the respective colors, are laid out from the cartridge-installing section to the carriage 38. The inks of the respective colors are supplied from the ink cartridges installed to the cartridge-installing section via the respective ink tubes 41 to the ink-jet recording head 39 carried on the carriage 38 as described above.

As shown in FIG. 4, the ink tube 41 is a tube made of synthetic resin, which has the flexibility to be flexibly bent or warped while following the reciprocating movement of the carriage 38. The respective ink tubes 41, which are derived from the cartridge-installing section, are led to the positions in the vicinity of the center along the widthwise direction of the apparatus. The ink tubes 41 are once fixed to a fixing clip 36 of the main apparatus body. The portions of the respective ink tubes 41, which range from the fixing clip 36 to the carriage 38, are not fixed, for example, to the main apparatus body. The portions undergo the posture change while following the reciprocating movement of the carriage 38. The portions of the ink tubes 41, which extend from the fixing clip 36 toward the cartridge-installing section, are omitted from FIG. 4.

The ink tubes 41 are laid out while the portions, which range from the fixing clip 36 to the carriage 38, form bent portions which are reversed in the direction of the reciprocating movement of the carriage 38. In other words, the ink tubes 41 are laid out so that a substantially U-shaped form is formed as viewed in a plan view. The four ink tubes 41 are arranged in the horizontal direction along with the recording paper transport direction in relation to the carriage 38, and they extend in the direction of the reciprocating movement of the carriage 38. On the other hand, the fixing clip 36 arranges and fixes the four ink tubes 41 so that they are in a state of being stacked in the vertical direction. The fixing clip 36 is a member which is open upwardly and which has a U-shaped cross section. The ink tubes 41 are inserted through the opening, and they are stacked in the vertical direction. Thus, the ink tubes 41 are integrally interposed. Accordingly, the four ink tubes 41 are curved substantially in the U-shaped form as a whole of the four, while being twisted so that the arrangement in the horizontal direction is converted into the arrangement in the vertical direction to extend from the carriage 38 toward the fixing clip 36.

The four ink tubes 41 have substantially the same length from the carriage 38 to the fixing clip 36. The ink tube 41, which is arranged on the most upstream side in the transport direction of the recording paper in the carriage 38, is arranged on the uppermost side in the fixing clip 36. The ink tube 41, which is arranged on the most upstream side next to the foregoing ink tube 41, is arranged on the uppermost side next to the concerning ink tube 41 in the fixing clip 36. This arrangement is repeated so that the ink tubes 41 are successively arranged from the uppermost side to the lower side of the fixing clip 36 in an order directed toward the downstream side as starting from the ink tube 41 disposed on the upstream side in the transport direction of the recording paper in the carriage 38. The lengths of the respective ink tubes 41 are substantially identical with each other. Therefore, the ink tubes 41 are curved so that the centers of the substantially U-shaped curved portions of the respective ink tubes 41 are deviated in the transport direction of the recording paper in accordance with the arrangement in the transport direction of the recording paper in relation to the carriage 38. Accordingly, the four ink tubes 41 are aligned in an oblique direction from the upper side to the lower side at the curved portions. When the posture is changed while following the carriage 38, the interference between the ink tubes 41 is reduced. This embodiment is illustrative of the four ink tubes 41. However, when the number of the ink tubes 41 is further increased, the ink tubes 41 are successively arranged on the upper side of the fixing clip 36 as starting from the ink tube 41 disposed on the upstream side in the transport direction of the recording paper in relation to the carriage 38 successively in the same manner as described above.

For example, the recording signal is transmitted via a flat cable 85 from the main board for constructing the control unit 64 (see FIG. 8) to the head control board of the ink-jet recording head 39. The main board is arranged on the front side of the apparatus (front side in FIG. 4), which is not shown in FIG. 4. The flat cable 85 has a thin band-shaped form insulated by coating a plurality of conductive wires for transmitting the electric signal with a synthetic resin film such as a polyester film. The flat cable 85 electrically connects the main board and the head control board.

The flat cable 85 has the flexibility to be flexibly bent or warped while following the reciprocating movement of the carriage 38. As shown in FIG. 4, the flat cable 85 is laid out while the portion, which ranges from the carriage 38 to the fixing clip 86, forms a curved portion reversed in the direction of the reciprocating movement of the carriage 38. In other words, the flat cable 85 is laid out so that the substantially U-shaped form is formed as viewed in a plan view while the front and back surfaces of the thin-band shaped form extend in the vertical direction. In other words, the perpendicular line of the front and back surfaces of the flat cable 85 is directed in the horizontal direction, and the surfaces are expanded in the vertical direction. The direction in which the flat cable 85 is allowed to extend from the carriage 38 and the direction in which the ink tubes 41 are allowed to extend are the same as the direction of the reciprocating movement of the carriage 38.

One end of the flat cable 85 fixed to the carriage 38 is electrically connected to the head control board carried on the carriage 38. The other end of the flat cable 85 fixed to the fixing clip 86 is allowed to further extend to the main board, and the other end is electrically connected thereto. The portion of the flat cable 85, which is curved to have the substantially U-shaped form, is not fixed to any member, which undergoes the posture change while following the reciprocating movement of the carriage 38 in the same manner as the ink tubes 41. The ink tubes 41 and the flat cable 85, which are subjected to the posture change while following the reciprocating movement of the carriage 38 as described above, are supported by a rotation support member 90. The end of the rotation support member 90 is rotatably supported by a bearing section 91. Therefore, the rotation support member 90 may make the swinging movement about the center of the swinging movement of the bearing section 91.

A regulating wall 37 is provided to extend in the widthwise direction of the apparatus (left and right directions in FIG. 4) on the apparatus front side of the ink tubes 41 and the flat cable 85. The regulating wall 37 is a wall which has a wall surface in the vertical direction to make abutment against the ink tubes 41. The regulating wall 37 is provided upstandingly in a straight form in the direction of the reciprocating movement of the carriage 38. The regulating wall 37 is provided in the extending direction of the ink tubes 41 from the fixing clip 36 which fixes the ink tubes 41. The height of the regulating wall 37 is set to have such a dimension that all of the four ink tubes 41, which are arranged in the vertical direction by the fixing clip 36, are capable of making abutment against the regulating wall 37. The ink tubes 41 are allowed to extend along the regulating wall 37 from the fixing clip 36. When the ink tubes 41 abut against the wall surface of the regulating wall 37 disposed on the apparatus back surface side, the ink tubes 41 are regulated or restricted for the expansion toward the front side of the apparatus, in other words, in the direction to make separation from the carriage 38.

The fixing clip 36 is arranged substantially in the vicinity of the center in the widthwise direction of the apparatus. The fixing clip 36 fixes the ink tubes 41 so that the ink tubes 41 are allowed to extend toward the regulating wall 37. In other words, an obtuse angle, which is smaller than 180° as viewed in a plan view, is formed by the wall surface of the regulating wall 37 in the vertical direction and the direction in which the fixing clip 36 allows the ink tubes 41 to extend. The ink tubes 41 have the flexibility. However, the ink tubes 41 have the rigidity (bending rigidity) to an appropriate extent as well. Therefore, when the ink tubes 41 are allowed to extend while forming the angle with respect to the regulating wall 37 by the fixing clip 36, the ink tubes 41 are pressed against the wall surface of the regulating wall 37. Accordingly, the range, in which the ink tubes 41 are reformed or adapted by the regulating wall 37, is widened in the range of the reciprocating movement of the carriage 38. It is possible to decrease the area of the expansion of the portions ranging from the curved portions of the ink tubes 41 to the carriage 38, toward the back surface side of the apparatus, in other words, toward the side of the carriage 38.

A fixing clip 86 is provided at a position which is substantially in the vicinity of the center of the apparatus in the widthwise direction and which is inside the curve as compared with the fixing clip 36. The fixing clip 86 fixes the flat cable 85 so that the flat cable 85 is allowed to extend toward the regulating wall 37. In other words, an obtuse angle, which is smaller than 180° as viewed in a plan view, is formed by the wall surface of the regulating wall 37 in the vertical direction and the direction in which the fixing clip 86 allows the flat cable 85 to extend. The flat cable 85 has the flexibility. However, the flat cable 85 has the rigidity (bending rigidity) to an appropriate extent as well. Therefore, when the flat cable 85 is allowed to extend while forming the angle with respect to the regulating wall 37 by the fixing clip 86, the flat cable 85 is pressed against the wall surface of the regulating wall 37. Accordingly, the range, in which the flat cable 85 is reformed or adapted by the regulating wall 37, is widened in the range of the reciprocating movement of the carriage 38. It is possible to decrease the area of the expansion of the portion ranging from the curved portion of the flat cable 85 to the carriage 38, toward the back surface side of the apparatus, in other words, toward the side of the carriage 38.

Figure 6:
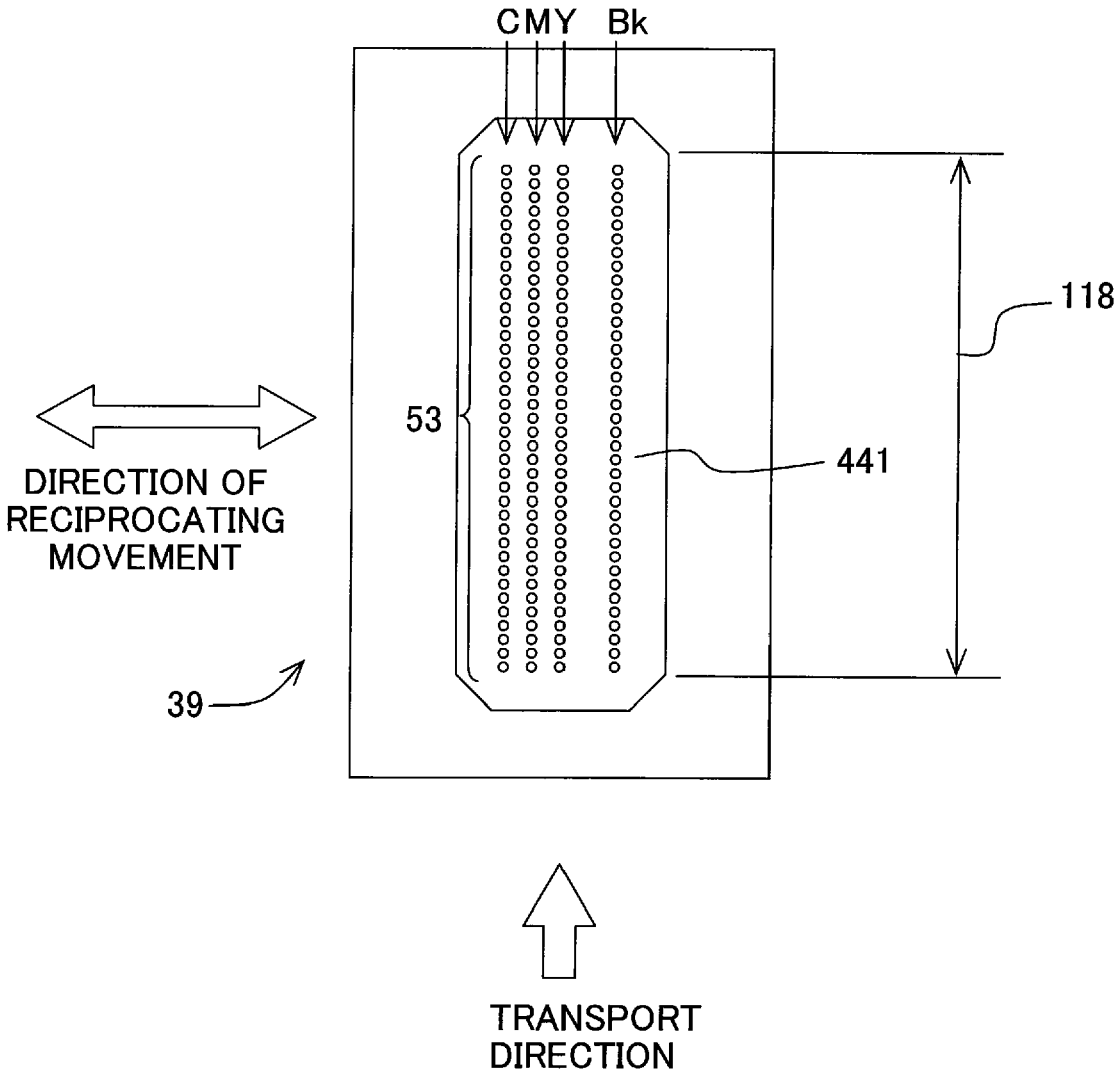
FIG. 6 shows a magnified bottom view illustrating an ink-jet recording head of the multifunction machine according to the first embodiment of the present invention.

FIG. 6 shows a bottom view illustrating a nozzle formation surface of the ink-jet recording head 39.

As shown in FIG. 6, the nozzles 53 are provided on the lower surface 441 (ink discharge surface) of the ink-jet recording head 39. The nozzles 53 are provided in arrays in the transport direction of the recording paper for each of the inks of the respective colors of cyan (C), magenta (M), yellow (Y), and black (Bk). The pitches and the numbers of the respective ink discharge ports 53 in the transport direction are appropriately set depending on, for example, the resolution of the recording image. In FIG. 6, the vertical direction is the transport direction of the recording paper, and the left and right directions are the directions of the reciprocating movement of the carriage 38. The nozzles 53 of the inks of the respective colors of C, M, Y, and Bk form the arrays in the transport direction of the recording paper respectively. The arrays of the nozzles 52 of the inks of the respective colors are aligned in the direction of the reciprocating movement of the carriage 38. The pitch and the number in the transport direction of each of the nozzles 53 are appropriately set in consideration of, for example, the resolution of the recording image. It is also possible to increase/decrease the number of the arrays of the nozzles 53 depending on the number of the types of the color inks.

Figure 7:
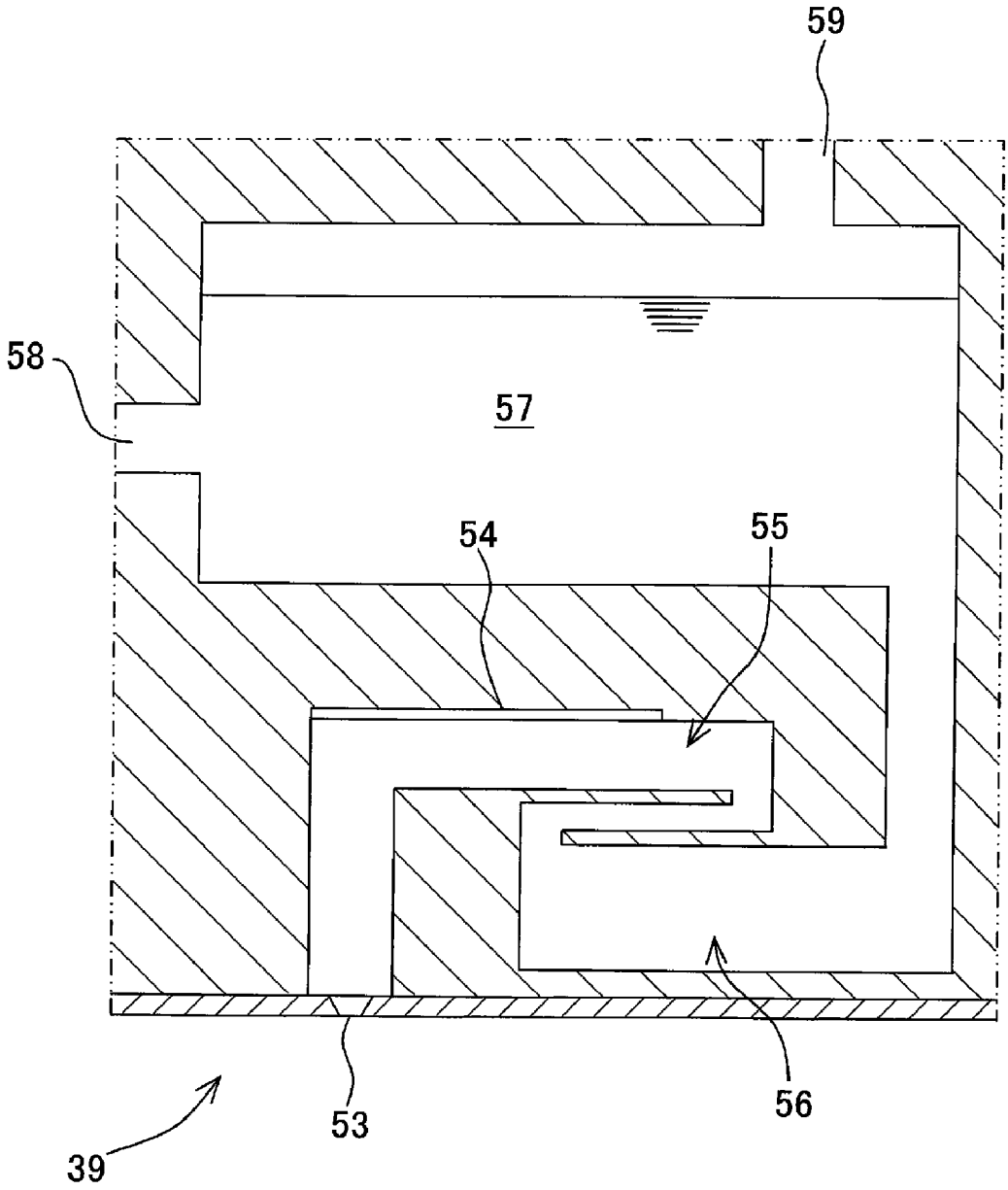
FIG. 7 shows a partial magnified sectional view illustrating an internal structure of the ink-jet recording head of the multifunction machine according to the first embodiment of the present invention.

FIG. 7 shows a partial magnified sectional view illustrating the internal structure of the ink-jet recording head 39.

As shown in FIG. 7, a cavity 55, which is provided with a piezoelectric element 54, is formed on the upstream side of the nozzle 53 formed on the lower surface of the ink-jet recording head 39. The piezoelectric element 54 is deformed by applying a predetermined voltage to reduce the volume of the cavity 55. The ink contained in the cavity 55 is discharged as ink droplets from the nozzle 53 in accordance with the change of the volume of the cavity 55.

The cavity 55 is provided for each of the nozzles 53. A manifold 56 is formed to range over a plurality of cavities 55. The manifold 56 is provided for each of the inks of the respective colors of C, M, Y, and Bk. A buffer tank 57 is arranged on the upstream side of the manifold 55. The buffer tank 57 is also provided for each of the inks of the respective colors of C, M, Y, and Bk. The ink, which flows through the ink tube 41, is supplied from an ink supply port 58 to each of the buffer tanks 57. When the ink is once stored in the buffer tank 57, then the bubbles, which are generated in the ink, for example, in the ink tube 41, are captured, and the cavity 55 and the manifold 56 are prevented from any invasion of the bubbles. The bubbles, which are captured in the buffer tank 57, are sucked and removed from a bubble discharge port 59 by means of the pump mechanism. The ink, which is supplied from the buffer tank 57 to the manifold 56, is distributed to the respective cavities 55 by the manifold 56.

The ink flow passage is constructed so that the ink of each of the colors supplied from the ink cartridge via the ink tube 41 as described above, flows to the cavity 55 via the buffer tank 57 and the manifold 56. The ink of each of the colors of C, M, Y, and Bk, which is supplied via the ink flow passage as described above, is discharged as ink droplets onto the recording paper from the nozzle 53 in accordance with the deformation of the piezoelectric element 54.

As shown in FIG. 3, a pair of transport rollers 60 and pinch rollers are provided on the upstream side of the image-recording unit 24. The pinch rollers are not shown in FIG. 3, because they are hidden behind other members. However, the pinch rollers are arranged under the transport rollers 60 in a contact state under pressure. The transport rollers 60 and the pinch rollers interpose the recording paper transported through the printing paper transport passage 23 to transport the recording paper onto the platen 42. A pair of paper discharge rollers 62 and spur rollers 63 are provided on the downstream side of the image-recording unit 24. The paper discharge rollers 62 and the spur rollers 63 interpose the recording paper completed for the recording to transport the recording paper to the paper discharge tray 21. The driving force is transmitted from the LF motor 71, and the transport rollers 60 and the paper discharge rollers 62 are driven intermittently by a predetermined line feed width to intermittently feed the recording paper by the predetermined line feed width. The rotation is synchronized for the transport rollers 60 and the paper discharge rollers 62. A rotary encoder 76 (see FIG. 8), which is provided for the transport roller 60, detects, with an optical sensor (or a photo-interrupter) 82 (see FIG. 5), a pattern of an encoder disk 61 which is rotatable together with the transport roller 60. The rotation is controlled for the transport rollers 60 and the paper discharge rollers 62 on the basis of the detection signal.

On the other hand, a press roller 361 (see FIG. 5) is provided rotatably while being urged to press the transport roller 60 at a predetermined pressing force. When the recording paper enters the space between the transport roller 60 and the press roller 361, the press roller 361 is retracted by an amount corresponding to a thickness of the recording paper to interpose the recording paper together with the transport roller 60. Accordingly, the rotational force of the transport roller 60 is reliably transmitted to the recording paper. The spur roller 63 makes contact under pressure with the recording paper on which the recording has been completed. Therefore, the roller surface thereof is formed to be concave/convex in a spur form so that the image, which is recorded on the recording paper, is not deteriorated. The spur roller 63 is provided slidably movably in the directions to make approach and separation with respect to the paper discharge roller 62. The spur roller 63 is urged by a coil spring so that the spur roller 63 makes contact under the pressure with the paper discharge roller 62. When the recording paper enters the space between the paper discharge roller 62 and the spur roller 63, then the spur roller 63 is retracted against the urging force by an amount corresponding to the thickness of the recording paper, and the recording paper is interposed so that the recording paper makes contact under pressure with the paper discharge roller 62. Accordingly, the rotational force of the paper discharge roller 62 is reliably transmitted to the recording paper. The pinch roller is provided for the transport roller 60 in the same manner as described above. The recording paper is interposed so that the recording paper makes contact under pressure with the transport roller 60. The rotational force of the transport roller 60 is reliably transmitted to the recording paper.

A regi sensor 95 is arranged on the upstream side of the transport roller 60 of the printing paper transport passage 23. The regi sensor 95 is provided with a detection probe (detector) shown in FIG. 3 and an unillustrated optical sensor. The detection probe is arranged so that the detection probe is capable of appearing/disappearing in the printing paper transport passage 23. The detection probe is always elastically urged to protrude to the printing paper transport passage 23. When the recording paper, which is transported through the printing paper transport passage 23, makes abutment thereagainst, the detection probe is rotated so that the detection probe is immersed in the printing paper transport passage 23. The optical sensor is turned ON or OFF in accordance with the appearance/disappearance of the detection probe. Therefore, when the recording paper allows the detection probe to appear/disappear, the position of the forward end or the backward end of the recording paper is detected in the printing paper transport passage 23.

In the multifunction machine 1 according to this embodiment, the LF motor 71 serves as the driving source for the paper feed of the recording paper from the paper feed tray 20 as well as for the transport of the recording paper positioned on the platen 42 and the discharge of the recording paper completed for the recording to the paper discharge tray 21. That is, the LF motor 71 drives the transport rollers 60 (see FIG. 5), and the LF motor 71 drives the paper feed roller 25 by the aid of the driving force-transmitting mechanism 27 as described above (see FIG. 3). Further, the LF motor 71 drives the paper discharge roller shaft to which the paper discharge rollers 62 are attached, by the aid of a predetermined power transmission mechanism 83 (see FIG. 5). The power transmission mechanism 83 may be constructed, for example, by a gear array. Alternatively, a timing belt may be appropriately used therefor in view of the assembling space.

Figure 8:
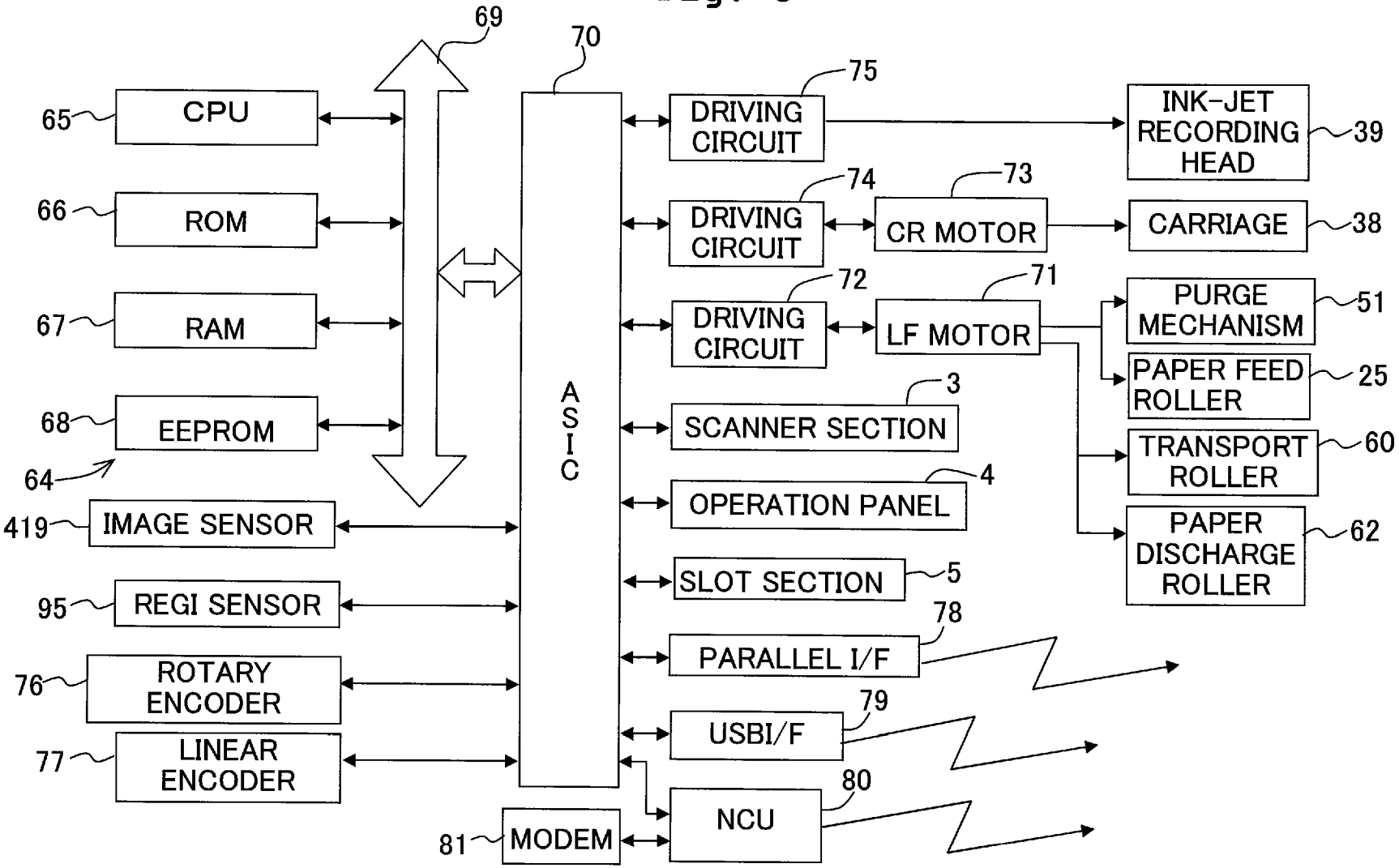
FIG. 8 shows a block diagram illustrating an arrangement of a control unit of the multifunction machine according to the first embodiment of the present invention.

FIG. 8 shows a block diagram illustrating the arrangement of the control unit 64 of the multifunction machine 1.

The control unit 64 controls the overall operation of the multifunction machine 1 including not only the printer section 3 but also the scanner section 2. The control unit 64 is composed of the main board to which the flat cable 85 is connected. The arrangement concerning the scanner section 3 is not the principal arrangement of the present invention. Therefore, any detailed explanation thereof is omitted.

As shown in FIG. 8, the control unit 64 is constructed as a microcomputer principally including CPU (Central Processing Unit) 65, ROM (Read Only Memory) 66, RAM (Random Access Memory) 67, and EEPROM (Electrically Erasable and Programmable ROM) 68. The control unit 64 is connected to ASIC (Application Specific Integrated Circuit) 70 via a bus 69.

For example, a program for controlling the various types of operation of the multifunction machine 1 is stored in ROM 66. RAM 67 is used as a storage area or a working area for temporarily storing various types of data to be used when CPU 65 executes the program. For example, flags and settings to be retained after turning OFF the power source are stored in EEPROM 68.

ASIC 70 generates, for example, a phase magnetic excitation signal to be electrically applied to the LF motor 71 in accordance with the instruction from CPU 65. The signal is applied to a driving circuit 72 for the LF motor 71. The driving signal is electrically applied to the LF motor 71 by the aid of the driving circuit 72. The rotation of the LF motor 71 is controlled as described above.

The driving circuit 72 drives the LF motor 71 which is connected to the paper feed roller 25, the transport rollers 60, the paper discharge rollers 62, and the purge mechanism 51. The driving circuit 72 receives the output signal from ASIC 70 to form an electric signal for rotating the LF motor 71. The LF motor 71 is rotated by receiving the electric signal. The rotational force of the LF motor 71 is transmitted to the paper feed roller 25, the transport rollers 60, the paper discharge rollers 62, and the purge mechanism 51 by the aid of a well-known driving mechanism composed of, for example, gears and driving shafts. That is, in the multifunction machine 1 according to this embodiment, the LF motor 71 serves as the driving source for the paper feed of the recording paper from the paper feed tray 20 as well as for the transport of the recording paper positioned on the platen 42 and the discharge of the recording paper completed for the recording to the paper discharge tray 21.

ASIC 70 generates, for example, a phase magnetic excitation signal to be electrically applied to the CR motor 73 in accordance with the instruction from CPU 65. The signal is applied to a driving circuit 74 for the CR motor 73. The driving signal is electrically applied to the CR motor 73 by the aid of the driving circuit 74. The rotation of the CR motor 73 is controlled as described above.

The driving circuit 74 drives the CR motor 73. The driving circuit 74 receives the output signal from ASIC 70 to form an electric signal for rotating the CR motor 73. The CR motor 73 is rotated by receiving the electric signal. The rotational force of the CR motor 73 is transmitted to the carriage 38 by the aid of the belt drive mechanism 46. Accordingly, the carriage 38 is subjected to the reciprocating movement. The reciprocating movement of the carriage 38 is controlled by the control unit 64 as described above.

A driving circuit 75 drives the ink-jet recording head 39 at predetermined timings. The driving circuit 75 receives the output signal generated in ASIC 70 on the basis of the driving control procedure outputted from CPU 65 to drive and control the ink-jet recording head 39. The driving circuit 75 is carried on the head control board. The signal is transmitted to the head control board from the main board which constitutes the control unit 64 via the flat cable 85. Accordingly, the ink-jet recording head 39 selectively discharges the inks of the respective colors onto the recording paper at predetermined timings.

Those connected to ASIC 70 are a rotary encoder 76 which detects the amount of rotation of the transport roller 60, a linear encoder 77 which detects the position of the carriage 38, and the regi sensor 95 which detects the forward end and the backward end of the recording paper. When the power source of the multifunction machine 1 is turned ON, then the carriage 38 is moved to one end of each of the guide rails 43, 44, and the detection position brought about by the linear encoder 77 is initialized. When the carriage 38 is moved on the guide rails 43, 44 from the initial position, the optical sensor 35, which is provided for the carriage 38, detects the pattern of the encoder strip 50. The number of pulse signals based on the detection is recognized as the amount of movement of the carriage 38 by the control unit 64. The control unit 64 controls the rotation of the CR motor 73 in order to control the reciprocating movement of the carriage 38 on the basis of the amount of movement. The control unit 64 recognizes the position of the forward end or the backward end of the recording paper on the basis of the signal of the regi sensor 95 and the encoder amount detected by the rotary encoder 76. When the forward end of the recording paper arrives at a predetermined position on the platen 42, the rotation of the LF motor 71 is controlled in order to intermittently transport the recording paper by every predetermined line feed width. The line feed width is set on the basis of, for example, the resolution inputted as the recording condition.

For example, a parallel interface 78 and a USB interface 79, which are provided to transmit and receive the data via a parallel cable or a USB cable with respect to the scanner section 3, the operation panel 4 for instructing the operation of the multifunction machine 1, the slot section 5 for inserting various small-type memory cards thereinto, and the external information equipment such as a personal computer, are connected to ASIC 70. Further, a modem (MODEM) 81 and NCU (Network Control Unit) 80 for realizing the facsimile function are connected to ASIC 70.

Figure 9:
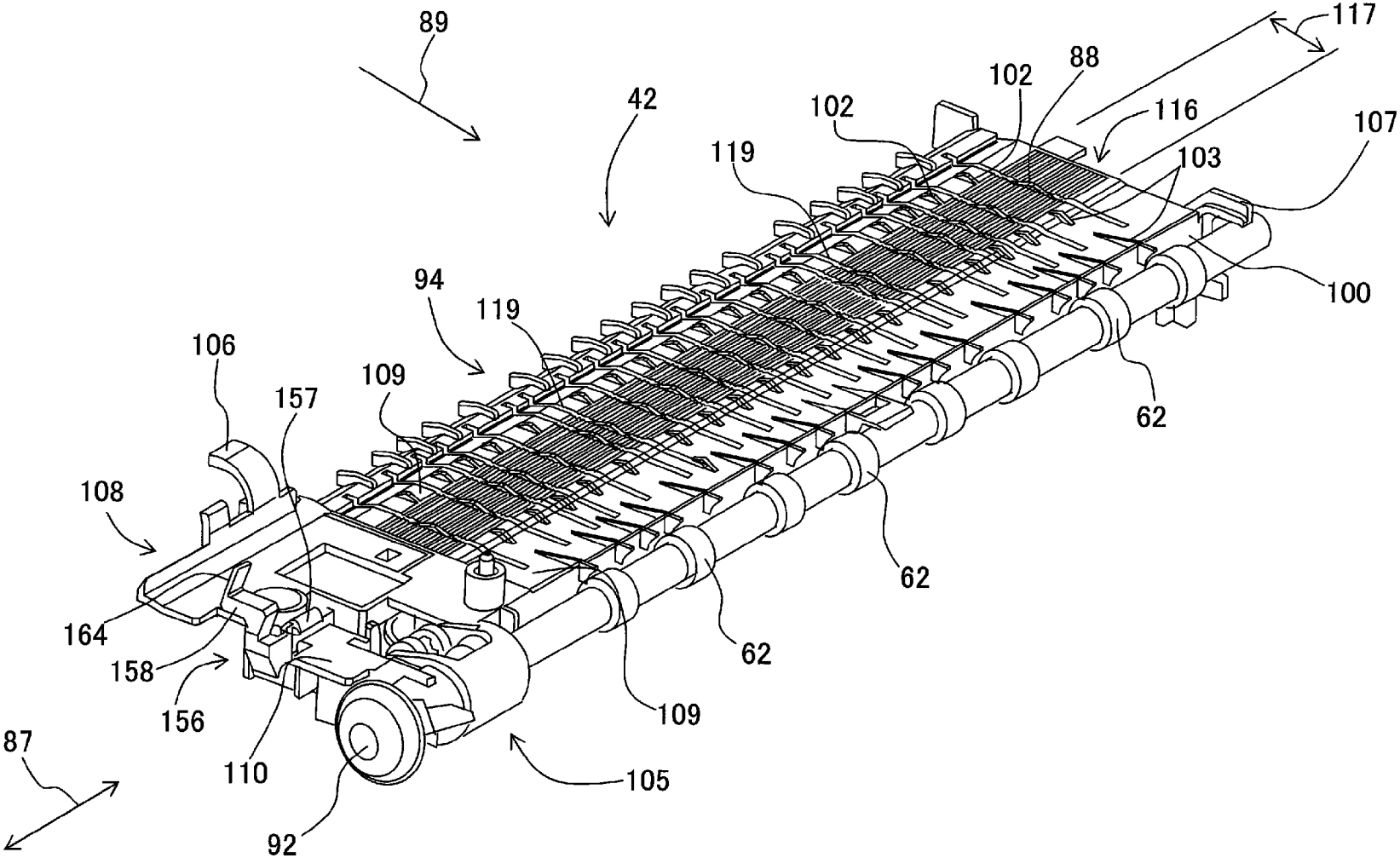
FIG. 9 shows a magnified perspective view illustrating main components shown in FIG. 5.

FIG. 9 shows a magnified perspective view illustrating main components shown in FIG. 5, which shows a magnified perspective view illustrating the platen 42.

As described above, the platen 42 is arranged opposingly to the ink-jet recording head 39 (under the ink-jet recording head 39 as shown in FIG. 3). The platen 42 supports the recording paper to be transported. As shown in FIG. 9, the platen 42 has a thin-walled plate-shaped form which is slender and rectangular as a whole. The platen 42 is arranged so that the longitudinal direction thereof is directed in the main scanning direction (direction of the arrow 87). In FIG. 9, the direction of the arrow 89 is the transport direction. The recording paper is transported in the direction of the arrow 89.

The platen 42 includes a frame 100, first fixed ribs 102 (first medium support section) and second fixed ribs 103 (second medium support section) which are provided for the frame 100, the movable support section 88 which is provided slidably for the frame 100, and the interlocking mechanism 105 which drives the movable support section 88 in a sliding manner as described later on.

The frame 100 is composed of, for example, synthetic resin or steel plate, which constitutes the skeleton of the platen 42. The frame 100 is formed to have a substantially C-shaped cross-sectional shape (so-called the channel form). Brackets 106, 107 are provided at both ends of the frame 100 in the main scanning direction respectively. The brackets 106, 107 are formed integrally with the frame 100. The frame 100 is fastened and fixed to the multifunction machine 1 by the aid of the brackets 106, 107.

A driving mechanism attachment section 108 is provided on one end side of the frame 100 (front side as shown in FIG. 9). The driving mechanism attachment section 108 is formed integrally with the frame 100, which includes an upper plate 110 continued to an upper surface 109 of the frame 100. The upper plate 110 has a rectangular shape. The upper plate 110 supports the interlocking mechanism 105 as described in detail later on.

The first fixed ribs 102 and the second fixed ribs 103 are provided on the upper surface 109 of the frame 100. Specifically, the first fixed ribs 102 are provided at end portions of the upper surface 109 on the upstream side in the transport direction. The first fixed ribs 102 protrude upwardly (toward the ink-jet recording head 39). The second fixed ribs 103 are provided at end portions of the upper surface 109 on the downstream side in the transport direction. The second fixed ribs 103 protrude upwardly. In this embodiment, as shown in FIG. 9, the first fixed ribs 102 and the second fixed ribs 103 are divided into two portions in the transport direction respectively. However, it is a matter of course that they may be formed in an integrated manner.

In this embodiment, the plurality of first fixed ribs 102 are provided on the upper surface 109. The respective first fixed ribs 102 are provided and aligned in the main scanning direction. Similarly, the plurality of second fixed ribs 103 are provided on the upper surface 109. The respective second fixed ribs 103 are provided and aligned in the main scanning direction. When the first fixed ribs 102 and the second fixed ribs 103 are provided as described above, a groove 116 is formed between the first fixed ribs 102 and the second fixed ribs 103. As shown in FIG. 9, the groove 116 extends in the main scanning direction, and the groove 116 is expanded in the transport direction. The widthwise dimension 117 of the groove 116 corresponds to the size of the ink-jet recording head 39. Specifically, the widthwise dimension 117 of the groove 116 is set to be wider than the ink discharge area 118 (see FIG. 6) of the ink-jet recording head 39.

In particular, in this embodiment, as shown in FIG. 9, one first fixed rib 102 and one second fixed rib 103 are opposed to one another in the transport direction (direction of the arrow 89) with the groove 116 intervening therebetween. The chamfering processing is applied to corner portions of the first fixed rib 102 to form a pair of inclined surfaces. In this embodiment, the inclined surfaces are formed at the corner portions disposed on the both sides of the first fixed rib 102 in the transport direction. However, it is enough that the inclined surface is formed at least at the corner portion disposed on the upstream side in the transport direction. Similarly, the chamfering processing is also applied to corner portions of the second fixed rib 103 to form a pair of inclined surfaces. As for the second fixed rib 103, the inclined surfaces are formed at the corner portions disposed on the both sides in the transport direction as well. However, it is enough that the inclined surface is formed at least at the corner portion disposed on the upstream side in the transport direction.

A plurality of slits 119 are provided through the upper surface 109 of the frame 100. As shown in FIG. 9, the respective slits 119 extend in the transport direction from the end on the upstream side to the end on the downstream side in the transport direction of the upper surface 109. Further, the respective slits 119 are provided and aligned in the scanning direction. The respective slits 119 are formed to span spaces between the adjoining first fixed ribs 102 to spaces between the adjoining second fixed ribs 103, or respective slits 119 are formed to make continuation. The movable support section 88 is fitted into the slits 119 to protrude upwardly from the slits 119.

Figure 10:
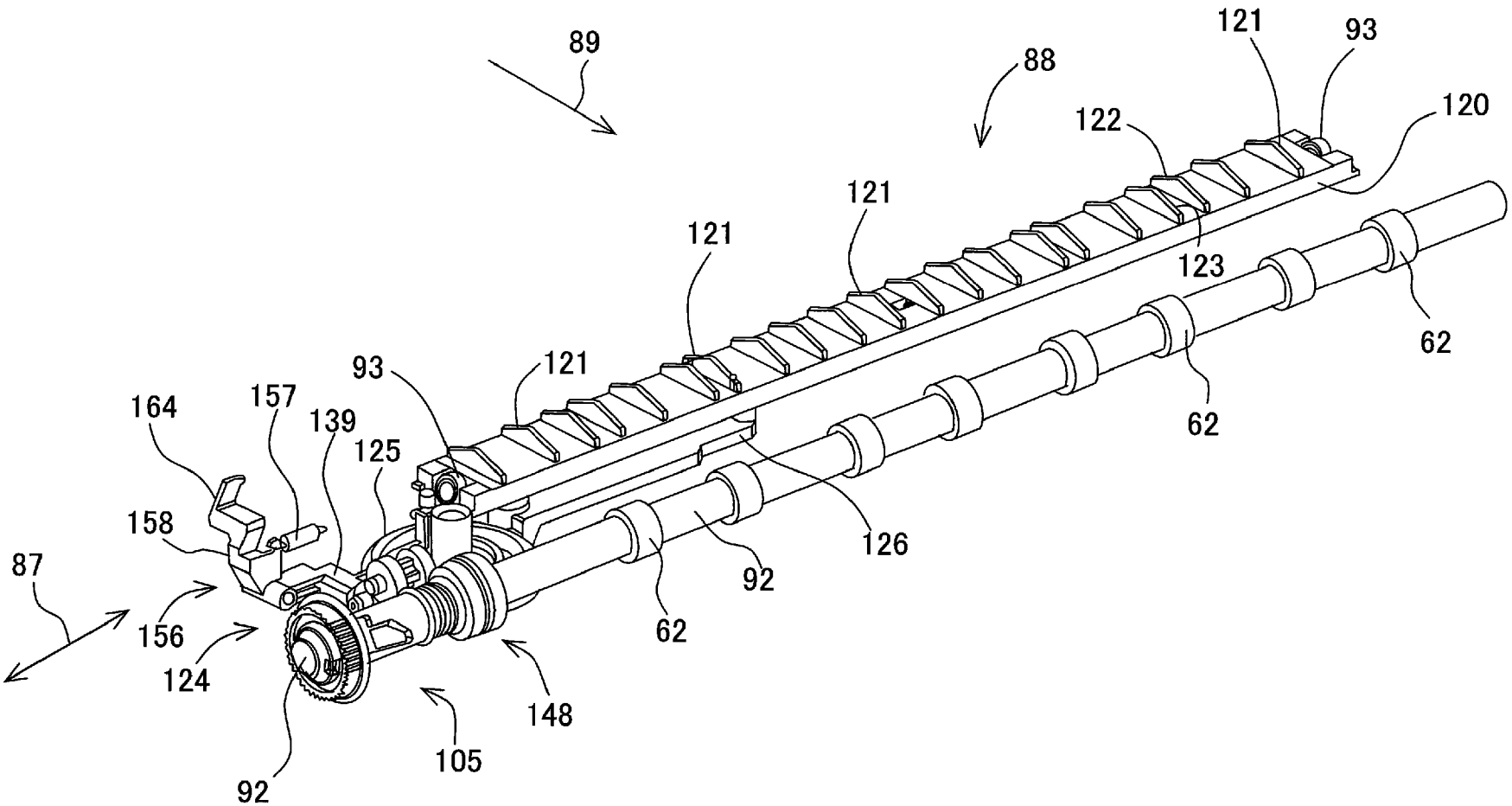
FIG. 10 shows a magnified perspective view illustrating a movable support section of the multifunction machine according to the first embodiment of the present invention.
Figure 11:
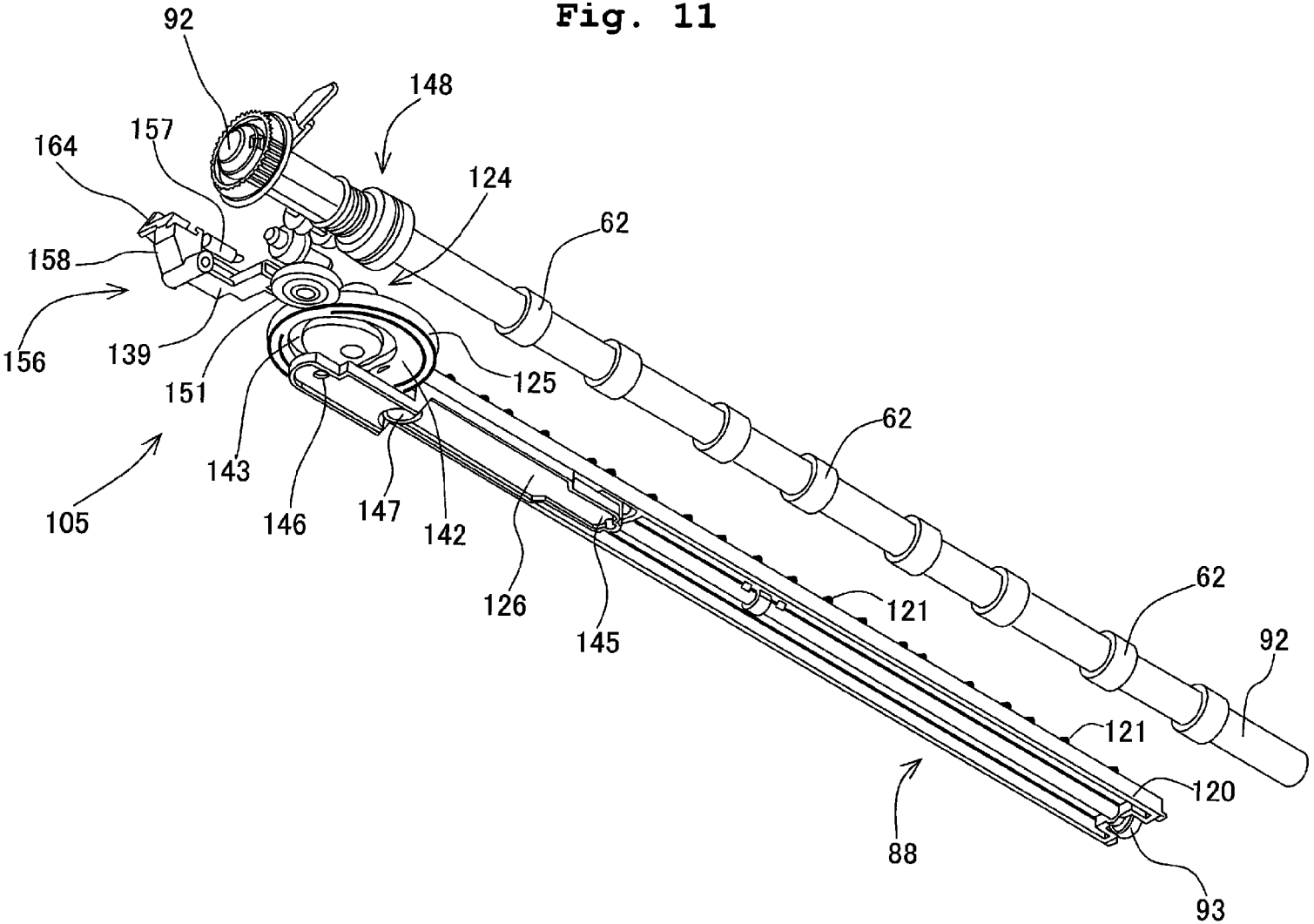
FIG. 11 shows a magnified perspective view illustrating the movable support section of the multifunction machine according to the first embodiment of the present invention.
Figure 12:
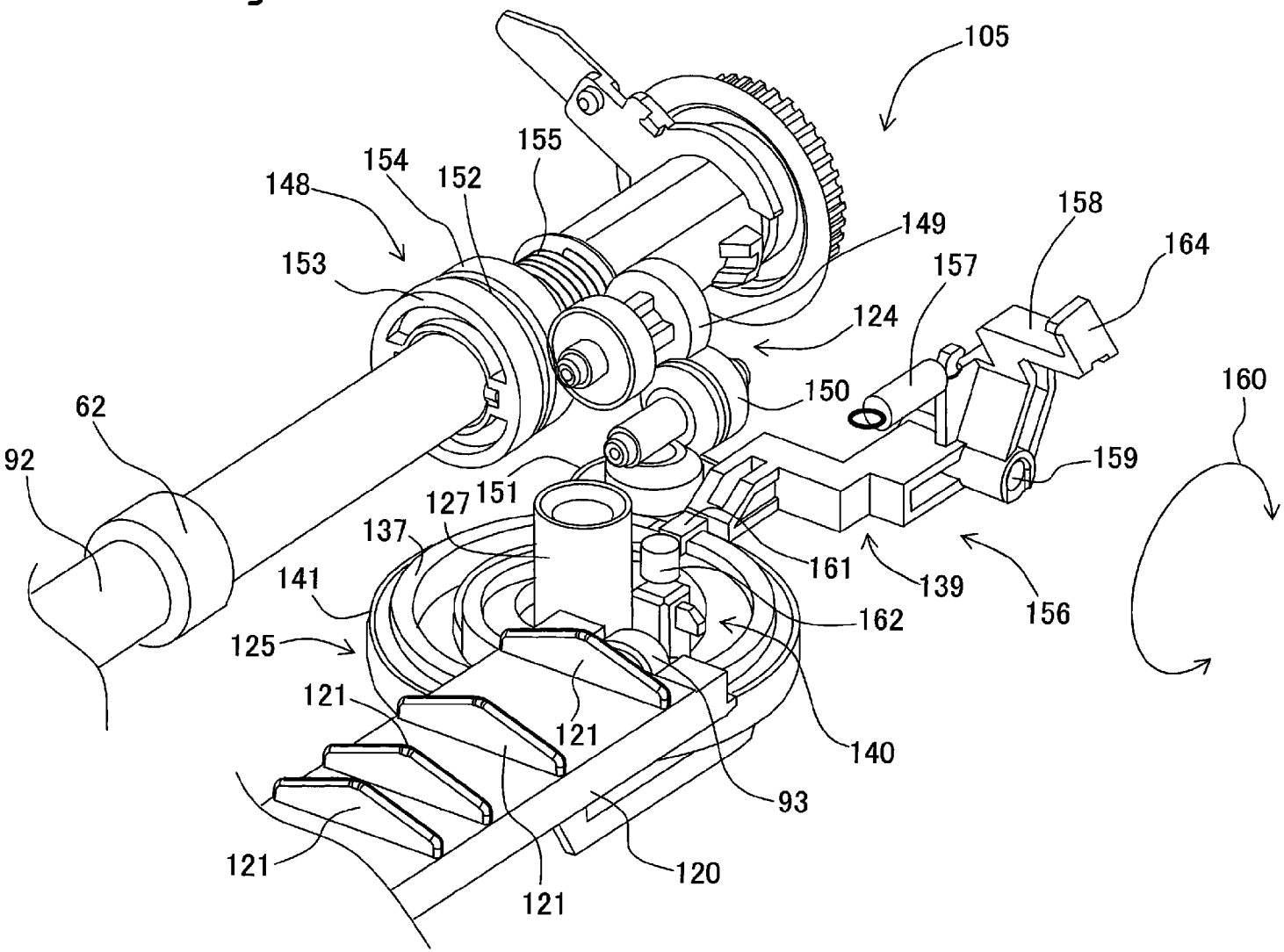
FIG. 12 shows a magnified perspective view illustrating an interlocking mechanism of the multifunction machine according to the first embodiment of the present invention.

FIG. 10 shows a magnified perspective view illustrating the movable support section 88. FIG. 11 shows a magnified perspective view illustrating the movable support section 88 as viewed from the bottom surface side of the platen 42. FIG. 12 shows a magnified perspective view illustrating the interlocking mechanism 105.

As shown in FIGS. 10 and 11, the movable support section 88 has a base 120 which is formed to be box-shaped, and ribs 121 (movable ribs) which are provided thereon. The ribs 121 are formed to be thin-walled and plate-shaped, which protrude from the platen 42 (see FIG. 9). The movable support section 88 may be composed of synthetic resin or metal. The base 120 is formed to have a slender plate-shaped form as a whole. However, the base 120 is formed to have a C-shaped cross-sectional shape. As shown in FIG. 9, the base 120 is internally fitted into the frame 100 on the lower side. As shown in FIG. 10, slide rollers 93 are rotatably provided at the both ends of the base 120 in the main scanning direction. The slide rollers 93 smoothly roll with respect to the frame 100. Therefore, the base 120 is capable of making the sliding movement smoothly in the transport direction (direction of the arrow 89 as shown in FIGS. 9 and 10) at the inside of the frame 100.

The ribs 121 are provided on the upper surface of the base 120. The ribs 121 are formed integrally with the base 120. The rib 121 is formed to have a triangular shape. In this embodiment, the plurality of ribs 121 are provided upstandingly on the upper surface of the base 120. The ribs 121 are disposed on the upper surface of the base 120, and they are aligned at predetermined intervals or spacing distances in the main scanning direction (direction of the arrow 87 shown in FIG. 10). The predetermined interval corresponds to the pitch of the slits 119 (see FIG. 9). Therefore, the respective ribs 121 pass through the slits 119 provided through the frame 100, and they protrude upwardly from the upper surface 109 of the frame 100.

The ribs 121, which constitute the movable support section 88, are formed to be triangular as described above. In other words, the chamfering processing is applied to corner portions 122, 123 of the rib 121 in the same manner as the first fixed rib 102 and the second fixed rib 103. The corner portions 122, 123 constitute inclined surfaces which are inclined with respect to the transport direction. In this embodiment, the inclined surfaces are formed at the corner portions 122, 123 disposed on the both sides of the respective ribs 121 in the transport direction. However, it is enough that the inclined surface is formed at least at the corner portion 122 disposed on the upstream side in the transport direction. The first fixed ribs 102 and the second fixed ribs 103 may be formed integrally with the frame 100.

The interlocking mechanism 105 is provided in order to allow the movable support section 88 to slide in the transport direction as described above. The interlocking mechanism 105 is allowed to intervene between the paper discharge roller shaft 92 and the movable support section 88. When the interlocking mechanism 105 is provided, the movable support section 88 is interlocked with the paper discharge roller shaft 92. The movable support section 88 is moved while following the recording paper so that the end of the recording paper transported on the platen 42 is always supported. Specifically, when the recording paper is transported to the end 94 (see FIG. 9) on the upstream side in the transport direction of the frame 100 of the platen 42, the ribs 121 are moved to receive the recording paper. After that, the ribs 121 are allowed to slide toward the downstream side in the transport direction while supporting the end of the recording paper in accordance with the transport of the recording paper.

As shown in FIG. 12, the interlocking mechanism 105 includes the rotary plate 125 which is driven and rotated by using the paper discharge roller shaft 92 as a driving source by the aid of a power transmission mechanism 124, and a lever member 126 (not shown) which is arranged between the rotary plate 125 and the movable support section 88 and which converts the rotary motion of the rotary plate 125 into the translational motion of the movable support section 88.

Figure 13:
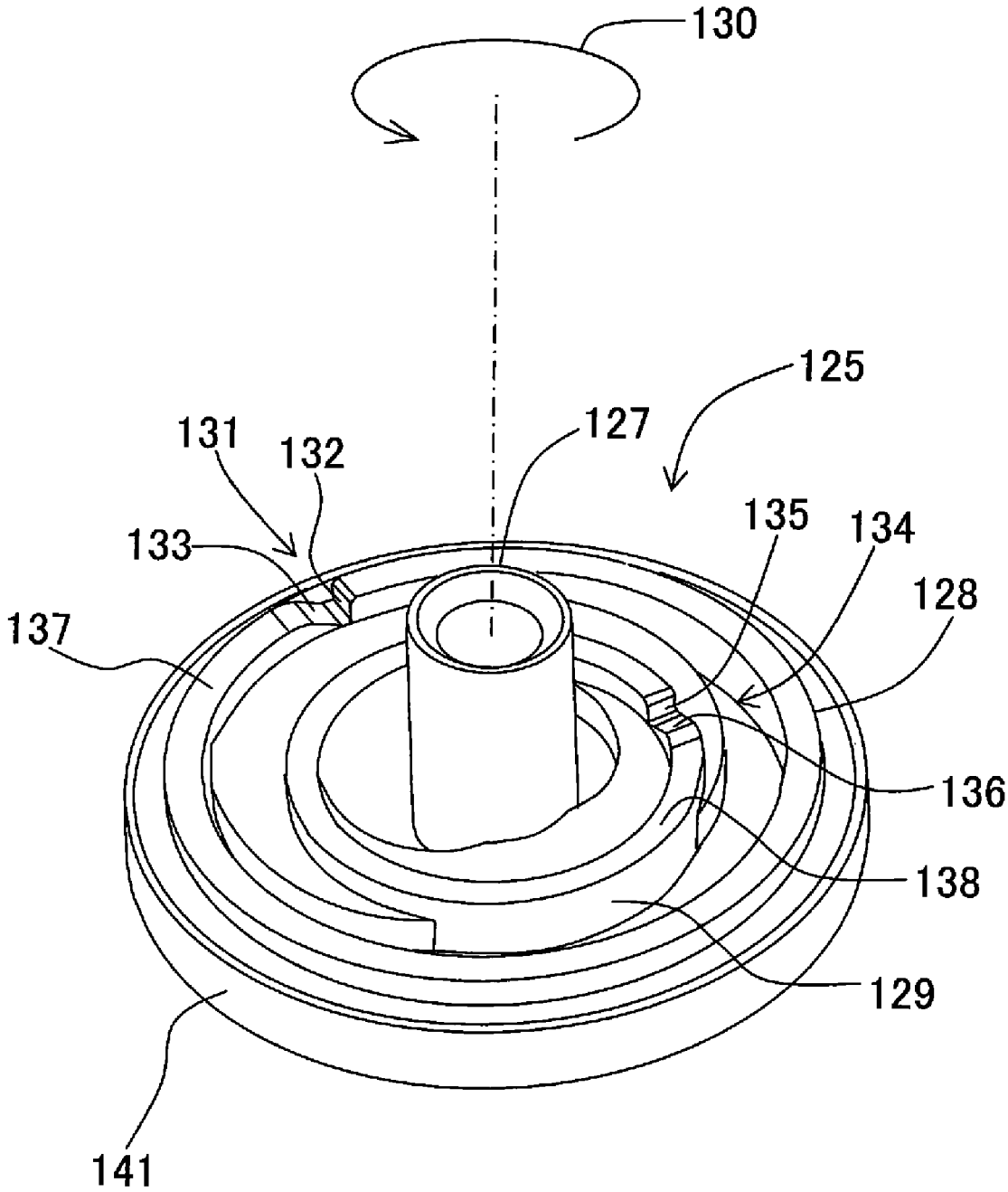
FIG. 13 shows a magnified perspective view illustrating a rotary plate of the multifunction machine according to the first embodiment of the present invention.
Figure 14:
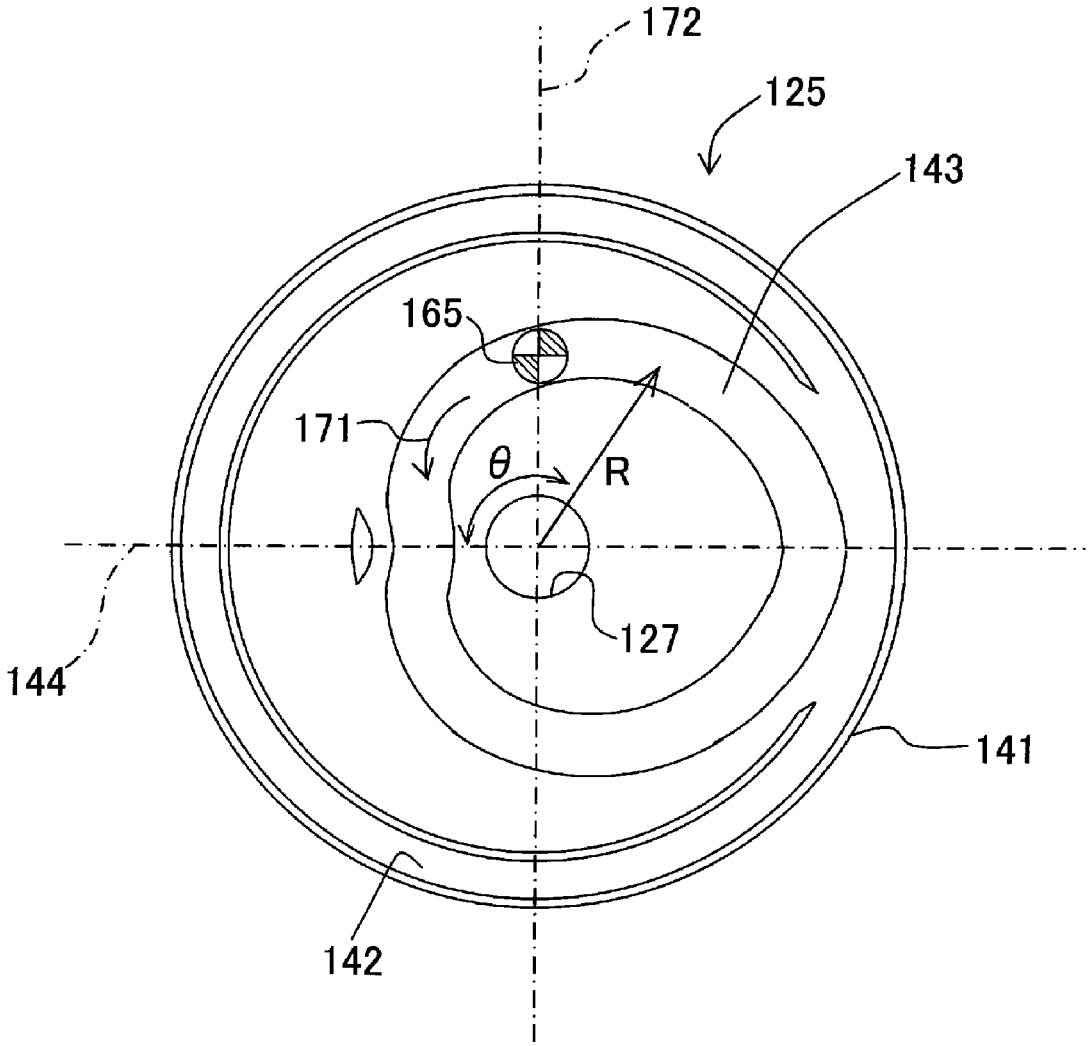
FIG. 14 shows a bottom view illustrating the rotary plate of the multifunction machine according to the first embodiment of the present invention.

FIG. 13 shows a magnified perspective view illustrating the rotary plate 125. FIG. 14 shows a view illustrating a lower surface of the rotary plate 125.

As shown in FIGS. 12 and 13, the rotary plate 125 is formed to be disk-shaped, which may be composed of resin or metal. The rotary plate 125 includes a circular rotary plate section 141, and a cylinder shaft 127 which is provided upstandingly at a central portion of the upper surface of the rotary plate section 141. The cylinder shaft 127 is rotatably supported by the frame 100 of the platen 42. Specifically, a rotary center shaft (not shown) is provided upstandingly on the frame 100. In this arrangement, the rotary center shaft extends in the direction perpendicular to both of the main scanning direction and the transport direction. The cylinder shaft 127 is rotatably fitted to the rotary center shaft. However, a rotary center shaft of the rotary plate 125 may be constructed by directly fitting the cylinder shaft 127 to the frame 100. Ribs 128, 129 are provided upstandingly on the upper surface of the rotary plate 125. The rib 129 is formed to have a rectangular cross-sectional shape, which is formed to be annular about the center of the shaft 127. The rib 128 is formed to have a rectangular cross-sectional shape as well, which is formed to be annular about the center of the shaft 127 to surround the rib 129.

The rotary plate 125 is subjected to the forward rotation or the reverse rotation by the aid of the power transmission mechanism 124 as described later on, provided that direction of the forward rotation resides in the direction of the arrow 130. As shown in FIG. 13, a substantially V-shaped groove 131 is provided for the rib 128. Two wall surfaces are formed by the groove 131. One wall surface is a forward rotation-restricting surface 132 which extends in the axial direction of the shaft 127, i.e., in the direction perpendicular to the direction of rotation of the rotary plate 125. The other wall surface is a reverse rotation-permitting surface 133 which extends from the lower edge of the forward rotation-restricting surface 132 toward the forward rotation side in the circumferential direction of the rib 128 and which is continued to the upper surface 137 of the rib 128. A substantially V-shaped groove 134 is also provided for the rib 129. Two wall surfaces are formed by the groove 134. One wall surface is a reverse rotation-restricting surface 135 which extends in the axial direction of the shaft 127, i.e., in the direction perpendicular to the direction of rotation of the rotary plate 125. The other wall surface is a forward rotation-permitting surface 136 which extends from the lower edge of the reverse rotation-restricting surface 135 toward the reverse rotation side in the circumferential direction of the rib 129 and which is continued to the upper surface 138 of the rib 129. A lock member 139 and a lock member 140 are engaged with the groove 131 and the groove 134 respectively as described in detail later on. Accordingly, the forward rotation and the reverse rotation of the rotary plate 125 are restricted or permitted.

As shown in FIGS. 11 and 14, a guide groove 143 is provided on a back surface 142 of the rotary plate 125. The guide groove 143 is formed to depict a predetermined locus curve. Specifically, when a polar coordinate system, in which the origin is the center of the cylinder shaft 127 as shown in FIG. 14, is established, and a virtual axis 144, which extends in the horizontal direction along the back surface 142 as shown in FIG. 14, is established, then the guide groove 143 is formed along the locus curve which satisfies $R=k\theta$ (k is a constant). On this assumption, the angle, which is directed from the origin in the direction toward the left side of the virtual axis 144, resides in $\theta=0$, and the clockwise direction resides in the positive direction of $\theta$. That is, the locus curve depicts an Archimedes' spiral, and the angle $\theta$ and the distance R between the origin and the center of the guide groove 143 are in a linear relationship. However, in this embodiment, the locus curve, which follows $R=k\theta$, resides in a range of $0°$ (degree)$\leqq\theta\leqq180°$. The locus curves, which are formed within this range, are arranged left-to-right symmetrically or bilaterally symmetrically (vertically symmetrically in FIG. 14) about the center of the virtual axis 144. Therefore, the guide groove 143 is formed along the Archimedes' spiral which is formed vertically symmetrically on the basis of the virtual axis 144.

As shown in FIG. 11, the lever member 126 is formed to be thin rod-shaped. The lever member 126 is attached to the base 120 of the movable support section 88. That is, in this embodiment, the lever member 126 functions as a constitutive part of the interlocking mechanism 105, and it also serves as an engaging section for the movable support section 88 to make engagement with the rotary plate 125. Specifically, the forward end 145 of the lever member 126 is fitted to the back surface side of the base 120. The proximal end 146 of the lever member 126 is fitted to the guide groove 143 of the rotary plate 125. An intermediate section 147 of the lever member 126 is supported by the frame 100 of the platen 42. Although the support structure for the lever member 126 and the frame 100 of the platen 42 is not shown in FIG. 11, it is possible to adopt, for example, such a structure that the intermediate section 147 is rotatably fitted to a support shaft (not shown) provided on the frame 100.

The proximal end 146 of the lever member 126 is displaceable in only the longitudinal direction of the guide groove 143 by being fitted to the guide groove 143 of the rotary plate 125. On the other hand, the forward end 145 of the lever member 126 is displaceable in only the main scanning direction by being fitted to the base 120. Therefore, when the rotary plate 125 is rotated, the lever member 126 makes the swinging movement about the swinging movement center of the intermediate section 147, while the proximal end 146 of the lever member 126 is guided by the guide groove 143. As a result, the forward end 145 of the lever member 126 makes the swinging movement about the swinging movement center of the intermediate section 147. When the forward end 145 of the lever member 126 makes the swinging movement, the base 120 is allowed to slide in the transport direction, because the forward end 145 is displaceable in the main scanning direction with respect to the base 120.

In this arrangement, the displacement amount of the forward end 145 of the lever member 126 is a predetermined multiple of the displacement amount of the proximal end 146 of the lever member 126. Specifically, the magnification corresponds to the ratio between the distance from the intermediate section 147 to the forward end 145 and the distance from the intermediate section 147 to the proximal end 146. Therefore, the displacement amount of the forward end 145 is obtained by amplifying the displacement amount of the proximal end 146 by the predetermined multiple. That is, owing to the provision of the lever member 126, the amount of rotation of the rotary plate 125 is converted by the predetermined magnification into the displacement amount of the base 120 in the transport direction.

As shown in FIG. 12, the power transmission mechanism 124 includes a torque limiter 148 which is provided on the paper discharge roller shaft 92, and gears 149 to 151. The torque limiter 148 includes a flange 153 which is provided on the paper discharge roller shaft 92, a pressing plate 154 which is allowed to abut against the flange 153 by the aid of a friction plate 152 (typically a nonwoven fabric), and a coil spring 155 which elastically urges the pressing plate 154 toward the flange 153 together with the friction plate 152. When the pressing plate 154 is pressed against the flange 153 by the coil spring 155, then the predetermined frictional force is generated between the both, and the power is transmitted between the both by means of the frictional force. In other words, the torque, which is transmitted between the pressing plate 154 and the flange 153, is limited. When the elastic force of the coil spring 155 is set to be large, the limited torque is increased.

Although not shown in FIG. 12 clearly, teeth are formed on the outer circumferential surface of the pressing plate 154. The teeth are meshed with the gear 149. Therefore, when the pressing plate 154 is rotated, the gear 149 is rotated as well. The gear 150 is meshed with the gear 149, and the gear 151 is meshed with the gear 150. However, the gear 150 and the gear 151 constitute a bevel gear array, and their central axes of rotation are perpendicular to one another. As shown in FIG. 11, the outer circumferential surface of the gear 151 makes contact with the outer circumferential surface of the rotary plate 125. In this embodiment, the torque is transmitted between the both by means of the frictional force generated by the contact between the gear 151 and the rotary plate 125. However, it is a matter of course that teeth may be formed on both of the gear 151 and the rotary plate 125, and the both may be connected to one another while constituting a spur gear array.

In this embodiment, a rotation-restricting mechanism 156, which restricts the rotation of the rotary plate 125, is provided. As shown in FIG. 12, the rotation-restricting mechanism includes the lock member 139, the lock member 140, a coil spring 157 (elastic member) which elastically urges the lock member 139 so that the lock member 139 is engaged with the rotary plate 125, and an abutment member 158 which changes the posture of the lock member 140 as described later on by making abutment with the ink-jet recording head 39 which is allowed to slide in the main scanning direction.

The lock member 139 is formed to be crank-shaped. The proximal end thereof is supported by a support shaft 159. The proximal end of the lock member 139 is rotatably supported by the support shaft 159. Accordingly, the lock member 139 is capable of rotating at angles of elevation and depression in the directions of the arrows 160 about the swinging movement center of the support shaft 159. An engaging pawl 161 is provided at the forward end of the lock member 139. The external shape of the engaging pawl 161 is formed to be wedge-shaped, which is to be fitted to the groove 131 of the rotary plate 125.

The lock member 139 makes the swinging movement about the center of the support shaft 159. Therefore, the lock member 139 is capable of changing the posture between the posture (rotation-restricting posture) in which the lock member 139 falls toward the rotary plate 125 and the engaging pawl 161 is fitted into the groove 131 and the posture (rotation-permitting posture) in which the lock member 139 rises from the rotary plate 125 and the engaging pawl 161 is disengaged from the groove 131. However, the lock member 139 is urged toward the rotation-restricting posture in the normal state, because the coil spring 155 is provided.

Therefore, in the state in which the engaging pawl 161 is fitted into the groove 131, the forward rotation of the rotary plate 125 is restricted, because the engaging pawl 161 abuts against the forward rotation-restricting surface 132 (see FIG. 13) in the forward rotation direction, even when the rotary plate 125 intends to cause the forward rotation. On the other hand, even in the state in which the engaging pawl 161 is fitted into the groove 131, when the rotary plate 125 is reversely rotated, the engaging pawl 161 can slide along the reverse rotation-permitting surface 133 (see FIG. 13). When the engaging pawl 161 is allowed to slide along the reverse rotation-permitting surface 133, the lock member 139 is changed toward the rotation-permitting posture against the elastic force of the coil spring 155. Accordingly, the engaging pawl 161 arrives at the upper surface 137 of the rib 128 of the rotary plate 125. The engaging pawl 161 makes the sliding movement on the upper surface 137 in accordance with the rotation of the rotary plate 125.

The lock member 140 is formed to be quadratic prism-shaped. Although not shown in FIG. 12, an engaging pawl is formed at the lower end of the lock member 140. The engaging pawl is also formed to be wedge-shaped in the same manner as the engaging pawl 161 of the lock member 139. The engaging pawl is fitted into the groove 134 provided for the rib 129 of the rotary plate 125. The lock member 140 is provided slidably in the vertical direction with reference to FIG. 12. The lock member 140 is always elastically urged downwardly by a coil spring 162. In other words, the engaging pawl, which is provided for the lock member 140, is always engaged with the rotary plate 125 to restrict the reverse rotation of the rotary plate 125. However, the engaging pawl permits the forward rotation of the rotary plate 125.

The abutment member 158 is connected to the proximal end of the lock member 139. Therefore, the abutment member 158 is rotatable together with the lock member 139 about the center of the support shaft 159. The forward end 164 of the abutment member 158 is formed to have an arm-shaped form which extends upwardly. When the carriage 38 of the ink-jet recording head 39 (see FIG. 5) is allowed to slide in the main scanning direction, the carriage 38 abuts against the forward end 164. The coil spring 157 is connected to the abutment member 158. The coil spring 157 elastically urges the lock member 139 together with the abutment member 158 as described above.

Next, an explanation will be made about the procedure of the image recording by using the multifunction machine 1 according to this embodiment.

In the multifunction machine 1 according to this embodiment, the mode of the image recording is selected by operating the operation panel 4 (see FIG. 1). That is, the so-called bordered recording or the borderless recording can be arbitrarily selected by operating the operation panel 4 by a user. When the recording mode is set with the operation panel 4, the signal, which instructs the recording mode, is transmitted from ASIC 70 (see FIG. 8) to CPU 65. CPU 65 receives the signal to give the instruction to the driving circuit 74 and the driving circuit 75 in order to drive the CR motor 73 and the recording head 39. Specifically, when the setting of the borderless recording is made, the CR motor 73 is driven so that the carriage 38 (see FIG. 5) presses the abutment member 158.

Figure 15:
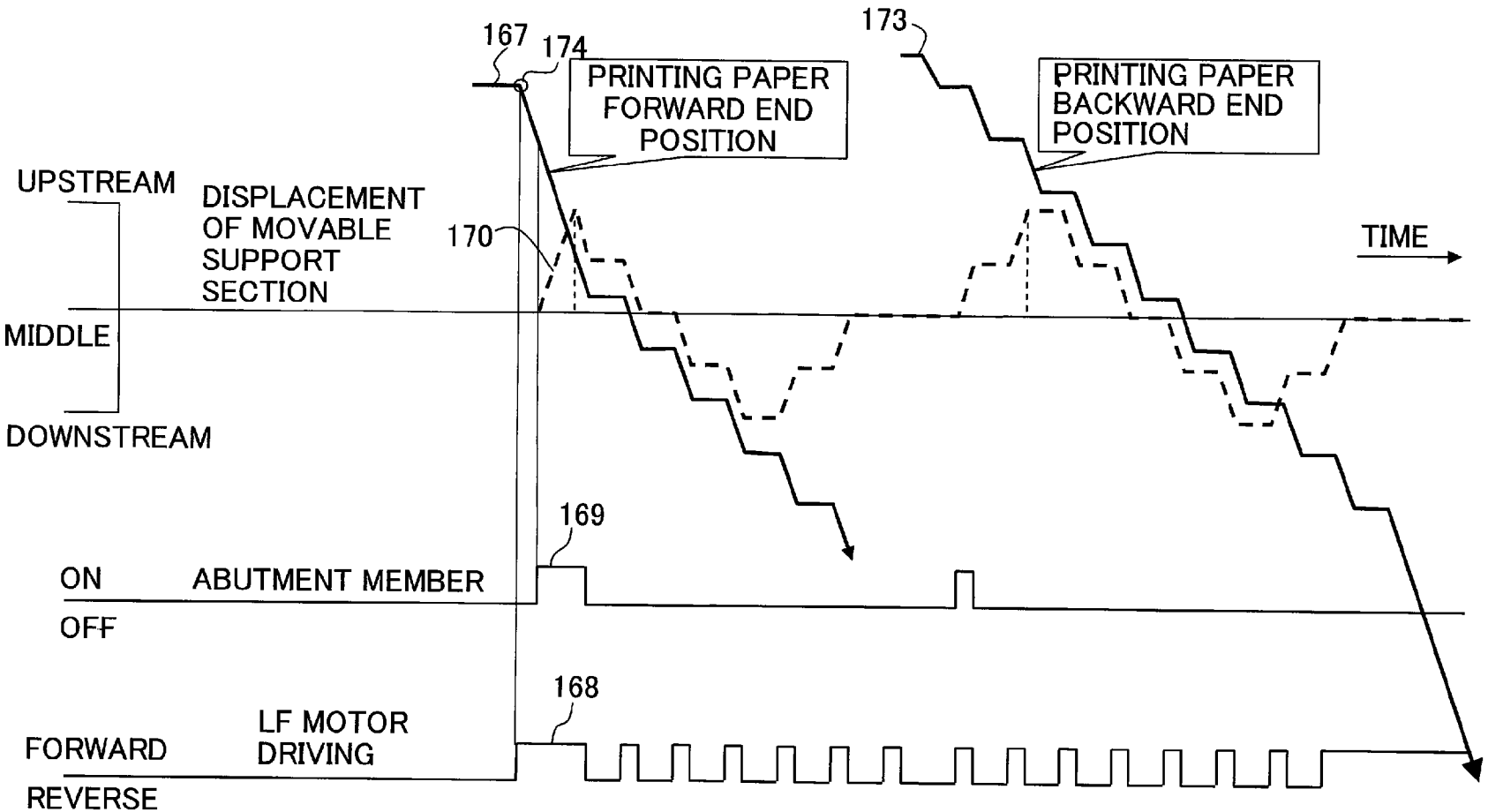
FIG. 15 shows a timing chart illustrating the timings of the transport of the recording paper and the sliding movement of the movable support section when the borderless recording is performed.

FIG. 15 shows a timing chart illustrating the timings of the transport of the recording paper and the sliding movement of the movable support section 88 when the borderless recording is performed. In FIG. 15, the horizontal axis represents the elapse of time. In FIG. 15, a diagram 167 and a diagram 173 indicate the displacement of the positions of the forward end and the backward end of the recording paper to be transported respectively. A diagram 170 indicates the displacement of the movable support section 88. In FIG. 15, a diagram 169 and a diagram 168 indicate the displacement of the abutment member 158 and the driving timing of the LF motor 71. FIG. 16 shows the displacement of the movable support section 88 during the transport of the recording paper in an order from FIGS. 16A to 16D. In FIG. 16, the direction of the arrow 166 is the transport direction of the recording paper. FIG. 16 shows the operation timings after the recording paper is subjected to the registration by the transport rollers 60 until the completion of the recording on the recording paper. The operation, which is to be performed until the recording paper fed from the paper feed tray 20 arrives at the transport rollers 60, is omitted.

When the image recording is performed, the control unit 64 firstly drives the LF motor 71 to rotate the paper feed roller 25 in order that the recording paper, which is stacked on the paper feed tray 20, is fed to the printing paper transport passage 23. When the paper is fed, the LF motor 71 is driven reversely. When the driving is transmitted, then the paper feed roller 25 is rotated in the direction to feed the recording paper, and the transport rollers 60 and the paper discharge rollers 62 are rotated in the direction opposite to the transport direction. The recording paper, which is fed from the paper feed tray 20 to the printing paper transport passage 23, is transported so that the recording paper is inverted from the lower position to the upper position along the printing paper transport passage 23. The forward end of the recording paper abuts against the regi sensor 95, and the recording paper is further transported. Accordingly, the recording paper abuts against the transport rollers 60 and the pinch rollers. The transport rollers 60 are rotated in the direction opposite to the transport direction. Therefore, the recording paper is subjected to the registration process in a state in which the forward end abuts against the transport rollers 60 and the pinch rollers. The registration position is indicated by reference numeral 174 in FIG. 15. After the completion of the registration process for the recording paper, the control unit 64 drives the LF motor 71 in the forward rotation. Accordingly, the recording paper, which has been subjected to the registration process, is nipped by the transport rollers 60 and the pinch rollers, and the recording paper is transported on the platen 42 as indicated by the diagram 167.

When the LF motor 71 is reversed, the paper discharge rollers 62 are rotated in the direction opposite to the transport direction. The rotation is transmitted via the driving power transmission mechanism 124 to the rotary plate 125. When the rotary plate 125 is disposed at the initial position, i.e., when the lock member 140 is engaged with the groove 134, the rotation of the rotary plate 125 is restricted. Therefore, only the paper discharge roller shaft 92 is rotated reversely in the state in which the reverse rotation of the rotary plate 125 is stopped by the torque limiter 148. When the rotary plate 125 is not disposed at the initial position, the lock member 140 is not engaged with the groove 134. Therefore, the rotation of the paper discharge rollers 62 is transmitted to the driving power transmission mechanism 124, and the rotary plate 125 is rotated reversely. When the rotary plate 125 is rotated reversely to the initial position, the lock member 140 is engaged with the groove 134. The reverse rotation of the rotary plate 125 is restricted as described above, and only the paper discharge roller shaft 92 is rotated reversely. The reverse driving of the LF motor 71 as described above may be set to be performed when the power source of the multifunction machine 1 is turned ON or after the error is canceled, as the operation for initializing the rotary plate 125 to the initial position. When the rotary plate 125 is disposed at the initial position, then the lock member 139 is engaged with the groove 131, and the forward rotation of the rotary plate 125 is restricted as well.

Figure 16A:
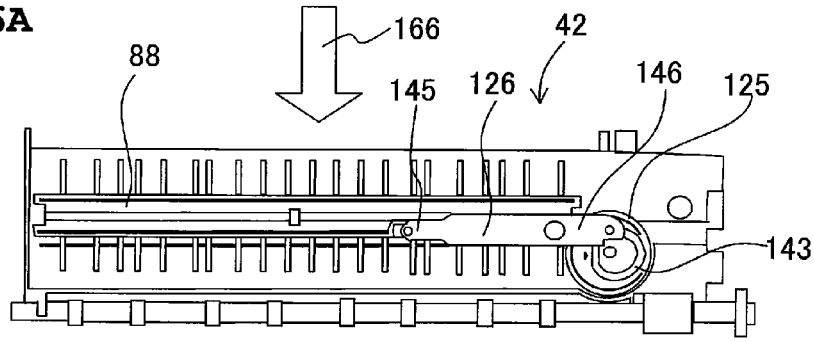
FIG. 16 shows the displacement of the movable support section during the transport of the recording paper in an order of FIGS. 16A to 16D.

When the borderless recording is performed, the movable support section 88 is allowed to slide while following the transport of the recording paper. In particular, when the recording paper is arranged at the initial position 174 (see FIG. 15), then the movable support section 88 is positioned at the middle or center of the platen 42 as shown in FIG. 16A, and the proximal end 146 of the lever member 126 is arranged at the predetermined position in the guide groove 143 of the rotary plate 125, i.e., at the position indicated by reference numeral 165 shown in FIG. 14. The position, which is indicated by reference numeral 165, is such a position that the virtual axis 172, which passes through the center of the cylinder shaft 127 and which is perpendicular to the virtual axis 144, intersects the guide groove 143. The relative positional relationship, which relates to the movable support section 88, the rotary plate 125, and the lever member 126 as shown in FIG. 16A, resides in the initial positions of the respective members.

After the forward end of the recording paper is subjected to the registration on the basis of the transport roller 60 as described above, the LF motor 71 is intermittently driven in the forward rotation as indicated by the diagram 168 shown in FIG. 15. The recording paper is transported to the recording position on the platen 42. After that, as indicated by the diagram 169, the CR motor 73 is also driven at the predetermined timing. Accordingly, the carriage 38 (see FIG. 5) is allowed to slide in the main scanning direction to abut against the abutment member 158 (see FIG. 12) of the rotation-restricting mechanism 156. In this situation, the control unit 64 performs the control of the slide amount of the carriage 38, i.e., the driving control of the CR motor 73.

As shown in FIG. 12, when the abutment member 158 is pushed in the main scanning direction by the carriage 38 ("ON" in FIG. 15), then the lock member 139 is rotated about the center of the support shaft 159, and the rotation-permitting posture is given. That is, the engaging pawl 161 is disengaged from the rotary plate 125, and the rotary plate 125 can perform the forward rotation (rotation in the clockwise direction about the center of the cylinder shaft 127). When the paper discharge roller shaft 92 is rotated in the transport direction by the LF motor 71 as described above, then the rotation is transmitted via the power transmission mechanism 124 to the rotary plate 125, and the rotary plate 125 makes the forward rotation. As a result, the movable support section 88 is displaced as depicted by the diagram 170 shown in FIG. 15. The relative positional relationship, which relates to the movable support section 88, the rotary plate 125, and the lever member 126, is changed in an order of FIGS. 16B to 16D. The movement of the movable support section 88 will be described in further detail below.

Figure 16B:
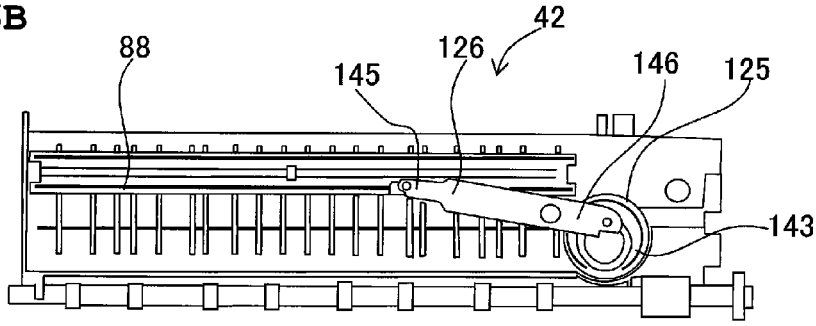

The movable support section 88 is positioned between the first fixed ribs 102 and the second fixed ribs 103 in the initial state (see FIG. 9). However, as depicted by the diagram 170 shown in FIG. 15, when the forward end of the recording paper is transported to the end on the upstream side in the transport direction of the frame 100 of the platen 42, the movable support section 88 is moved to the upstream side in the transport direction to receive the recording paper. Specifically, the transport rollers 60 are rotated in the transport direction in accordance with the forward rotation of the LF motor 71, and the recording paper is fed to the platen 42. Further, the forward rotation of the LF motor 71 is driven and transmitted, and the rotary plate 125 is subjected to the forward rotation. In this situation, the direction of rotation of the rotary plate 125 is the clockwise direction with reference to FIGS. 14 and 16. When the rotary plate 125 makes the forward rotation, the position 165 of the proximal end 146 of the lever member 126 is relatively moved in the direction of the arrow 171 with reference to FIG. 14. That is, the distance between the cylinder shaft 127 and the position 165 of the proximal end 146 is progressively decreased in accordance with the rotation of the rotary plate 125. Therefore, as shown in FIG. 16B, the lever member 126 makes the swinging movement about the swinging movement center of the intermediate section 147. As a result, the movable support section 88 is moved to the upstream side in the transport direction. When the angle of rotation of the rotary plate 125 arrives at 90°, the movable support section 88 is arranged at the position (first position) at which the movable support section 88 enters the space between the adjoining first fixed ribs 102 to receive the recording paper. In this embodiment, as shown in FIG. 15, the movable support section 88 is moved to the first position corresponding to the end on the upstream side in the transport direction before the forward end of the recording paper arrives at the end on the upstream side in the transport direction of the platen 42. Accordingly, the ribs 121 of the movable support section 88 are covered with the recording paper disposed thereon.

Figure 16C:
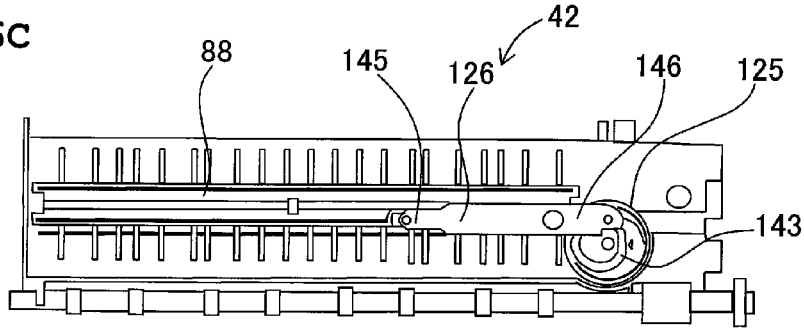
Figure 16D:
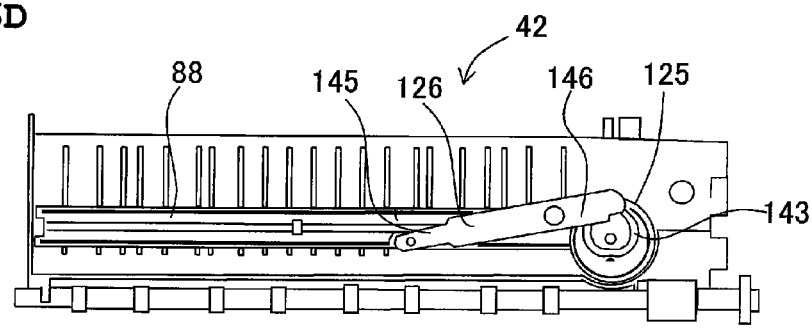

After that, as shown in FIG. 15, the discharge of the ink droplets in accordance with the sliding movement of the carriage 38 and the transport of the recording paper by every predetermined line feed width corresponding to the preset resolution are alternately repeated, and thus the image is recorded on the recording paper. In other words, as depicted by the diagram 168 shown in FIG. 15, the LF motor 71 is intermittently driven in the forward rotation, and the recording paper is intermittently fed by every predetermined line feed width. The rotary plate 125 is rotated while being interlocked with the driving of the LF motor 71. Therefore, when the recording paper is intermittently fed as described above, the rotary plate 125 is also intermittently rotated by a predetermined angle of rotation in synchronization therewith. The position 165 of the proximal end 146 of the lever member 126 is further moved in the direction of the arrow 171 shown in FIG. 14. When the angle of rotation of the rotary plate 125 arrives at 360°, the restoration is made to the initial position described above. That is, when the angle of rotation of the rotary plate 125 is in a range above 90° and not more than 270°, the distance between the cylinder shaft 127 and the position 165 of the proximal end 146 is progressively increased in accordance with the rotation of the rotary plate 125. Therefore, as shown in FIGS. 16B to 16D, the lever member 126 makes the swinging movement about the swinging movement center of the intermediate section 147. As a result, the movable support section 88 is moved to the downstream side in the transport direction. When the angle of rotation of the rotary plate 125 arrives at 270°, the movable support section 88 is arranged at the position (second position) at which the movable support section 88 enters the space between the adjoining second fixed ribs 103. When the rotary plate 125 is further rotated, the distance between the cylinder shaft 127 and the position 165 of the proximal end 146 is progressively decreased in accordance with the rotation of the rotary plate 125. Therefore, the lever member 126 makes the swinging movement about the swinging movement center of the intermediate section 147. The movable support section 88 is moved to the upstream side in the transport direction. When the angle of rotation of the rotary plate 125 arrives at 360°, the movable support section 88 is restored to the initial position described above.

When the rotary plate 125 is rotated as described above, the engaging pawl 161 is allowed to slide on the upper surface 137 of the rib 128 as shown in FIG. 12. Therefore, when the angle of rotation of the rotary plate 125 arrives at 360°, then the engaging pawl 161, which is urged by the coil spring 157, is fitted into the groove 131 of the rotary plate 125 again (see FIG. 13), and the forward rotation of the rotary plate 125 is restricted. When the forward rotation of the rotary plate 125 is restricted, the power transmission mechanism 124 is stopped. However, the driving force of the LF motor 71 is transmitted to the transport rollers 60 and the paper discharge roller shaft 92, because the torque limiter 148 is provided. Therefore, the smooth transport of the recording paper is secured.

The recording paper is intermittently transported by the predetermined line feed width as shown in FIG. 15 in the state in which the smooth transport of the recording paper is secured, and the image recording is continued. In this situation, as indicated by the diagram 170 shown in FIG. 15, the movable support section 88 is stopped at the initial position.

However, as indicated by the diagram 173, the backward end of the recording paper approaches the end of the platen 42 on the upstream side in the transport direction in accordance with the transport of the recording paper. The backward end of the recording paper is detected by the regi sensor 95. The control unit 64 controls the driving of the CR motor 73 on the basis of the detection signal. Accordingly, as indicated by the diagram 169 shown in FIG. 15, the carriage 38 is allowed to slide in the main scanning direction to abut against the abutment member 158 (see FIG. 12) ("ON" in FIG. 15).

When the abutment member 158 is pushed by the carriage 38 in the main scanning direction, then the lock member 139 is rotated about the center of the support shaft 159 as described above, and the engaging pawl 161 is disengaged from the rotary plate 125. Accordingly, the rotary plate 125 can make the forward rotation (rotation in the clockwise direction about the center of the cylinder shaft 127). As a result, the movable support section 88 is displaced as indicated by the diagram 170 shown in FIG. 15. The relative positional relationship, which relates to the movable support section 88, the rotary plate 125, and the lever member 126, is changed again in the order of FIGS. 16B to 16D. That is, the movable support section 88 is intermittently moved to the first position corresponding to the end on the upstream side in the transport direction in accordance with the intermittent driving of the LF motor 71 before the backward end of the recording paper arrives at the end of the platen 42 on the upstream side in the transport direction. Also in this situation, the ribs 121 of the movable support section 88 are covered with the recording paper to be transported and disposed thereon. After that, as shown in FIG. 15, the discharge of the ink droplets in accordance with the sliding movement of the carriage 38 and the transport of the recording paper by every predetermined line feed width corresponding to the preset resolution are alternately repeated, and thus the image recording on the recording paper is continued. The rotary plate 125 is rotated while being interlocked with the driving of the LF motor 71. Therefore, when the LF motor 71 is intermittently driven as described above, the rotary plate 125 is also intermittently rotated by every predetermined angle of rotation in synchronization therewith. In this state, the ribs 121 are allowed to slide to the downstream side in the transport direction while supporting the recording paper.

When the rotary plate 125 makes one revolution, the engaging pawl 161, which is urged by the coil spring 157, is fitted into the groove 131 of the rotary plate 125 again (see FIG. 13). The forward rotation of the rotary plate 125 is restricted. Further, the relative positional relationship, which relates to the movable support section 88, the rotary plate 125, and the lever member 126, is restored to the initial position. When the image recording is completed on the recording paper, then the LF motor 71 is continuously driven in the forward rotation, and the recording paper is discharged to the paper discharge tray 21 (see FIG. 3). In this situation, the rotation of the rotary plate 125 is restricted. However, the paper discharge rollers 62 are smoothly rotated owing to the torque limiter 148 described above (see FIG. 12).

When the mode of the image recording is set to the bordered recording by operating the operation panel 4, the carriage 38 does not make any contact with the abutment member 158. Therefore, the movable support section 88 is not subjected to the sliding movement unlike the above, and the movable support section 88 stops at the initial position as it is. Even when the bordered recording is performed, it is preferable to make the setting so that the LF motor 71 is reversely rotated before performing the paper feed. In this case, as described above even if the lock member 140 is not engaged with the rotary plate 125, then the lock member 140 is necessarily fitted into the groove 134 of the rotary plate 125 in accordance with the reverse rotation of the rotary plate 125, and the initialization is reliably performed.

In the multifunction machine 1 according to this embodiment, the recording paper, which is transported onto the platen 42, is supported by the platen 42. The image is recorded on the recording paper by discharging the ink droplets while allowing the ink-jet recording head 39 to slide in the main scanning direction. The recording paper is further transported in the transport direction in accordance with the recording of the image. In this situation, as shown in FIGS. 9 and 15, the movable support section 88 is allowed to slide in the transport direction while supporting the recording paper.

As shown in FIG. 12, the movable support section 88 is driven by the rotation of the rotary plate 125. The rotary plate 125 is rotated about the center of the cylinder shaft 127, and the cylinder shaft 127 is perpendicular to the upper surface 109 of the platen 42. In other words, the rotary plate 125 is rotated in such a state that the rotary plate 125 is arranged in parallel to the upper surface 109 of the platen 42. Therefore, the rotary plate 125 is efficiently arranged in the compact form in the vicinity of the platen 42. As a result, the miniaturization of the image-recording unit 24 is realized. Consequently, it is possible to design the compact form of the multifunction machine 1.

As shown in FIG. 16, the lever member 126 is engaged with the guide groove 143 of the rotary plate 125. Therefore, the forward end 145 of the lever member 126 is moved in the transport direction between the end of the platen 42 disposed on the upstream side in the transport direction and the end disposed in the downstream side in the transport direction in accordance with the rotation of the rotary plate 125. That is, the movable support section 88 is allowed to smoothly slide while following the recording paper. The end of the recording paper is always supported by the movable support section 88. The recording paper is not warped in the transport direction. Therefore, even when the groove 116 (see FIG. 9) is formed between the first fixed ribs 102 and the second fixed ribs 103 as in this embodiment, the recording paper does not fall toward the groove 116. The distance between the recording paper and the ink-jet recording head 39 is maintained to be constant. As a result, the high image quality recording on the recording paper is realized.

Further, the movable support section 88 is subjected to the sliding movement by using the LF motor 71 as the driving source. Accordingly, the movable support section 88 is allowed to slide more smoothly. Therefore, an advantage is obtained such that the higher image quality recording can be performed on the recording paper.

In this embodiment, the movable support section 88 is interlocked with the paper discharge roller shaft 92 which is driven by the LF motor 71. In general, the transport rollers are arranged in the vicinity of the recording head in the ink-jet recording apparatus. As for the power transmission mechanism 83 to transmit the power from the transport rollers 60 to the paper discharge rollers 62 and the purge mechanism 51, for example, it is necessary that a predetermined geometrical positional relationship should be maintained with respect to the transport rollers 60 and the ink-jet recording head 39. Therefore, if the movable support section 88 obtains the driving force from the transport roller 60 arranged closely to the ink-jet recording head 39, then it is difficult to design the image-recording unit 24, and the mechanism is complicated as well, in view of the geometrical positional relationship as described above. However, in the case of the multifunction machine 1 according to this embodiment, the movable support section 88 obtains the driving force from the side of the paper discharge roller 62 for which a certain margin is provided for the space. Therefore, the mechanism is simplified, and it is possible to design the further compact form of the multifunction machine 1.

In this embodiment, the rotary plate 125 is adopted, which is formed to have the disk-shaped form as the means for driving the movable support section 88. Therefore, the driving structure for the movable support section 88 is extremely simple, and the mechanism for rotating the rotary plate 125 can be designed in the compact form as well. Therefore, it is possible to realize the more compact form of the image-recording unit 24.

Further, the guide groove 143 having the shape as described above is formed on the rotary plate 125. Therefore, as shown in FIG. 16, the movable support section 88 is allowed to once slide to receive the recording paper to the upstream side in the transport direction. After that, the movable support section 88 is allowed to slide to the downstream side in the transport direction in accordance with the transport of the recording paper. Accordingly, the end of the recording paper is always supported by the movable support section 88. Therefore, the distance between the recording paper and the ink-jet recording head 39 is maintained to be constant more correctly. Therefore, it is possible to perform the higher image quality recording on the recording paper.

In particular, in this embodiment, the shape of the guide groove 143 provides the Archimedes' spiral. Therefore, the forward end 145 of the lever member 126 is moved in the radial direction from the center of the rotary plate 125 in response to the rotation of the rotary plate 125 (see FIG. 16). Specifically, the linear relationship is provided as described above between the angle of rotation of the rotary plate 125 and the amount of movement of the forward end 145. Therefore, the movable support section 88 smoothly follows the transport of the recording paper at the constant velocity in response to the rotary plate 125 rotated at the constant velocity, i.e., in synchronization with the recording paper intermittently transported by every predetermined line feed width. Therefore, for example, when the high resolution recording is performed, the feed amount of the recording paper (i.e., the line feed width) is set to be small. The rotary plate 125 is intermittently rotated by every small angle of rotation in response thereto. On the other hand, when the low resolution recording is performed, the line feed width of the recording paper is set to be large. The angle of rotation is increased for the rotary plate 125 in response thereto, and the amount of movement of the movable support section 88 is increased as well. Accordingly, the following advantage is obtained. That is, the recording paper is supported by the movable support section 88 more reliably, and the distance with respect to the ink-jet recording head 39 is maintained more correctly.

For example, if the shape of the guide groove 143 is not the Archimedes' spiral, the rotary plate 125 may be always rotated at a constant velocity of rotation irrelevant to the line feed width of the recording paper in some cases. This situation does not immediately cause any inconvenience. However, if it is feared that the movable support section 88 may get ahead of the recording paper to be transported by rotating the rotary plate 125 at a constant velocity, for example, it is also appropriate to make the setting such that the sliding movement of the movable support section 88 is stopped at a ratio of once per predetermined number of times of the line feed of the recording paper.

In this embodiment, as shown in FIGS. 14 and 16, the guide groove 143, which is formed in accordance with the Archimedes' spiral as described above, is formed symmetrically on the basis of the virtual axis 144. Therefore, the movable support section 88 is allowed to once slide from the initial position (FIG. 16A) to receive the recording paper to the upstream side in the transport direction. The movable support section 88 is continuously allowed to slide to the downstream side in the transport direction while supporting the end of the recording paper in accordance with the transport of the recording paper. Further, the movable support section 88 is allowed to slide continuously to return to the upstream side in the transport direction, and the movable support section 88 is returned to the initial position. Therefore, the movable support section 88 is always arranged at the initial position correctly. This means the fact that it is unnecessary to perform the initialization as described above for every sheet of the recording paper even when the continuous recording is performed on a plurality of sheets of the recording paper. Therefore, an advantage is obtained such that the continuous recording is performed at a high speed.

Additionally, the following function and effect are obtained in this embodiment.

In this embodiment, the recording paper, which is transported onto the platen 42, is firstly supported by the first fixed ribs 102. Further, the recording paper passes over the groove 116, and the recording paper is fed toward the second fixed ribs 103. The groove 116 can receive the ink droplets discharged from the ink-jet recording head 39 while exceeding the edge of the recording paper especially when the borderless recording is performed. An ink-absorbing member such as a sheet-shaped sponge may be laid and placed on the bottom of the groove 116. Accordingly, the ink droplets, which arrive at the inside of the groove 116, are reliably absorbed.

As described above, the movable support section 88 is covered with the recording paper when the movable support section 88 supports the recording paper. Therefore, the ink droplets, which are discharged toward the recording paper, are not adhered to the movable support section 88. Therefore, even when the next recording paper, which is continued to the foregoing recording paper, is arranged on the movable support section 88 when the image is continuously recorded on the sheets of the recording paper, any inconvenience does not arise, which would be otherwise caused such that the back surface of the recording paper is dirtied by the ink.

Further, the widthwise dimension 117 of the groove 116 may be set to be large, because the recording paper is supported by the movable support section 88. Accordingly, it is possible to allow the ink-jet recording head 39 to have a large size. Even when the ink-jet recording head 39 is large-sized, the groove 116 can cover the entire ink discharge area 118 of the ink-jet recording head 39. As a result, an advantage is obtained such that the high speed borderless recording is realized as well.

In this embodiment, the widthwise dimension 117 of the groove 116 (see FIG. 9) is set to be wider than the ink discharge area 118 of the ink-jet recording head 39 (see FIG. 6). Accordingly, even if the ink droplets are discharged from all of the nozzles 53 of the ink-jet recording head 39 when the recording paper is not arranged on the platen 42, then all of the ink droplets are received by the groove 116. Therefore, when the borderless recording is performed, the image can be recorded on the end of the recording paper, while the ink droplets are discharged from all of the nozzles 53 of the ink-jet recording head 39. That is, the borderless recording is performed at the high speed. Further, any complicated control is not required in relation to the discharge of the ink droplets from all of the nozzles 53.

In other words, if the widthwise dimension 117 of the groove 116 is narrower than the ink discharge area 118 of the ink-jet recording head 39, the following situation arises. That is, the ink droplets should be discharged from only the nozzles 53 disposed on the upstream side of the ink-jet recording head 39, when the borderless recording is performed on the forward end portion of the recording paper in the transport direction. The ink droplets should be successively discharged from the nozzles 53 disposed on the downstream side as well in accordance with the transport of the recording paper. It is necessary to perform the complicated control for the ink-jet recording head 39. On the contrary, in the case of the multifunction machine 1 according to this embodiment, it is unnecessary to perform any complicated control as described above. The borderless recording can be performed on the end portion of the recording paper by discharging the ink droplets from all of the nozzles 53 as described above. That is, the borderless recording is performed at the high speed without applying any complicated control in relation to the discharge of the ink droplets from the nozzles 53.

Further, in addition to the fact that the cross-sectional shape of the nozzle 53 is not necessarily a perfect circle, any minute dust adheres to the inside of the nozzle 53 in some cases. Therefore, the ink droplets are sometimes discharged in slightly oblique directions without being discharged straight from the nozzles 53. Even in such situations, the ink droplets are not adhered to the outside of the groove 116, because the widthwise dimension 117 of the groove 116 is set to be wider than the ink discharge area 118 of the ink-jet recording head 39. As a result, the back surface of the recording paper is reliably prevented from being dirtied by the ink.

In particular, the members, which support the recording paper, are the first fixed ribs 102, the second fixed ribs 103, and the ribs 103. Therefore, the members for supporting the recording paper have the extremely simple structure. Additionally, the contact area between the respective ribs and the recording paper is decreased. Therefore, the transport resistance of the recording paper is decreased, and it is possible to transport the recording paper more smoothly. The chamfering processing is applied to the corner portions 122, 123 of the ribs 121 of the movable support section 88 (see FIG. 9). The inclined surfaces are formed at the corner portions 122, 123. Accordingly, even when the end of the recording paper having passed over the first fixed ribs 102 abuts against the corner portions 122, the end of the recording paper is smoothly guided onto the movable support section 88. Therefore, the smooth transport of the recording paper is not inhibited by the provision of the movable support section 88. The chamfering processing is also applied to the respective corner portions of the first fixed ribs 102 and the second fixed ribs 103 as described above. These portions are constructed as the inclined surfaces. Therefore, even when the recording paper abuts against the corner portions of the first fixed ribs 102 and the second fixed ribs 103 during the transport, the smooth transport of the recording paper is not inhibited.

As shown in FIG. 16, the lever member 126, which is engaged with the rotating rotary plate 125, converts the amount of rotation of the rotary plate 125 into the amount of displacement of the movable support section 88 in the transport direction by the predetermined magnification. Accordingly, the movable support section 88 is allowed to make the sliding movement in synchronization with the transport of the recording paper (see FIG. 15). Further, the amount of rotation of the rotary plate 125 is amplified and converted into the amount of displacement in the transport direction. Therefore, the rotary plate 125 is small-sized or miniaturized. As a result, it is possible to design the multifunction machine 1 in the more compact form.

In this embodiment, the lock member 139 is always engaged with the rotary plate 125 as shown in FIG. 12. Therefore, the movable support section 88 is not slid while following the recording paper except for the case in which the borderless recording is performed. In this situation, the movable support section 88 is arranged between the first fixed ribs 102 and the second fixed ribs 103. Therefore, the recording paper, which is transported on the platen 42, is suppressed from the invasion into the groove 116. The lock member 139 is disengaged from the rotary plate 125 when the borderless recording is performed. Therefore, any one of the borderless recording or the bordered recording is freely changed and set.

Next, a modified embodiment of the embodiment of the present invention will be explained.

Figure 17:
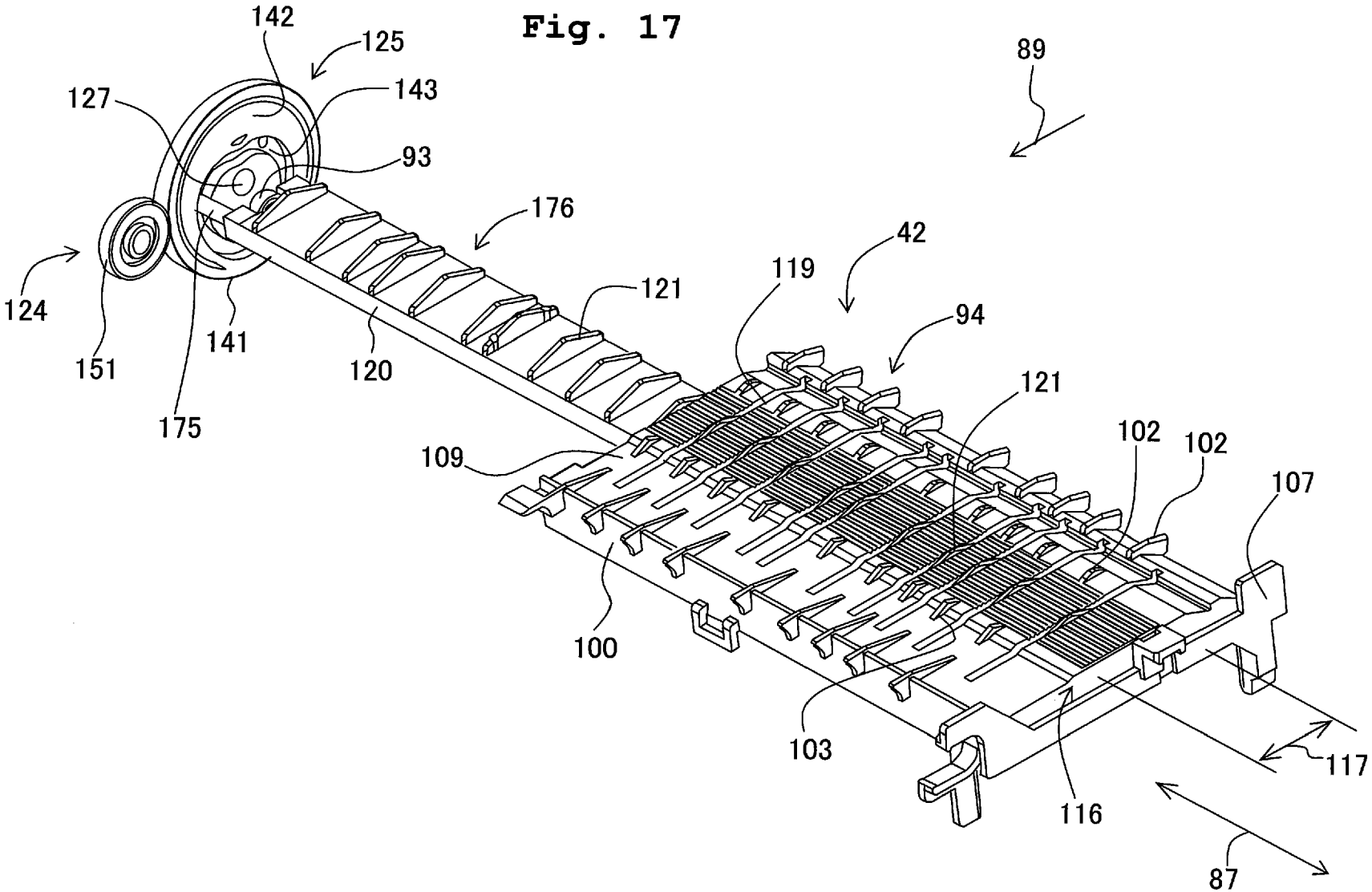
FIG. 17 shows a magnified perspective view illustrating main components of a multifunction machine according to a modified embodiment of the first embodiment of the present invention.

FIG. 17 shows a magnified perspective view illustrating main components of a multifunction machine 1 according to the modified embodiment of the embodiment of the present invention, which depicts a magnified perspective view illustrating a platen 42 and a movable support section 176.

The movable support section 176 according to this modified embodiment is different from the movable support section 88 according to the embodiment described above in the following points. That is, in the case of the embodiment described above, the lever member 126 is provided for the movable support section 88 as shown in FIG. 11. The movable support section 88 is interlocked with the rotary plate 125 by the aid of the lever member 126. On the contrary, in this modified embodiment, an engaging pin 175 (engaging section) is provided for the movable support section 176. The engaging pin 175 is fitted into a guide groove 143 of a rotary plate 125. Further, for this reason, a cylinder shaft 127 of the rotary plate 125 extends in the main scanning direction (direction of the arrow 87). The geometry is changed for a power transmission mechanism 124 including a gear 151 for driving the rotary plate 125. The other constitutive components are the same as or equivalent to those of the embodiment described above.

That is, in this modified embodiment, an engaging surface 142 of the rotary plate 125 ("back surface" in the embodiment described above) is substantially perpendicular to the upper surface 109 of the platen 42. The engaging pin 175, which is provided to protrude on the side surface of the movable support section 176, is fitted to the guide groove 143 which is provided on the engaging surface 142 of the rotary plate 125. The engaging pin 175 is slidable along the guide groove 143. Therefore, also in this modified embodiment, when the rotary plate 125 is rotated, then the movable support section 176 is allowed to slide by the aid of the engaging pin 175, and the recording paper, which is transported on the platen 42, is reliably supported by the ribs 121. Further, an advantage is obtained such that the interlocking mechanism 105 for driving the movable support section 176 has the simple structure, because the movable support section 176 is allowed to slide by the aid of the engaging pin 175.

Second Embodiment

Next, a second embodiment of the present invention will be explained.

Figure 18:
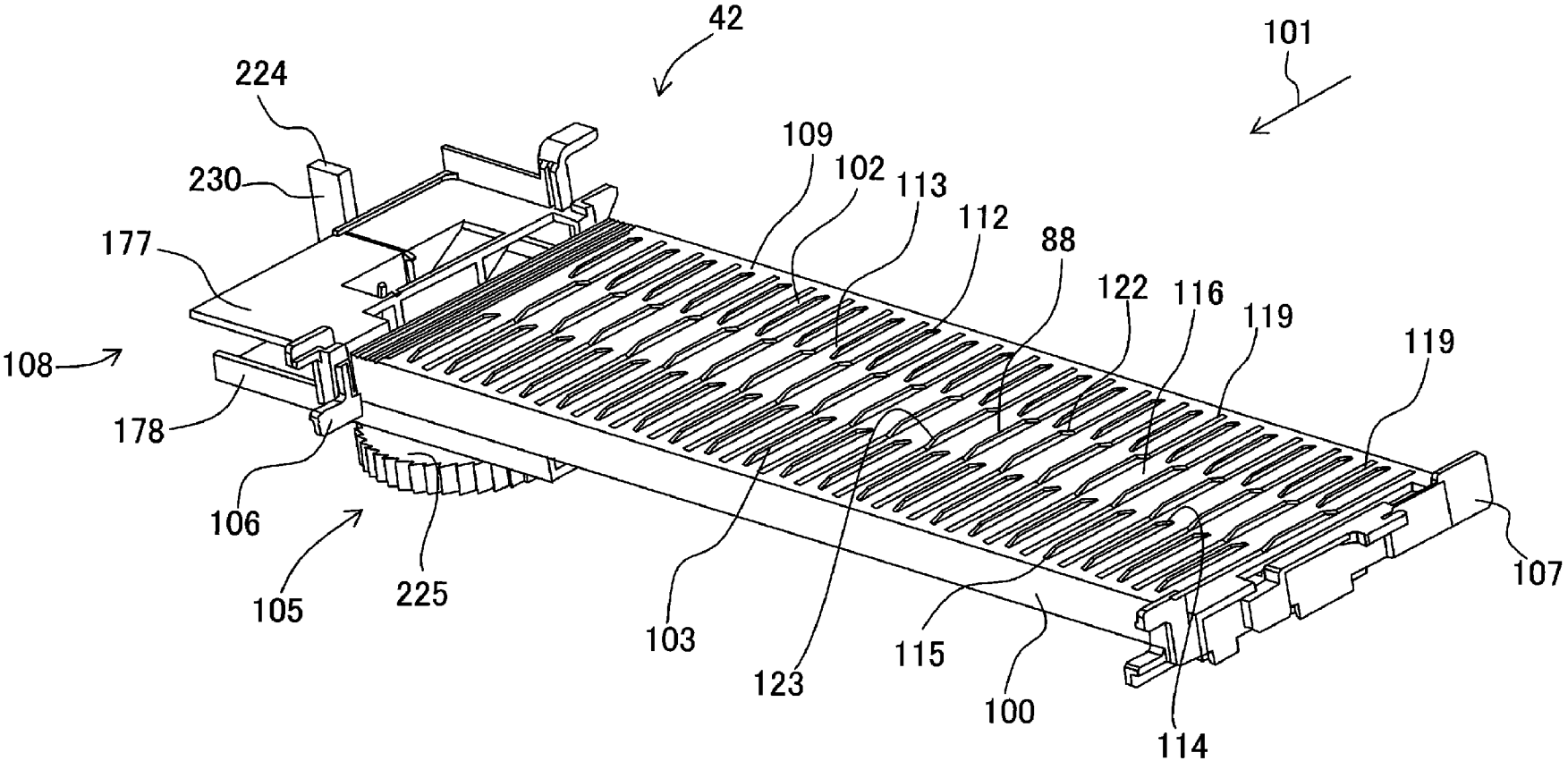
FIG. 18 shows a magnified perspective view illustrating a platen of a multifunction machine according to a second embodiment of the present invention.
Figure 19:
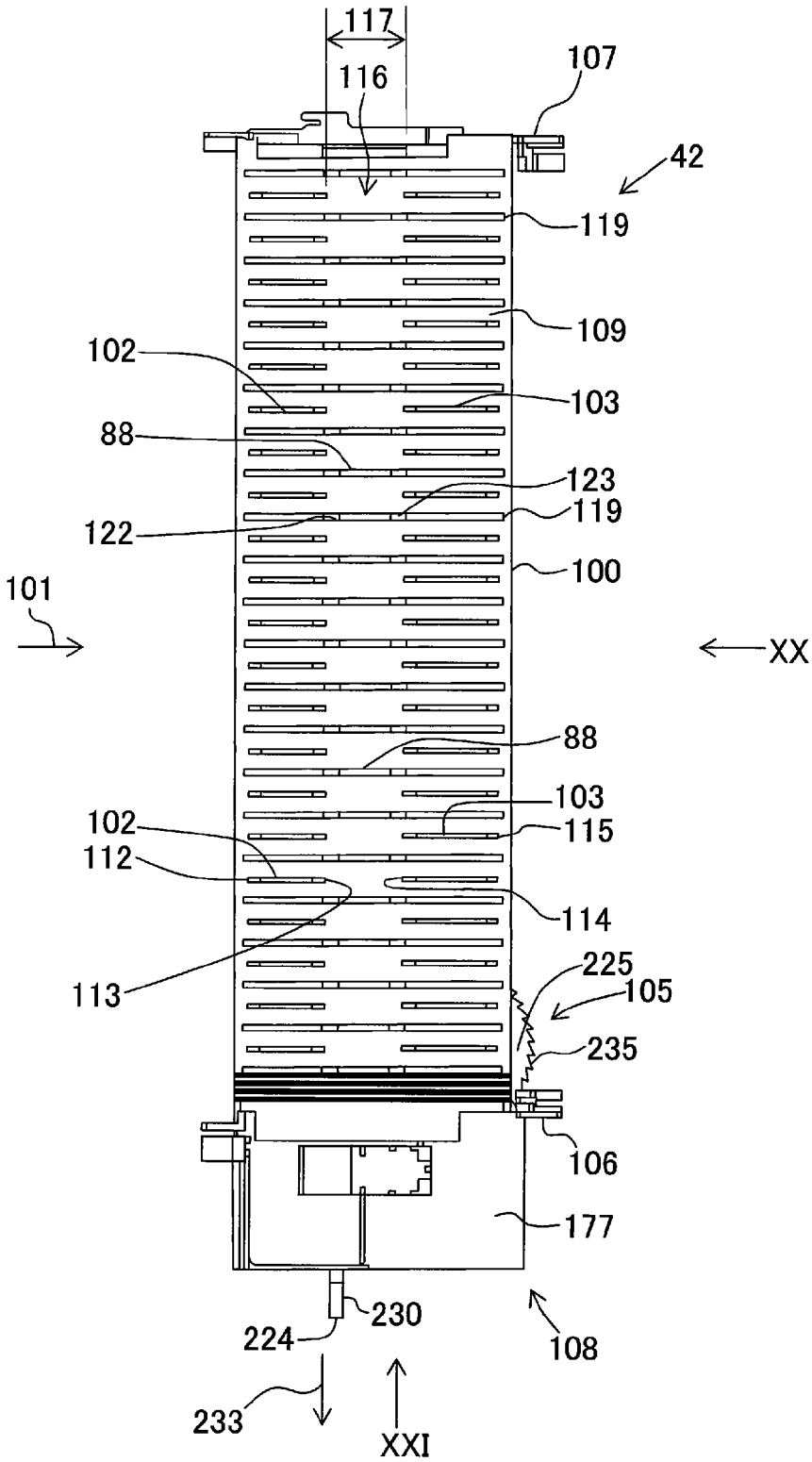
FIG. 19 shows a front view illustrating the platen of the multifunction machine according to the second embodiment of the present invention.
Figure 20:
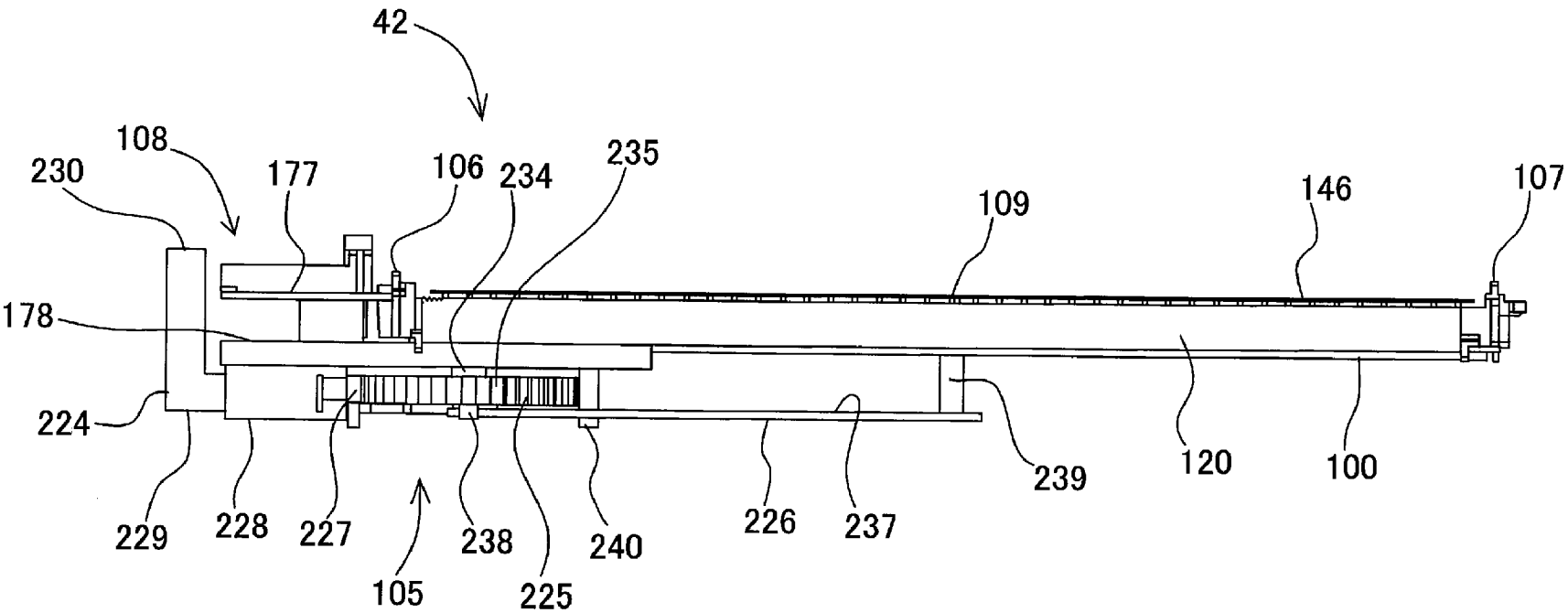
FIG. 20 shows a view as viewed in a direction of an arrow XX shown in FIG. 19.
Figure 21:
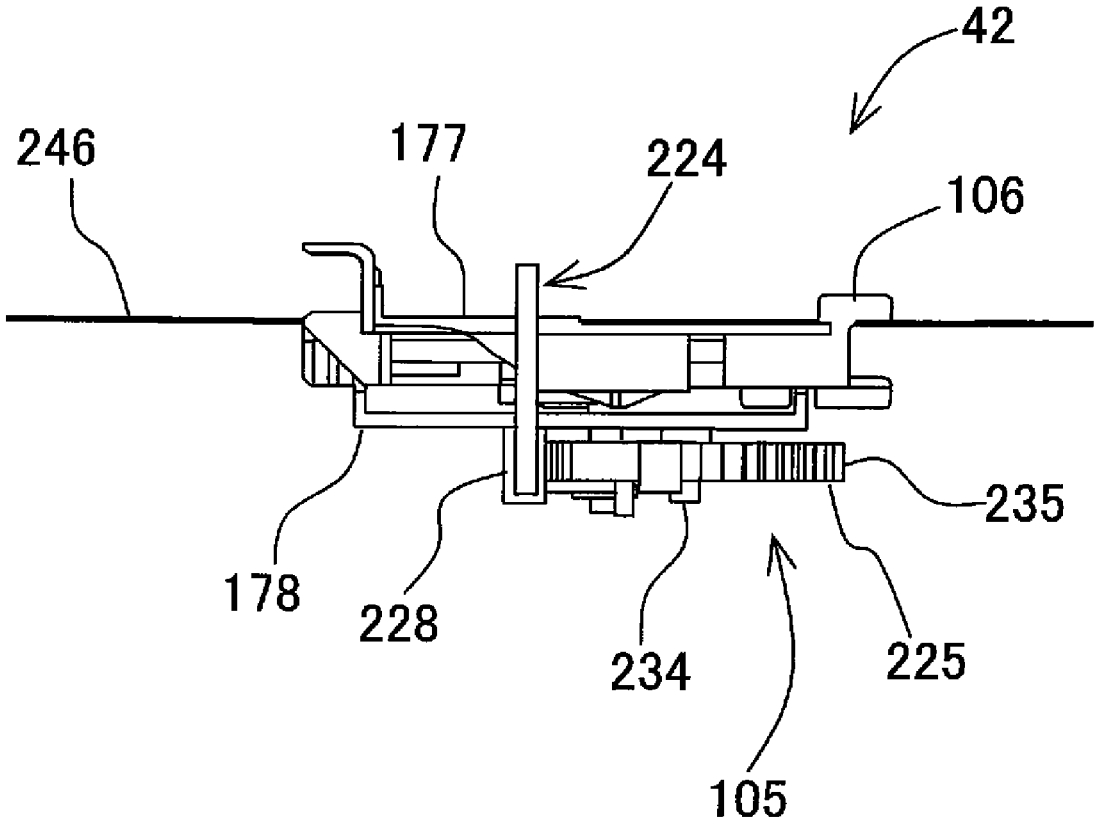
FIG. 21 shows a view as viewed in a direction of an arrow XXI shown in FIG. 19.
Figure 22:
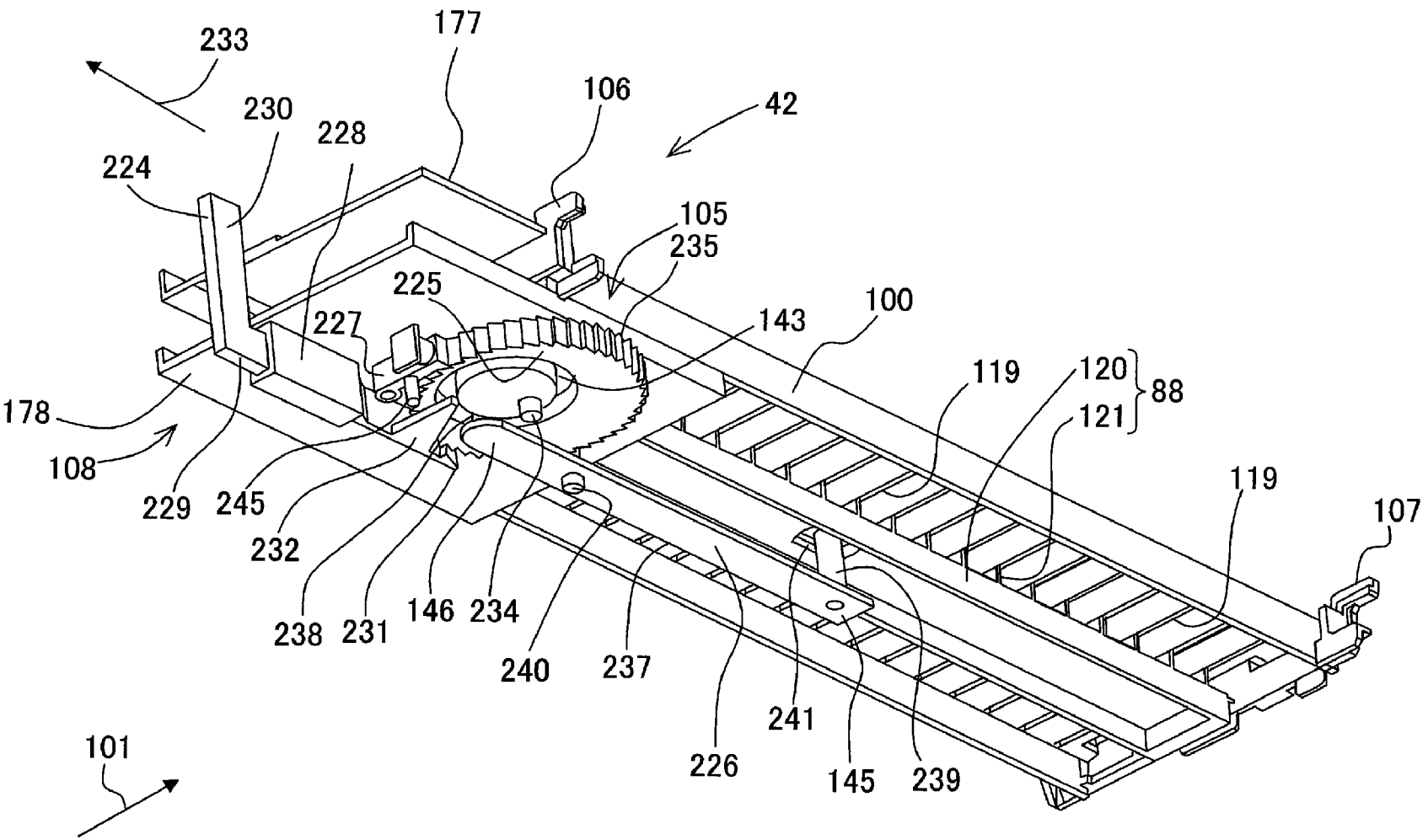
FIG. 22 shows a perspective view as viewed from a bottom surface side illustrating a platen of the multifunction machine according to the second embodiment of the present invention.
Figure 23:
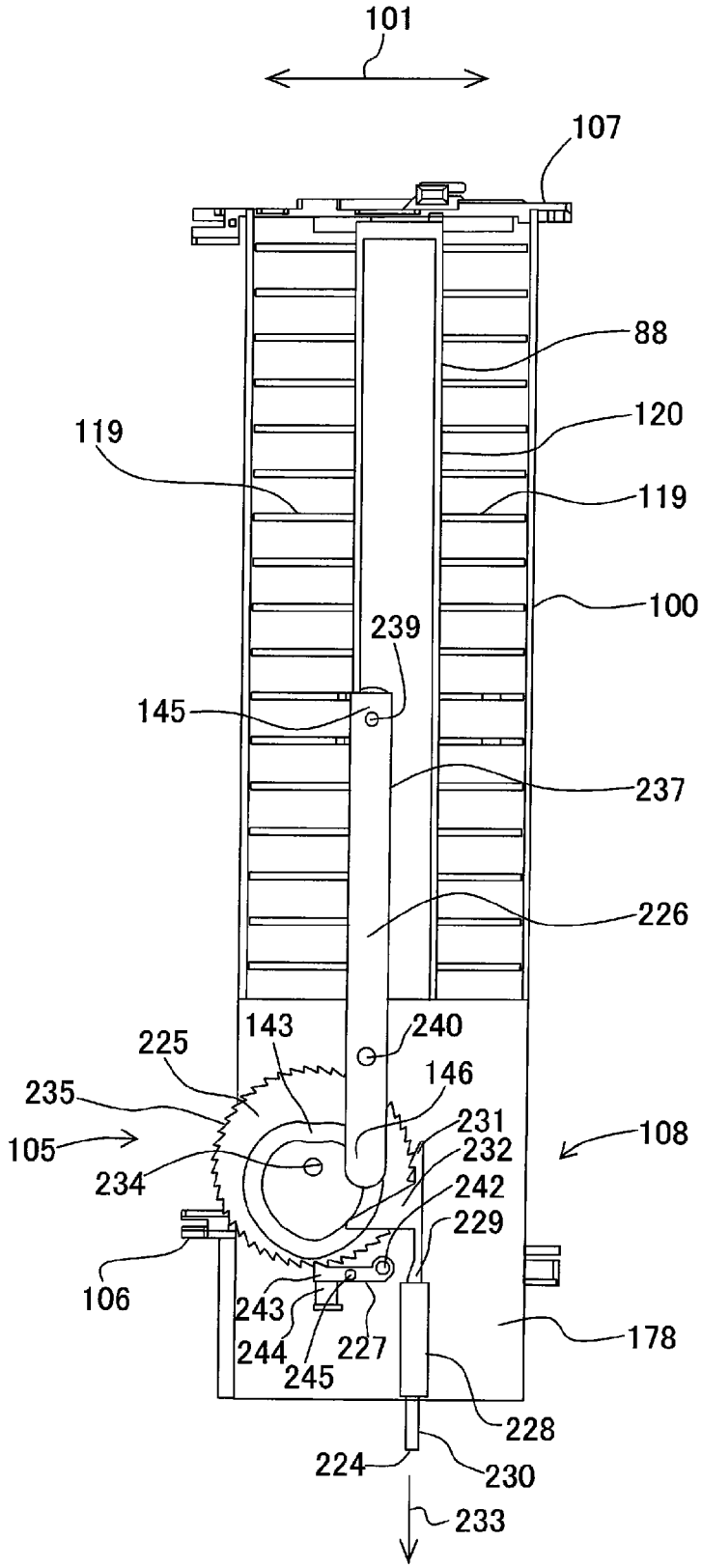
FIG. 23 shows a bottom view illustrating the platen of the multifunction machine according to the second embodiment of the present invention.

FIG. 18 shows a magnified perspective view illustrating a platen 42 of a multifunction machine 1 according to the second embodiment of the present invention. FIG. 19 shows a front view illustrating the platen 42. FIGS. 20 and 21 show views as viewed in the directions indicated by arrows XX and XXI shown in FIG. 19 respectively. FIG. 22 shows a perspective view as viewed from the bottom surface side of the platen 42. FIG. 23 shows a bottom view illustrating the platen 42. A detailed explanation will be made below about the platen 42, a movable support section 88, and an interlocking mechanism 105 according to this embodiment. In the multifunction machine 1 according to this embodiment, constitutive components other than the platen 42, the movable support section 88, and the interlocking mechanism 105 described later on are the same as or equivalent to those of the first embodiment described above.

The platen 42 is also arranged opposingly (at the lower position as shown in FIG. 3) to the ink-jet recording head 39 in the same manner as in the first embodiment described above to support the recording paper to be transported (see FIGS. 3 and 5). As shown in FIG. 18, the platen 42 has a thin-walled plate-shaped form which is slender and rectangular as a whole. The platen 42 is arranged so that the longitudinal direction thereof extends in the main scanning direction. In FIG. 18, the direction of the arrow 101 is the transport direction. The recording paper is transported in the direction of this arrow.

The platen 42 includes a frame 100, and first fixed ribs 102 and second fixed ribs 103 which are provided on the frame 100. The platen 42 is provided with the movable support section 88 which is provided slidably for the frame 100, and the interlocking mechanism 105 which drives the movable support section 88 in a sliding manner as described later on.

The frame 100 is composed of, for example, synthetic resin or steel plate, which constitutes the skeleton of the platen 42. The frame 100 is formed to have a substantially C-shaped cross-sectional shape. Brackets 106, 107 are provided at the proximal end and the forward end of the frame 100 respectively. The brackets 106, 107 are formed integrally with the frame 100. The frame 100 is fastened and fixed to the multifunction machine 1 by the aid of the brackets 106, 107.

An interlocking mechanism attachment section 108 is provided at the proximal end of the frame 100. As shown in FIGS. 18 and 22, the interlocking mechanism attachment section 108 is provided at the proximal end of the frame 100. The interlocking mechanism attachment section 108 includes an upper plate 177 which is provided to extend on the side of the upper surface 109 of the frame 100, and a lower plate 178 which is provided on the side of the lower surface of the frame 100. Both of the upper plate 177 and the lower plate 178 are rectangular, which are formed integrally with the frame 100. The lower plate 178 supports the interlocking mechanism 105 as described in detail later on.

The first fixed ribs 102 and the second fixed ribs 103 are provided on the upper surface 109 of the frame 100. The first fixed ribs 102 are provided at end portions of the upper surface 109 on the upstream side in the transport direction. The first fixed ribs 102 protrude upwardly (toward the ink-jet recording head 39). The second fixed ribs 103 are provided at end portions of the upper surface 109 on the downstream side in the transport direction. The second fixed ribs 103 protrude upwardly. As shown in FIG. 18, the first fixed ribs 102 and the second fixed ribs 103 are composed of rectangular thin-walled plate-shaped members, and they are provided upstandingly on the upper surface 109.

In this embodiment, the plurality of first fixed ribs 102 are provided on the upper surface 109. The respective first fixed ribs 102 are aligned in the main scanning direction. Similarly, the plurality of second fixed ribs 103 are provided on the upper surface 109. The respective second fixed ribs 103 are aligned in the main scanning direction. When the first fixed ribs 102 and the second fixed ribs 103 are provided as described above, a groove 116 is formed between the first fixed ribs 102 and the second fixed ribs 103. As shown in FIGS. 18 and 19, the groove 116 extends in the main scanning direction, and the groove 116 is expanded in the transport direction. The widthwise dimension 117 of the groove 116 corresponds to the size of the ink-jet recording head 39. The widthwise dimension 117 of the groove 116 is set to be wider than the ink discharge area 118 (see FIG. 6) of the ink-jet recording head 39.

As shown in FIG. 19, one first fixed rib 102 and one second fixed rib 103 are opposed to one another in the transport direction (direction of the arrow 101) with the groove 116 intervening therebetween. As shown in FIG. 18, the chamfering processing is applied to corner portions 112, 113 of the first fixed rib 102 to form a pair of inclined surfaces. In this embodiment, the inclined surfaces are formed at the corner portions 112, 113 disposed on the both sides of the first fixed rib 102 in the transport direction. However, it is enough that the inclined surface is formed at least at the corner portion 112 disposed on the upstream side in the transport direction. Similarly, the chamfering processing is also applied to corner portions 114, 115 of the second fixed rib 103 to form a pair of inclined surfaces. In this embodiment, the inclined surfaces are formed at the corner portions 114, 115 of the second fixed rib 103 disposed on the both sides in the transport direction. However, it is enough that the inclined surface is formed at least at the corner portion 114 disposed on the upstream side in the transport direction.

A plurality of slits 119 are provided through the upper surface 109 of the frame 100. As shown in FIG. 18, the slits 119 extend in the transport direction from the end on the upstream side to the end on the downstream side in the transport direction of the upper surface 109. The respective slits 119 are formed continuously to span the adjoining first fixed ribs 102 and the adjoining second fixed ribs 103. The movable support section 88 is fitted into the slits 119 from the lower position to protrude upwardly from the slits 119.

As shown in FIG. 22, the movable support section 88 has a base 120 which is formed to be box-shaped, and ribs 121 which are composed of rectangular thin-walled plate-shaped members. The movable support section 88 may be composed of synthetic resin or metal. The base 120 is constructed as a member having a C-shaped cross section. The base 120 is fitted into the frame 100. Although not shown in FIG. 22, the both ends of the base 120 in the main scanning direction are slidably supported by the frame 100. Therefore, the base 120 is smoothly slidable in the transport direction (direction of the arrow 101 as shown in FIG. 23) at the inside of the frame 100.

The ribs 121 are provided on the upper surface of the base 120. The ribs 121 are formed integrally with the base 120. The ribs 121 are rectangular, and they pass through the slits 119 to protrude upwardly from the upper surface 109 of the frame 100 as shown in FIG. 18. The plurality of ribs 121 are provided on the upper surface of the base 120. As shown in FIG. 22, the respective ribs 121 are provided and aligned at predetermined intervals or spacing distances in the main scanning direction on the upper surface of the base 120. The predetermined interval corresponds to the pitch of the slits 119. Therefore, the plurality of ribs 121 protrude upwardly from the respective slits 119.

The chamfering processing is applied to corner portions 122, 123 of the movable support section 88 to form a pair of inclined surfaces in the same manner as the first fixed ribs 102 and the second fixed ribs 103. In this embodiment, the inclined surfaces are formed at the corner portions 122, 123 of the movable support section 88 disposed on the both sides in the transport direction. However, it is enough that the inclined surface is formed at least at the corner portion 122 disposed on the upstream side in the transport direction.

The interlocking mechanism 105 is provided in order to allow the movable support section 88 to slide in the transport direction as described above. As shown in FIG. 22, the interlocking mechanism 105 includes an input member 224, a rotary plate 225, and a swinging member 226 (engaging section). In this embodiment, a rotation-restricting member 227 for restricting the rotation of the rotary plate 225 as described later on and an unillustrated spring member are further provided. The spring member is constructed, for example, as a spiral spring, which is arranged between the upper plate 177 and the lower plate 178. The spring member is fixed to the upper plate 177 or the lower plate 178 and the rotary plate 225, which is deformed in accordance with the rotation of the rotary plate 225. Therefore, when the rotary plate 225 is rotated as described later on, the spring member accumulates the strain energy depending on the angle of rotation. If the strain energy is released from the spring member 127, the rotary plate 225 is rotated in the opposite direction.

As shown in FIG. 22, the input member 224 is formed to be substantially L-shaped, which is provided with a first arm 229 and a second arm 230. The input member 224 is arranged outside the printing area in the main scanning direction. The input member 224 is retained by a retaining section 228 which is provided on the lower surface of the lower plate 178. The retaining section 228 is formed to have a cylindrical shape with a rectangular cross section in this embodiment. The first arm 229 of the input member 224 is slidably inserted into the retaining section 228. As shown in FIGS. 22 and 23, an engaging pawl 231 is formed at the forward end of the first arm 229. Further, a restriction release arm 232 is provided on the proximal end side of the engaging pawl 231 (on the side of the second arm 230). The restriction release arm 232 releases the rotary plate 225 from the restriction of rotation as described later on. On the other hand, the second arm 230 is continued to the proximal end of the first arm 229, and the second arm 230 is perpendicular to the first arm 229. That is, as shown in FIG. 22, the second arm 230 extends upwardly by a predetermined distance from the upper plate 177 of the interlocking mechanism attachment section 108. When the ink-jet recording head 39 is subjected to the sliding movement, the carriage 38 presses the second arm 230 in the direction of the arrow 233 (in the main scanning direction). Although not shown in FIG. 22, an urging spring is arranged in the retaining section 228. The input member 224 is elastically urged by the elastic force of the urging spring in the direction opposite to the arrow 233. Therefore, when the carriage 38 is separated from the input member 224 after the carriage 38 presses the input member 224 in the direction of the arrow 233, the input member 224 is allowed to slide in the direction opposite to the arrow 233 by means of the urging spring.

The rotary plate 225 is formed to be disk-shaped. The rotary plate 225 is rotatably supported by a rotation center shaft 234. The rotation center shaft 234 is fixed to the frame 100 (specifically to the lower plate 178). The rotation center shaft 234 is inserted into the central portion of the rotary plate 225. A plurality of teeth 235 are continuously formed on the circumferential surface of the rotary plate 225. The teeth 235 are engaged with the engaging pawl 231 of the input member 224. Therefore, when the input member 224 is allowed to slide in the direction of the arrow 233 as described above, the rotary plate 225 is rotated in the rightward direction (see FIG. 23) about the center of the rotation center shaft 234. As described above, the input member 224 is elastically urged in the direction opposite to the direction of the arrow 233. Therefore, when the carriage 38 is moved after the input member 224 is pressed in the direction of the arrow 233, the input member 224 is allowed to slide in the direction opposite to the direction of the arrow 233. Accordingly, the engaging pawl 231 is engaged with the teeth 235 again. Further, as shown in FIGS. 22 and 23, a guide groove 143 is formed on the rotary plate 225. The guide groove 143 has a shape similar to that of the guide groove 143 provided for the rotary plate 125 according to the first embodiment described above. The guide groove 143 is formed along an Archimedes' spiral. The proximal end of the swinging member 226 is engaged with the guide groove 143.

The swinging member 226 includes a main body 237 which is composed of a slender flat plate, an engaging pin 238 which is provided at a proximal end 146 of the main body 237, and an engaging rod 239 which is provided at a forward end 145. The swinging member 226 may be also composed of synthetic resin or metal. The main body 237 is rotatably supported by a swinging movement center shaft 240. The swinging movement center shaft 240 is fixed to the lower plate 178 of the interlocking mechanism attachment section 108. The swinging movement center shaft 240 is inserted into the central portion of the main body 237. The engaging pin 238 is provided to protrude upwardly from the main body 237 (see FIG. 22). The engaging pin 238 is fitted into the guide groove 143 of the rotary plate 225. The outer diametral dimension of the engaging pin 238 is adapted to the groove width dimension of the guide groove 143. The engaging pin 238 is capable of performing the relative sliding movement without causing any backlash along the guide groove 143. When the engaging pin 238 is relatively moved along the guide groove 143 as described above, the main body 237 is rotated about the center of the swinging movement center shaft 240. That is, the swinging member 226 makes the swinging movement about the center of the swinging movement center shaft 240. Accordingly, the engaging rod 239, which is provided at the forward end 145 of the main body 237, makes the sliding movement in a circular arc-shaped form about the center of the swinging movement center shaft 240.

In this arrangement, the engaging rod 239 is connected to the base 120 of the movable support section 88. The base 120 is provided with a slotted hole 241 which extends in the longitudinal direction (i.e., in the main scanning direction). The engaging rod 239 is fitted into the slotted hole 241. The outer diametral dimension of the engaging rod 239 is adapted to the inner diametral dimension of the slotted hole 241. Therefore, the engaging rod 239 does not cause any backlash in any direction other than the scanning direction with respect to the slotted hole 241.

Therefore, when the main body 237 makes the swinging movement as described above, and the engaging rod 239 is moved in the circular arc-shaped form about the center of the swinging movement center shaft 240, then the base 120 is allowed to slide in the transport direction, while the engaging rod 239 is allowed to slide in the main scanning direction along the slotted hole 241. As described above, the both ends of the base 120 in the main scanning direction are slidably supported by the frame 100. Therefore, the base 120 is allowed to smoothly slide in the transport direction (direction of the arrow 101 shown in FIG. 23) on the virtual surface which is parallel to the upper surface 109 at the inside of the frame 100. In other words, when the swinging member 226 makes the swinging movement, the movable support section 88 is allowed to slide in the transport direction.

An engaging rod, which is engaged with the rotary plate 225, is adopted for the rotation-restricting member 227. As shown in FIG. 23, the rotation-restricting member 227 is rotatably supported by a support pin 242. The support pin 242 is provided upstandingly on the lower plate 178 of the interlocking mechanism attachment section 108, which is inserted into the proximal end portion of the rotation-restricting member 227. An engaging pawl 243 is formed at the forward end of the rotation-restricting member 227. The engaging pawl 243 is engaged with the teeth 235 of the rotary plate 225. Accordingly, with reference to FIG. 23, the rightward rotation is permitted but the leftward rotation is restricted for the rotary plate 225. The rotation-restricting member 227 is elastically urged toward the rotary plate 225 by a spring 244. Therefore, the rotation-restricting member 227 is engaged with the rotary plate 225 in the normal state, and the rotation of the rotary plate 225 is restricted as described above.

The rotation-restricting member 227 is provided with an abutment pin 245. The abutment pin 245 is provided to protrude on the rotation-restricting member 227, which extends downwardly (see FIG. 22). As described above, the input member 224 is allowed to slide in the direction of the arrow 233. When the input member 224 is allowed to slide to a predetermined restriction release position, the restriction release arm 232 abuts against the abutment pin 245 to press the abutment pin 245 in the direction of the arrow 233. Accordingly, the rotation-restricting member 227 is rotated against the elastic force of the spring 244, and the engaging pawl 243 is separated from the rotary plate 225. Accordingly, the rotary plate 225 is released from the restriction of the rotation.

In this embodiment, the engaging pin 238 is engaged at the predetermined position (initial position) of the guide groove 143 as shown in FIG. 23. In this situation, the movable support section 88 is positioned at the central portion of the frame 100. As shown in FIG. 18, the movable support section 88 is positioned between the first fixed ribs 102 and the second fixed ribs 103. The movable support section 88 is arranged at this position in the normal state in the same manner as in the first embodiment described above.

With reference to FIG. 23, when the ink-jet recording head 39 is reciprocatively moved in the main scanning direction, the input member 224 is intermittently pressed by the scanning carriage 38. Accordingly, the rotary plate 225 is intermittently rotated in the rightward direction by every predetermined angle of rotation (i.e., by every angle of rotation corresponding to the rotation feed amount brought about by the teeth 235). When the rotary plate 225 is rotated as described above, the guide groove 143 makes the swinging rotation about the center of the rotation center shaft 234. Therefore, the engaging pin 238, which is engaged with the guide groove 143, is moved in the leftward direction in accordance with the rotation of the rotary plate 225. When the angle of rotation of the rotary plate 225 arrives at 90° (degrees), the engaging pin 238 begins to be moved in the rightward direction in accordance with the rotation of the rotary plate 225. The engaging pin 238 is moved in the rightward direction until the angle of rotation of the rotary plate 225 arrives at 270°.

FIGS. 24 and 25 schematically show the relationship between the transport of the recording paper and the movement of the movable support section 88.

Figure 24A:
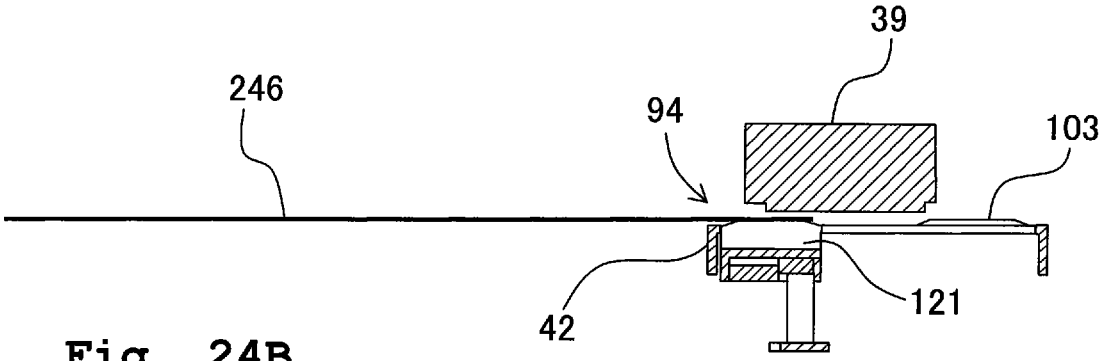
FIGS. 24A to 24C schematically show the relationship between the recording paper and the movement of a movable support section according to the second embodiment of the present invention.

In the initial state, the movable support section 88 is positioned between the first fixed ribs 102 and the second fixed ribs 103 (initial position). However, as shown in FIG. 24A, when the recording paper 246 is transported to the end 94 on the upstream side in the transport direction of the frame 100 of the platen 42, the movable support section 88 is moved to the upstream side in the transport direction to receive the recording paper 246. Specifically, as described above, the recording paper 246 is fed along the transport passage 23 (see FIG. 3), and the recording paper 246 is fed onto the platen 42 by the transport rollers 60.

At first, the control unit 64 drives the LF motor 71 to rotate the paper feed roller 25 in order that the recording paper stacked in the paper feed tray 20 is fed to the printing paper transport passage 23 when the image recording is performed in the same manner as in the first embodiment described above. When the recording paper is fed, the LF motor 71 is driven in the reverse rotation. When the driving is transmitted, then the paper feed roller 25 is rotated in the direction to feed the recording paper, and the transport rollers 60 and the paper discharge rollers 62 are rotated in the direction opposite to the transport direction. The recording paper, which is fed from the paper feed tray 20 to the printing paper transport passage 23, is transported so that the recording paper is inverted from the lower position to the upper position along the printing paper transport passage 23. The forward end of the recording paper abuts against the regi sensor 95, and the recording paper is further transported. Accordingly, the recording paper abuts against the transport rollers 60 and the pinch rollers. The transport rollers 60 are rotated in the direction opposite to the transport direction. Therefore, the recording paper is subjected to the registration process in a state in which the forward end abuts against the transport rollers 60 and the pinch rollers. The registration position is indicated by reference numeral 174 in FIG. 15. After the completion of the registration process for the recording paper, the control unit 64 drives the LF motor 71 in the forward rotation. Accordingly, the recording paper, which has been subjected to the registration process, is nipped by the transport rollers 60 and the pinch rollers, and the recording paper is transported on the platen 42 as indicated by the diagram 167 shown in FIG. 15.

When the borderless recording is performed, the movable support section 88 is allowed to slide while following the transport of the recording paper. In particular, when the recording paper is arranged at the registration position 174, then the movable support section 88 is positioned at the middle or center of the platen 42 as described above, and the proximal end 146 of the swinging member 226 is arranged at the predetermined position in the guide groove 143 of the rotary plate 225 (position equivalent to the position indicated by reference numeral 165 shown in FIG. 14: initial position) as shown in FIG. 23.

After the forward end of the recording paper 246 is subjected to the registration on the basis of the transport roller 60, the LF motor 71 is intermittently driven as indicated by the diagram 168 shown in FIG. 15. The recording paper 246 is transported to the recording position on the platen 42. After that, as indicated by the diagram 169, the CR motor 73 is also driven at the predetermined timing. Accordingly, the carriage 38 is allowed to slide in the main scanning direction to abut against the input member 224. In this situation, the control unit 64 performs the control of the slide amount of the carriage 38, i.e., the driving control of the CR motor 73.

When the carriage 38 is allowed to slide, and the input member 224 is pressed as described above, then the rotary plate 225 is rotated in the rightward direction with reference to FIG. 23, and the movable support section 88 is moved to the upstream side in the transport direction as shown in FIG. 24A. When the angle of rotation of the rotary plate 225 arrives at 90°, the movable support section 88 arrives at the first position to receive the recording paper 246.

Figure 24B:
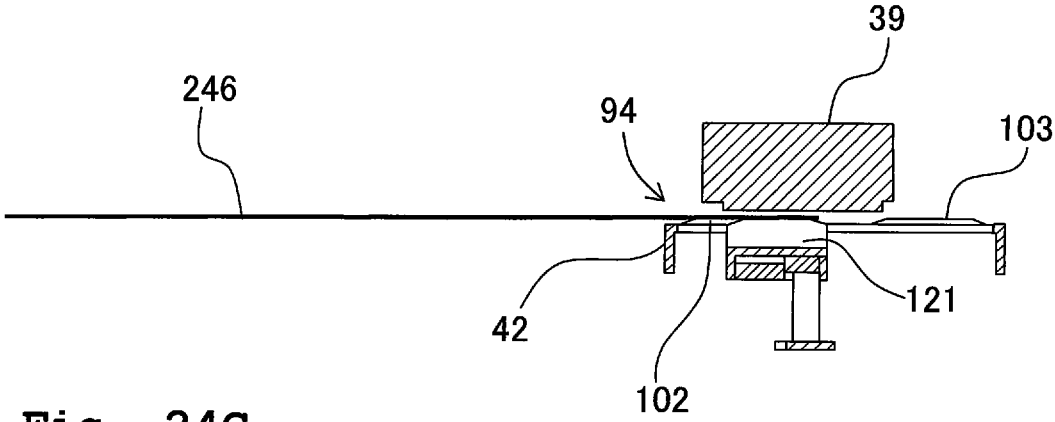
Figure 24C:
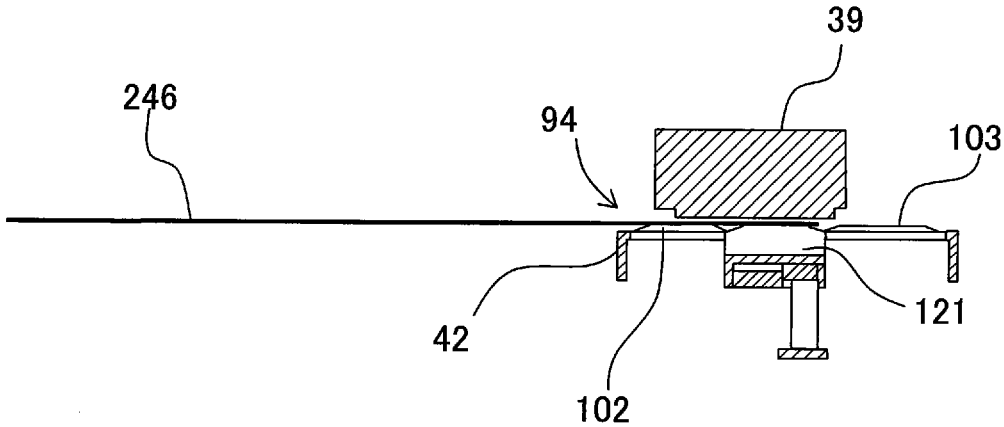

After that, the carriage 38 is allowed to slide in accordance with the image recording, and the input member 224 is pressed. Accordingly, the rotary plate 225 is further rotated in the rightward direction with reference to FIG. 23. When the rotary plate 225 is further rotated in the rightward direction, the movable support section 88 is moved to the downstream side in the transport direction while following the recording paper 246 while supporting the forward end of the recording paper 246 as shown in FIG. 24B. When the angle of rotation of the rotary plate 225 arrives at 180°, the movable ribs 121 arrive at the initial position (central portion of the groove 116) from the first position as shown in FIG. 24C.

Figure 25A:
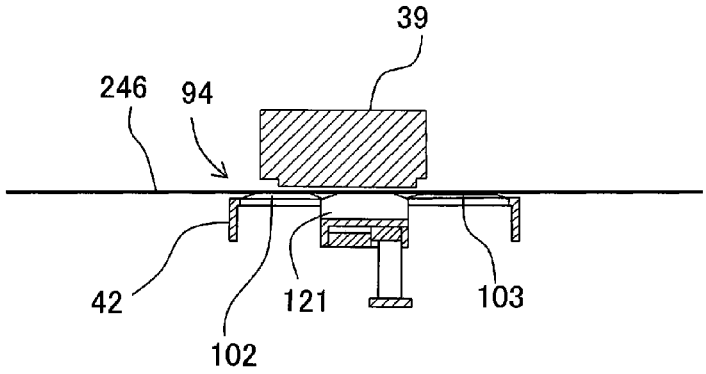
FIGS. 25A to 25C schematically show the relationship between the recording paper and the movement of the movable support section according to the second embodiment of the present invention.

When the angle of rotation of the rotary plate 225 arrives at 180°, and the movable support section 88 is moved to the position between the first fixed ribs 102 and the second fixed ribs 103, then the movable support section 88 is retained at that position. However, as shown in FIG. 25A, the image recording is performed while feeding the recording paper 246 in the transport direction. The following means is available to retain the movable support section 88 while transporting the recording paper 246 as described above. That is, the slide distance may be controlled so that the carriage 38, which retains the ink-jet recording head 39, does not abut against the input member 224.

Figure 25B:
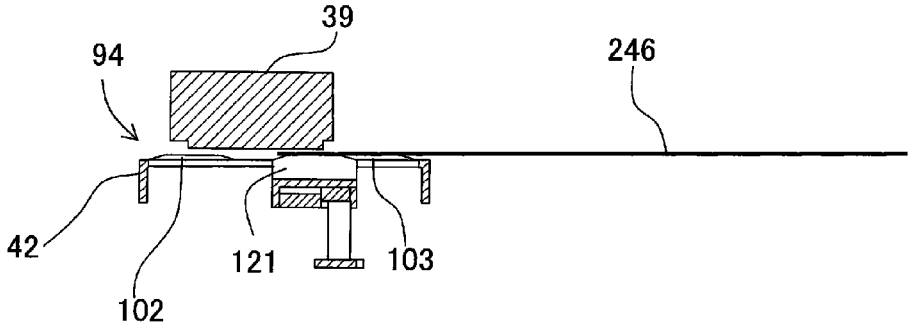
Figure 25C:
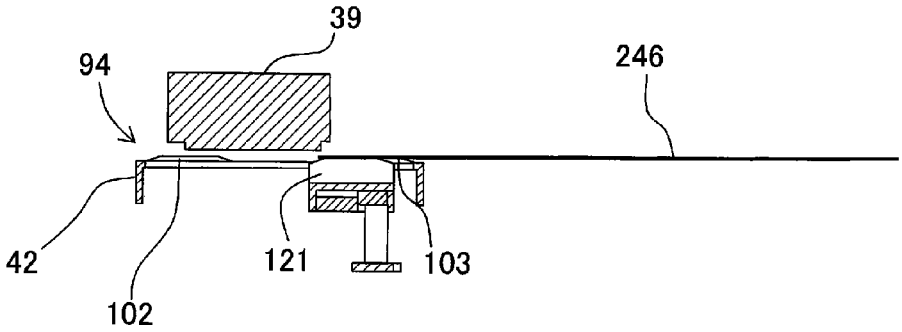

As shown in FIG. 25B, when the recording paper 246 is transported, and the backward end of the recording paper 246 is moved onto the movable support section 88, then the movable support section 88 is allowed to slide in the transport direction again. As shown in FIG. 25C, the movable support section 88 is moved to the downstream side in the transport direction while following the recording paper 246 while supporting the backward end of the recording paper 246. Specifically, the input member 224 is pressed again in accordance with the sliding movement of the carriage 38, and the rotary plate 225 is rotated in the rightward direction with reference to FIG. 23. Accordingly, the movable support section 88 is further moved to the downstream side in the transport direction. When the angle of rotation of the rotary plate 225 arrives at 270°, the movable support section 88 is positioned at the second position. The following means is available to move the movable support section 88 again, the movable support section 88 being stopped at the position between the first fixed ribs 102 and the second fixed ribs 103 (initial position). That is, the slide distance of the ink-jet recording head 39 may be controlled so that the carriage 38, which retains the ink-jet recording head 39, abuts against the input member 224 again.

When the recording paper 246 is discharged, the carriage 38, which retains the ink-jet recording head 39, allows the input member 224 to slide to the predetermined position (restriction release position). In this situation, when the driving of the CR motor is controlled, the carriage 38 is allowed to slide to the predetermined position. Accordingly, the input member 224 is allowed to slide to the restriction release position. Specifically, as shown in FIG. 23, the input member 224 is allowed to slide in the direction of the arrow 233, and the restriction release arm 232 presses the abutment pin 242. Accordingly, the rotation-restricting member 227 is rotated in the leftward direction against the elastic force of the spring 244, and the rotary plate 225 is released from the restriction of rotation. As described above, the strain energy is accumulated in the spring member in accordance with the rotation of the rotary plate 225. Therefore, when the rotary plate 225 is released from the restriction of rotation, the strain energy is released. As a result, the rotary plate 225 is rotated in the opposite direction (leftward direction in FIG. 23). The strain energy, which is accumulated in the spring member, results from the rotation of the rotary plate 225. Therefore, when all of the strain energy is released, the rotary plate 225 is rotated by 270° in the leftward direction. That is, the movable support section 88 is restored to the initial position again.

In the multifunction machine 1 according to this embodiment, the recording paper 246, which is transported onto the platen 42, is supported by the platen 42. The image is recorded on the recording paper 246 by discharging the ink droplets while allowing the ink-jet recording head 39 to slide in the main scanning direction. The recording paper 246 is further transported in the transport direction in accordance with the recording of the image. In this situation, as shown in FIGS. 24 and 25, the movable support section 88 is allowed to slide in the transport direction while supporting the recording paper 246. That is, the end of the recording paper 246 is always supported by the movable support section 88 during the image recording. Therefore, no warpage is caused in the transport direction. Accordingly, even when the groove 116 (see FIGS. 18 and 19) is formed between the first fixed ribs 102 and the second fixed ribs 103 as in this embodiment, the recording paper 246 does not fall toward the groove 116. The constant distance is maintained between the recording paper 246 and the ink-jet recording head 39. As a result, the multifunction machine 1 is capable of performing the high image quality printing in the same manner as the first embodiment described above.

In particular, the recording paper 246, which is transported onto the platen 42, is firstly supported by the first fixed ribs 102. Further, the recording paper 246 passes over the groove 116, and the recording paper 246 is fed toward the second fixed ribs 103. The groove 116 can receive the ink droplets discharged from the ink-jet recording head 39 while exceeding the edge of the recording paper 246 especially when the borderless recording is performed. Accordingly, the back side of the recording paper 246 is prevented from any adhesion of the ink. When the recording paper 246 passes over the groove 116, the movable support section 88 is allowed to slide in the transport direction while following the recording paper 246 to be transported. That is, the movable support section 88 supports the recording paper 246 while making the sliding movement from the first position to the second position. Therefore, the end of the recording paper 246 is always supported by the movable support section 88 reliably as described above. The invasion of the recording paper 246 into the groove 116 is avoided. As a result, the constant distance is maintained between the recording paper 246 and the ink-jet recording head 39 as described above. The high image quality printing is realized.

As shown in FIG. 22, the movable support section 88 is driven in accordance with the rotation of the rotary plate 225. However, the rotary plate 225 is rotated about the center of the rotation center shaft 234. In other words, also in this embodiment, the rotary plate 225 is rotated in the state of being arranged in parallel to the upper surface 109 of the platen 42. Therefore, the rotary plate 225 is efficiently arranged in the compact form in the vicinity of the platen 42. As a result, the miniaturization of the image-recording unit 24 is realized. Consequently, it is possible to design the compact form of the multifunction machine 1.

In this embodiment, the rotation of the rotary plate 225 is restricted or regulated by the rotation-restricting member 227. In this arrangement, as shown in FIGS. 22 and 23, the input member 224 and the rotation-restricting member 227 constitute a ratchet mechanism which rotates the rotary plate 225 in only the rightward direction with reference to FIG. 23. Therefore, every time when the ink-jet recording head 39 makes the reciprocating motion, the rotary plate 225 is rotated in the rightward direction. The movable support section 88 reliably makes the sliding movement in the transport direction to support the recording paper 246. In this situation, the sliding movement of the ink-jet recording head 39 may be controlled by the control unit 64 to make the following adjustment. That is, the carriage 38 may press the input member 224 to rotate the rotary plate 225 every time when the ink-jet recording head 39 makes the reciprocating motion. Alternatively, the carriage 38 may press the input member 224 to rotate the rotary plate 225 every time when the ink-jet recording head 39 is subjected to the reciprocating motion a predetermined number of times. When the sliding movement of the ink-jet recording head 39 is controlled as described above, the line feed width of the recording paper 246 may be synchronized with the sliding amount of the movable support section 88.

The guide groove 143 having the shape as described above is formed on the rotary plate 225. Therefore, when the rotary plate 225 is rotated, the movable support section 88 is allowed to once slide to receive the recording paper 246 on the upstream side in the transport direction as shown in FIGS. 24 and 25. After that, the movable support section 88 is allowed to slide to the downstream side in the transport direction in accordance with the transport of the recording paper 246. Accordingly, the end of the recording paper 246 is always supported by the movable support section 88. Therefore, the distance between the recording paper 246 and the ink-jet recording head 39 is maintained to be constant more correctly. Therefore, it is possible to perform the higher image quality recording on the recording paper 246.

Also in this embodiment, the shape of the guide groove 143 provides the Archimedes' spiral. Therefore, the movable support section 88 smoothly follows the transport of the recording paper 246 at the constant velocity in response to the rotary plate 225 rotated at the constant velocity. When the intermittent rotation of the rotary plate 225 is adapted to the line feed width of the recording paper 246, then the sliding movement of the movable support section 88 is synchronized with the feed of the recording paper 246, and the recording paper 246 is supported by the movable support section 88 more reliably. Therefore, an advantage is obtained such that the distance between the ink-jet recording head 39 and the recording paper 246 is maintained more correctly.

In this embodiment, the spring member is arranged between the upper plate 177 and the lower plate 178. Therefore, the spring member is strained in accordance with the rotation of the rotary plate 225, and the strain energy is accumulated corresponding to the angle of rotation of the rotary plate 225. However, when the recording paper 246 is discharged, then the sliding movement of the ink-jet recording head 39 is controlled by the control unit 64, and the input member 224, which is pressed by the carriage 38, is allowed to slide to the restriction release position. Accordingly, the rotary plate 225 is released from the restriction of rotation, and the strain energy, which is accumulated in the spring member, is released as described above. The rotary plate 225 is rotated in the leftward direction. As a result, the movable support section 88 is restored to the initial position (position shown in FIG. 18). The movable support section 88 is returned to the initial position after the recording paper 246 is discharged as described above. Therefore, even when the continuous recording is performed on a plurality of sheets of the recording paper 246, then it is unnecessary to perform the initialization for each of the sheets of the recording paper 246, and the continuous recording is performed at a high speed.

Additionally, in this embodiment, as shown in FIGS. 22 and 23, the guide groove 143, which is formed in accordance with the Archimedes' spiral as described above, is formed to be annular. Therefore, the movable support section 88 is once allowed to slide from the initial position to receive the recording paper 246 to the upstream side in the transport direction. The movable support section 88 is continuously allowed to slide to the downstream side in the transport direction while supporting the end of the recording paper 246 in accordance with the transport of the recording paper 246. Further, the movable support section 88 is allowed to slide continuously to return to the upstream side in the transport direction, and thus the movable support section 88 is returned to the initial position. Therefore, even if the spring member is omitted, the movable support section 88 is always arranged at the initial position correctly. Accordingly, it is unnecessary to perform the initialization for every sheet of the recording paper 246 even when the continuous recording is performed on a plurality of sheets of the recording paper 246. The continuous recording is performed at a high speed.

Also in this embodiment, the widthwise dimension 117 of the groove 116 may be set to be large, because the recording paper 246 is supported by the movable support section 88. Accordingly, it is possible to allow the ink-jet recording head 39 to have a large size. Further, even when the ink-jet recording head 39 is large-sized, the groove 116 can cover the entire ink discharge area 118 of the ink-jet recording head 39. As a result, the high speed borderless recording is realized as well. In particular, the members for supporting the recording paper 246 are the ribs. Therefore, an advantage is obtained such that the members for supporting the recording paper 246 have the extremely simple structure. Further, the recording paper 246 can be transported smoothly, because the contact area is decreased between the recording paper 246 and the first fixed ribs 102, the second fixed ribs 103, and the movable support section 88 (ribs 121).

Also in this embodiment, in the same manner as in the first embodiment described above, the widthwise dimension 117 of the groove 116 is set to be wider than the ink discharge area 118 of the ink-jet recording head 39. Accordingly, even if the ink droplets are discharged from all of the nozzles 53 of the ink-jet recording head 39 when the recording paper 246 is not arranged on the platen 42, all of the ink droplets are received by the groove 116. Therefore, when the borderless recording is performed, the image can be recorded on the end of the recording paper 246, while the ink droplets are discharged from all of the nozzles 53 of the ink-jet recording head 39. That is, the borderless recording is performed at the high velocity. Further, any complicated control is not required in relation to the discharge of the ink droplets from the nozzles 53. Further, in addition to the fact that the cross-sectional shape of the nozzle 53 is not necessarily a perfect circle, any minute dust adheres to the inside of the nozzle 53 in some cases. Therefore, the ink droplets are sometimes discharged in slightly oblique directions without being discharged straight from the nozzles 53. Even in such situations, the ink droplets are not adhered to the outside of the groove 116, because the widthwise dimension 117 of the groove 116 is set to be wider than the ink discharge area 118 of the ink-jet recording head 39. As a result, the back surface of the recording paper 246 is reliably prevented from being dirtied by the ink.

Further, the chamfering processing is applied to the corner portions 122, 123 of the movable support section 88 (see FIG. 18). The inclined surfaces are formed at the corner portions 122, 123. Accordingly, even when the end of the recording paper 246 having passed over the first fixed ribs 102 abuts against the corner portions 122 of the movable support section 88, the end of the recording paper 246 is smoothly guided onto the upper surface of the movable support section 88.

Therefore, the smooth transport of the recording paper 246 is not inhibited by the provision of the movable support section 88. Similarly, the chamfering processing is also applied to the respective corner portions 112 to 115 of the first fixed ribs 102 and the second fixed ribs 103, and these portions are constructed as the inclined surfaces. Therefore, even when the recording paper 246 abuts against the corner portions 112 to 115 during the transport, the smooth transport of the recording paper 246 is not inhibited.

In particular, in this embodiment, the carriage 38, which is subjected to the sliding movement by the CR motor 73 (see FIG. 5), allows the input member 224 to slide as described above (see FIGS. 22 and 23). The rotary plate 225 is rotated in accordance with the sliding movement of the input member 224. Further, the rotation of the rotary plate 225 is converted into the sliding movement of the movable support section 88 by means of the swinging member 226. That is, in the case of the interlocking mechanism 105 according to this embodiment, the LF motor 71 is not the direct driving source of the movable support section 88. Therefore, the correct transport of the recording paper 246 is not inhibited. In this embodiment, the driving source of the movable support section 88 is the CR motor 73. However, the CR motor 73 effects the pressing action on the input member 224 in the area which is disposed outside the scanning range of the carriage 38 (i.e., the area disposed outside the image recording range). Therefore, the correct transport of the recording paper 246 is secured at the inside of the image recording range.

The movement of the movable support section 88 as described above is required especially when the borderless recording is performed on the recording paper 246. However, when the bordered recording is performed, the movement of the movable support section 88 is unnecessary. The movable support section 88 waits at the position shown in FIG. 18 in the normal state. Therefore, when the bordered recording is performed, the movable support section 88 may be fixed at the position shown in FIG. 18 without being driven. In this arrangement, the following means is available to fix the movable support section 88. That is, the sliding movement of the ink-jet recording head 39 may be adjusted by the control unit 64. That is, it is appropriate that the CR motor 73 is driven so that the carriage 38 makes no contact with the input member 224.

Third Embodiment

Next, a third embodiment of the present invention will be explained. A multifunction machine 310 according to this embodiment will be explained below with reference to FIGS. 26 to 35. Those other than portions of the multifunction machine 310 explained below are basically the same as those of the multifunction machine 1 explained in the first embodiment, any explanation of which will be omitted.

Figure 26:
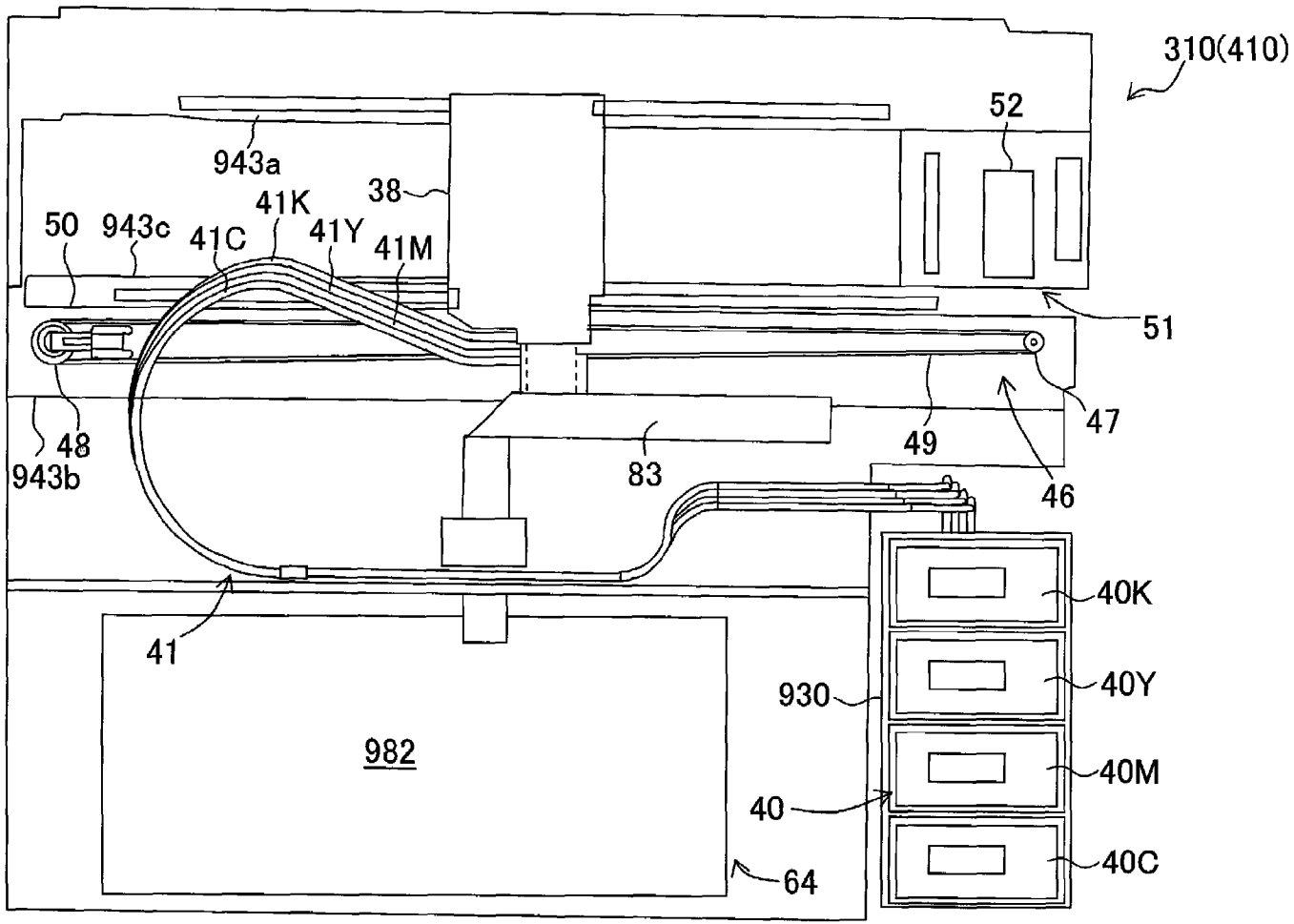
FIG. 26 shows a plan view illustrating a printer section of a multifunction machine according to a third embodiment of the present invention.

As shown in FIG. 26, a pair of guide rails 943*a*, 943*b* are arranged over the transport passage 23. The pair of guide rails 943*a*, 943*b* are arranged opposingly while providing a predetermined spacing distance in the transport direction of the recording paper. The respective guide rails 943*a*, 943*b* extend in the widthwise direction of the transport passage 23. The scanning carriage 38 spans the pair of guide rails 943*a*, 943*b*. The scanning carriage 38 is provided slidably along the guide rails 943*a*, 943*b*. The guide rail 943*a*, which is arranged on the upstream side in the transport direction of the recording paper, is flat plate-shaped. The length thereof in the widthwise direction of the transport passage 23 is set to be longer than the scanning width of the scanning carriage 38. The upper surface of the guide rail 943*a* slidably carries the end of the scanning carriage 38 disposed on the upstream side.

On the other hand, the guide rail 943*b*, which is arranged on the downstream side in the transport direction of the recording paper, is flat plate-shaped. The length thereof in the widthwise direction of the transport passage 23 is set to be approximately the same as the length of the guide rail 943*a*. An edge 943*c* of the guide rail 943*b* supports the end of the scanning carriage 38 disposed on the downstream side. The edge 943*c* is bent substantially perpendicularly in the upward direction. The scanning carriage 38 is slidably carried on the upper surface of the guide rail 943*b*. Further, the edge 943*c* is supported, for example, by an unillustrated roller. Therefore, the scanning carriage 38 is slidably carried on the guide rails 943*a*, 943*b*. The scanning carriage 38 makes the reciprocating movement in the widthwise direction of the transport passage 23 on the basis of the edge 943*c* of the guide rail 943*b*. Sliding members, which reduce the friction, are appropriately provided at portions at which the scanning carriage 38 makes contact with the upper surfaces of the guide rails 943*a*, 943*b*.

A belt drive mechanism 44 is arranged on the upper surface of the guide rail 943*b*. The belt drive mechanism 44, the scanning carriage 38, the purge mechanism 51, the driven pulley 48, and the driving pulley 47 are the same as or equivalent to those of the first embodiment, any explanation of which will be omitted. The encoder strip 50 of the linear encoder (see FIG. 8) is arranged along the edge 943*c*. The linear encoder detects the encoder strip 50 by the aid of the photo-interrupter. The reciprocating movement of the scanning carriage 38 is controlled on the basis of the detection signal of the linear encoder.

Figure 27:
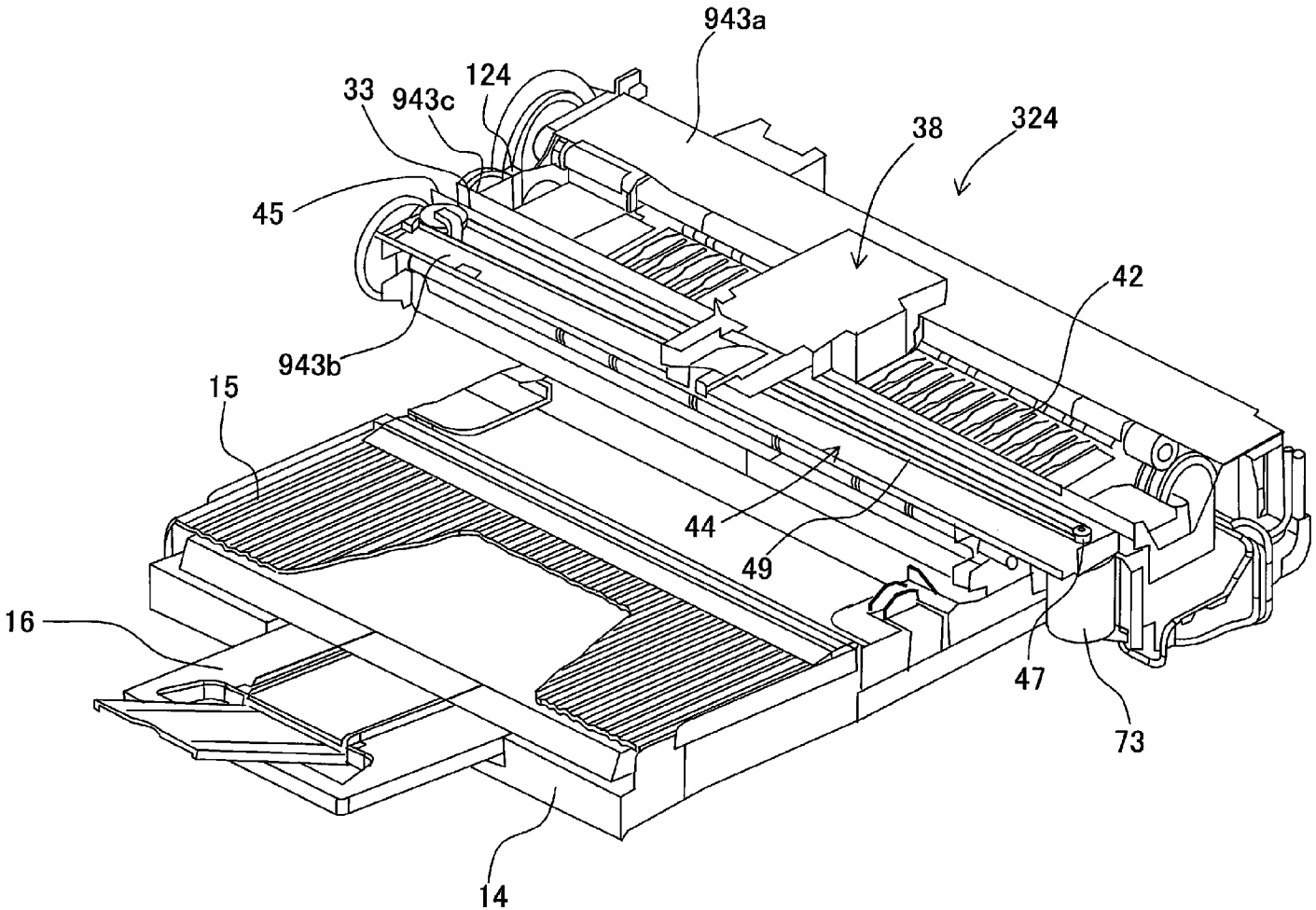
FIG. 27 shows a perspective view illustrating an image-recording unit of the multifunction machine according to the third embodiment of the present invention.

As shown in FIG. 27, a platen 342 is arranged opposingly to the recording head 39 under the transport passage 23 as described above. The platen 342 is arranged over a central portion through which the recording paper passes, of the reciprocating movement range of the scanning carriage 38. The dimension of the platen 342 in the longitudinal direction (dimension in the direction perpendicular to the paper surface of FIG. 3) is set to be sufficiently larger than the maximum width of the recording paper capable of being transported. The both ends of the recording paper always pass on the platen 342. The structure of the platen 342 will be described in detail later on.

The ink cartridges 40 are installed to a cartridge-installing section 930. The cartridge-installing section 930 is provided on the front side of the printer section 2 in the frame disposed on the right side. The cartridge-installing section 930 is arranged in the multifunction machine 310, while the cartridge-installing section 930 is constructed as a member distinct from the scanning carriage 38 which carries the recording head 39. Therefore, the inks, which are contained in the ink cartridges 40 installed to the cartridge-installing section 930, are supplied to the scanning carriage 38 via the ink tubes 41. The ink cartridges 40 include four ink cartridges 40C, 40M, 40Y, 40K for storing the inks of the respective colors of cyan (C), magenta (M), yellow (Y), and black (Bk). The ink cartridges 40C, 40M, 40Y, 40K are installed to predetermined positions in the cartridge-installing section 930 respectively. The respective ink cartridges 40C, 40M, 40Y, 40K are constructed in the same manner except that the colors of the inks to be stored are different from each other.

The multifunction machine 310 according to this embodiment performs the image recording with the inks of the four colors. However, the number of ink colors is not specifically limited in relation to the ink-jet recording apparatus according to the present invention. It is a matter of course that the number of the ink cartridges 40 can be increased when the image recording is performed, for example, with six color inks or eight color inks.

The ink tubes 41 are provided independently for each of the colors. Therefore, the inks are supplied to the recording head 39 independently for each of the colors from the respective ink cartridges 40C, 40M, 40Y, 40K installed to the cartridge-installing section 930 respectively. The respective ink tubes 41C, 41M, 41Y, 41K are tubes made of synthetic resin, which has the flexibility so that the ink tubes 41C, 41M, 41Y, 41K are flexibly bent or warped in accordance with the scanning of the scanning carriage 38.

Respective flow passages of the cartridge-installing section 930, which are provided for the respective ink cartridges 40, are connected to ends of the respective ink tubes 41C, 41M, 41Y, 41K respectively. The ink tube 41C corresponds to the ink cartridge 40C, which is provided to supply the ink of cyan (C). Similarly, the ink tubes 41M, 41Y, 41K correspond to the ink cartridges 40M, 40Y, 40K respectively, which are provided to supply the inks of magenta (M), yellow (Y), and black (Bk) respectively.

The respective ink tubes 41C, 41M, 41Y, 41K, which are connected to the cartridge-installing section 930, are led from the cartridge-installing section 930 to the positions in the vicinity of the center in the widthwise direction of the image-recording unit 24, and they are once fixed to an appropriate member such as the apparatus frame. The portions of the respective ink tubes 41C, 41M, 41Y, 41K, which range from the fixed positions to the scanning carriage 38, are not fixed to the frame or the like of the multifunction machine 310, and they undergo the posture change while following the reciprocating movement of the scanning carriage 38. That is, the respective ink tubes 41C, 41M, 41Y, 41K are moved in the direction of the movement of the scanning carriage 38 while being flexibly bent so that the bending radii of the U-shaped curved portions are decreased, in accordance with the movement of the scanning carriage 38 to one end (left side in the drawing) in the reciprocating movement direction. On the other hand, the respective ink tubes 41C, 41M, 41Y, 41K are moved in the direction of the movement of the scanning carriage 38 while being flexibly bent so that the bending radii of the U-shaped curved portions are increased, in accordance with the movement of the scanning carriage 38 to the other end (right side in the drawing) in the reciprocating movement direction.

FIG. 6 shows a magnified bottom view illustrating the recording head 39. In FIG. 6, the vertical direction is the transport direction of the recording paper, and the lateral direction is the main scanning direction of the scanning carriage 38.

Figure 28:
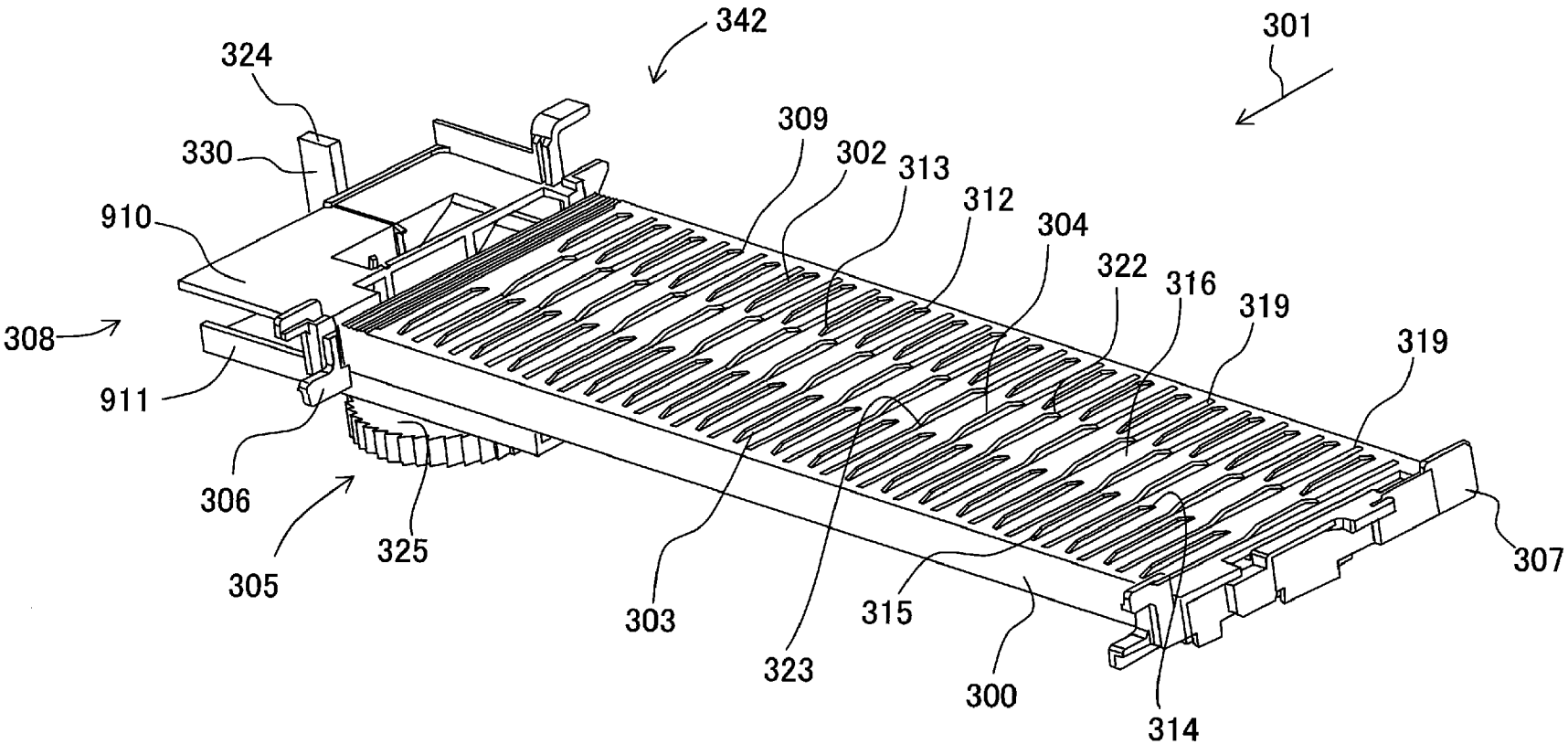
FIG. 28 shows a perspective view illustrating main components shown in FIG. 27.
Figure 29:
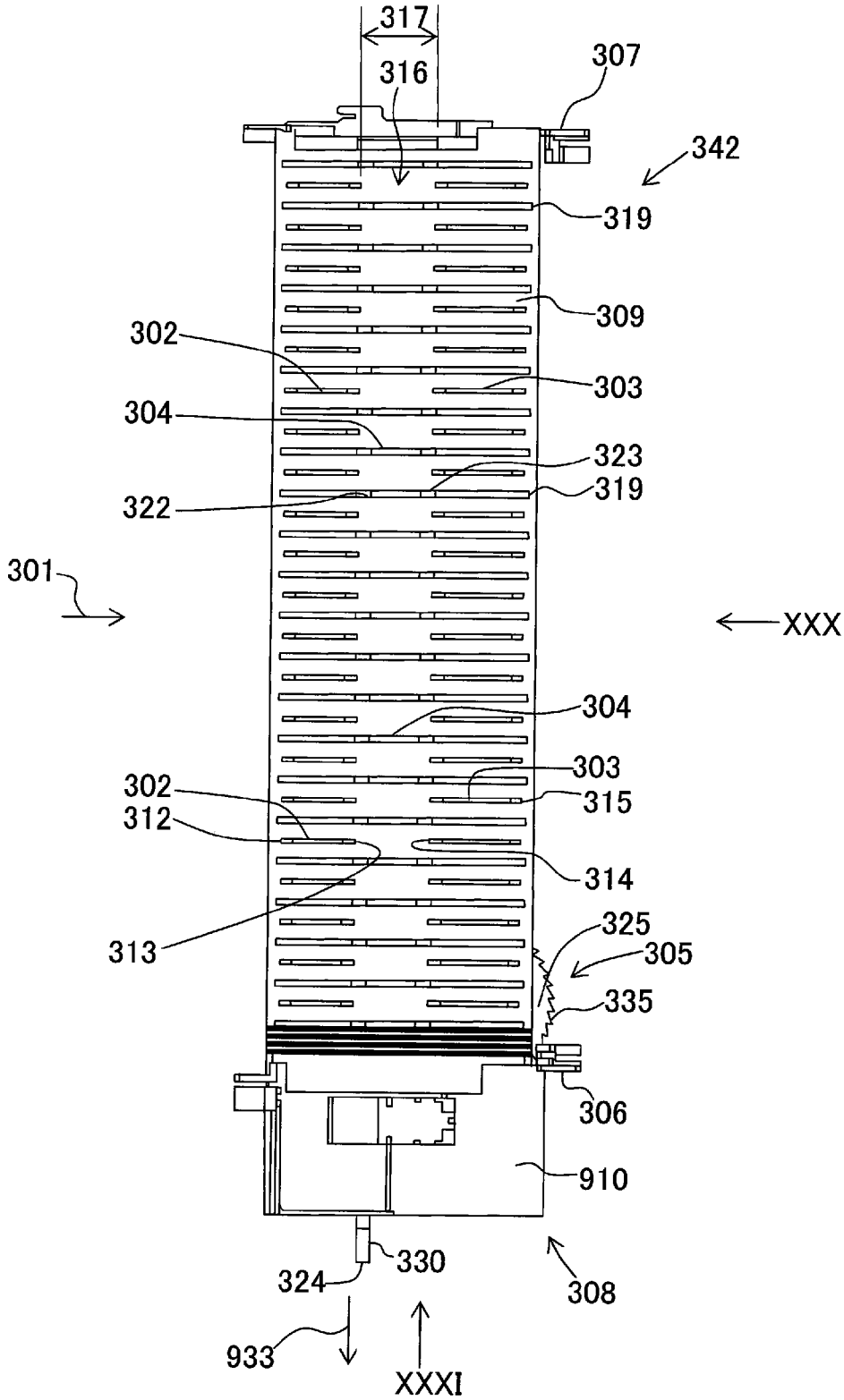
FIG. 29 shows a front view illustrating a platen of the multifunction machine according to the third embodiment of the present invention.
Figure 30:
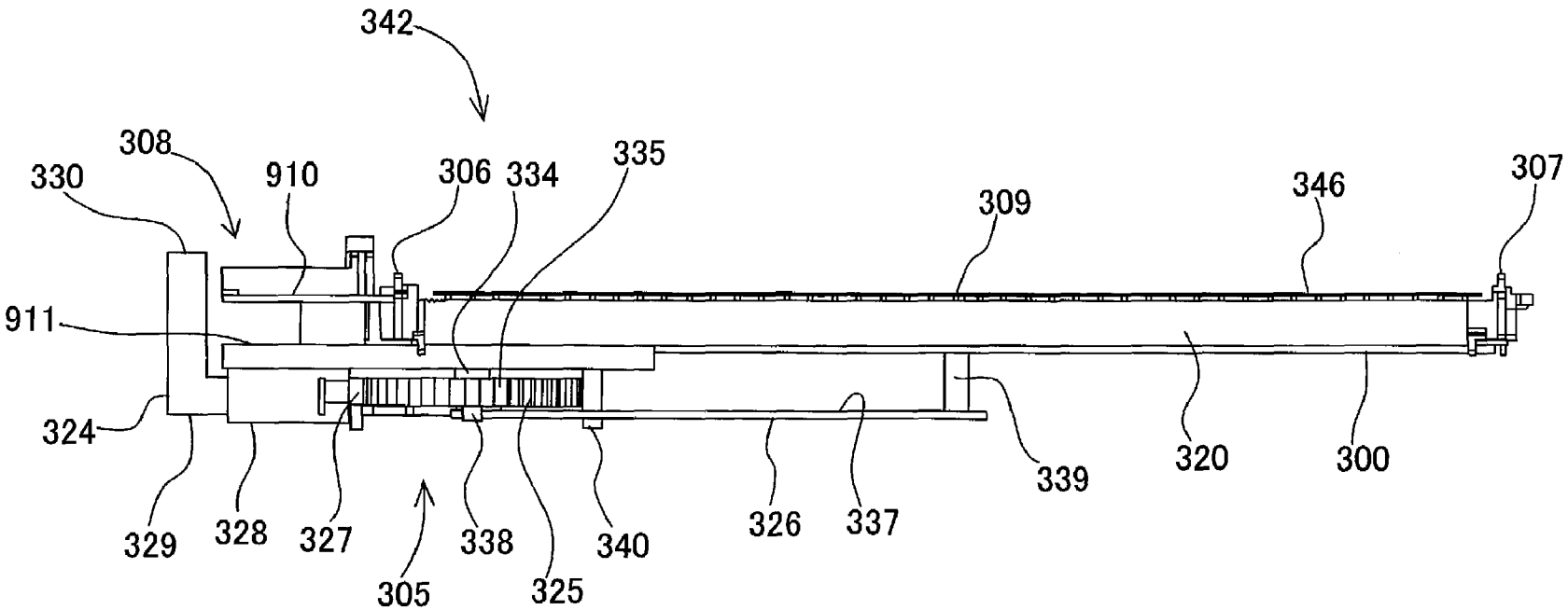
FIG. 30 shows a view as viewed in a direction of an arrow XXX shown in FIG. 29.
Figure 31:
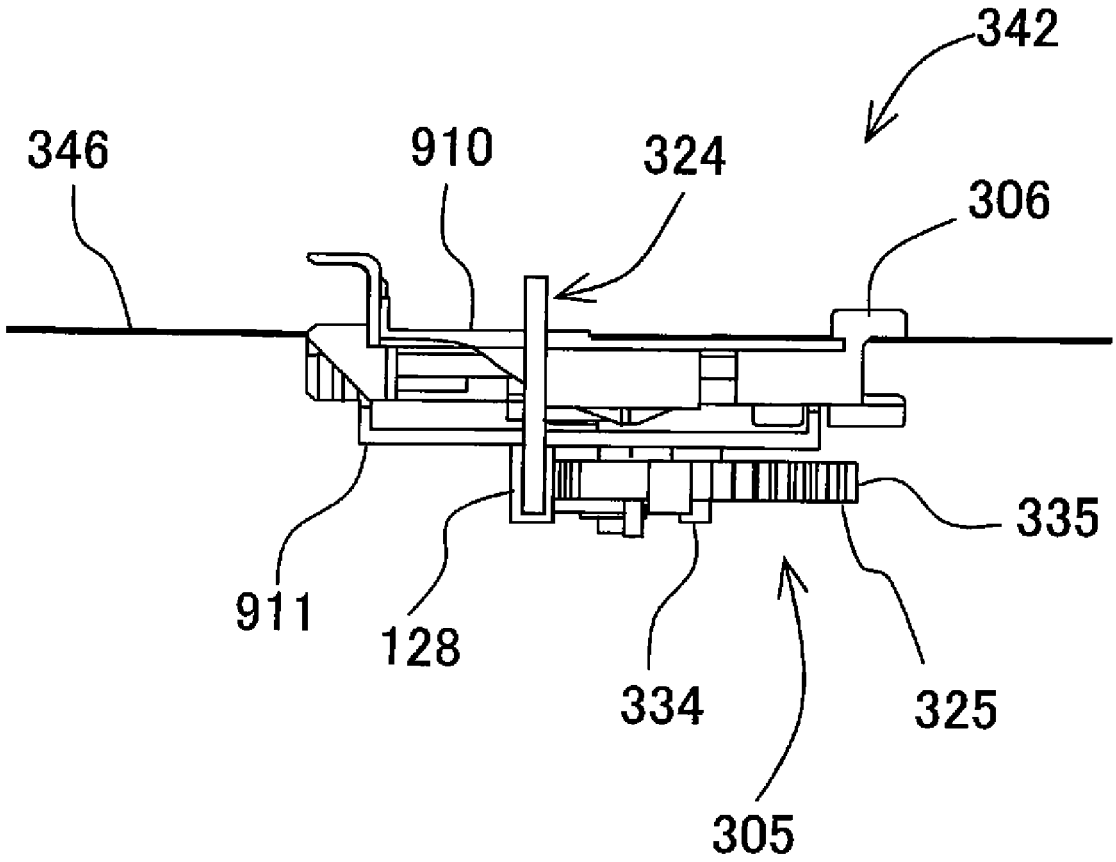
FIG. 31 shows a view as viewed in a direction of an arrow XXXI shown in FIG. 29.
Figure 32:
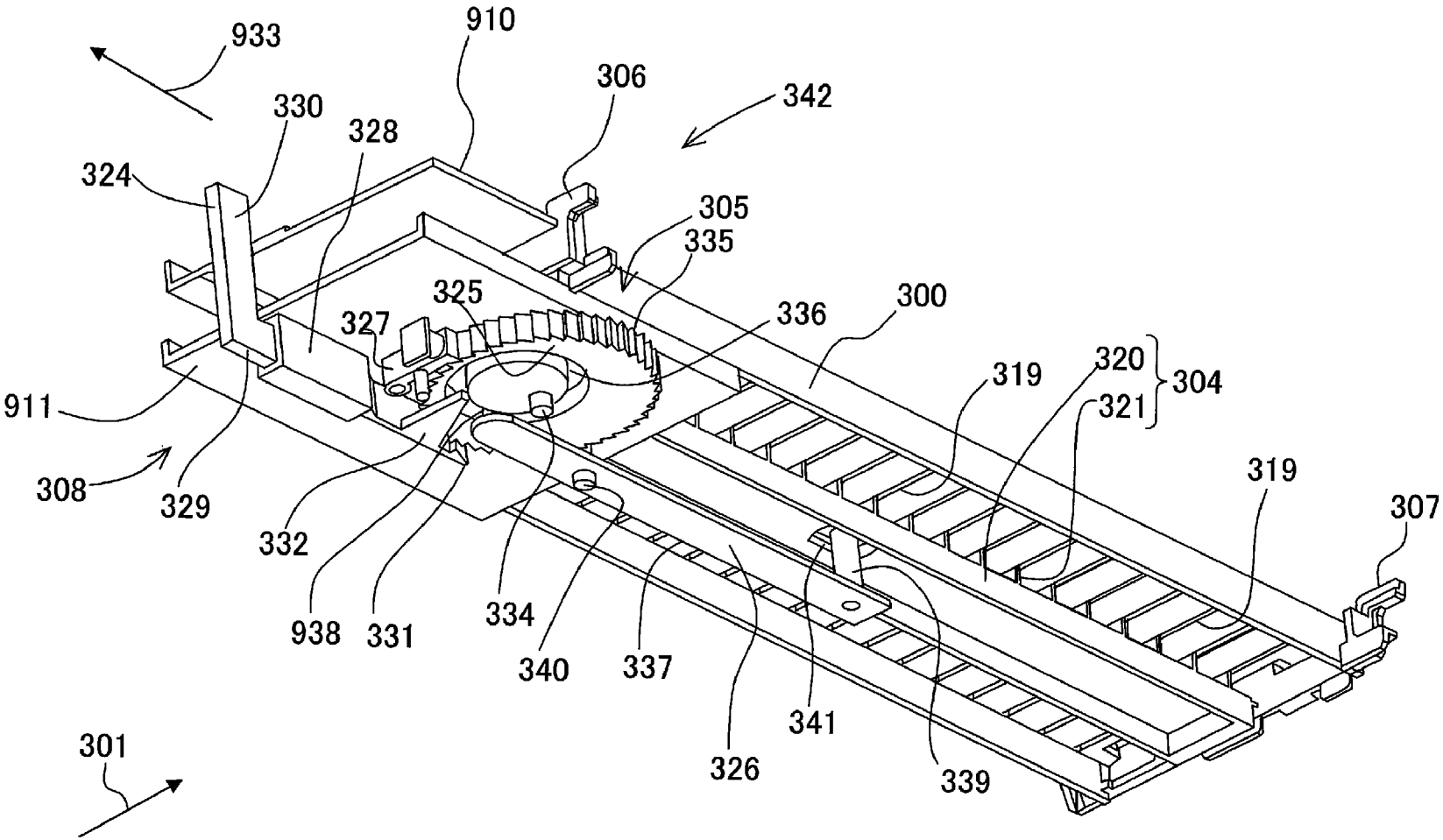
FIG. 32 shows a perspective view as viewed from a bottom surface side illustrating the platen of the multifunction machine according to the third embodiment of the present invention.
Figure 33:
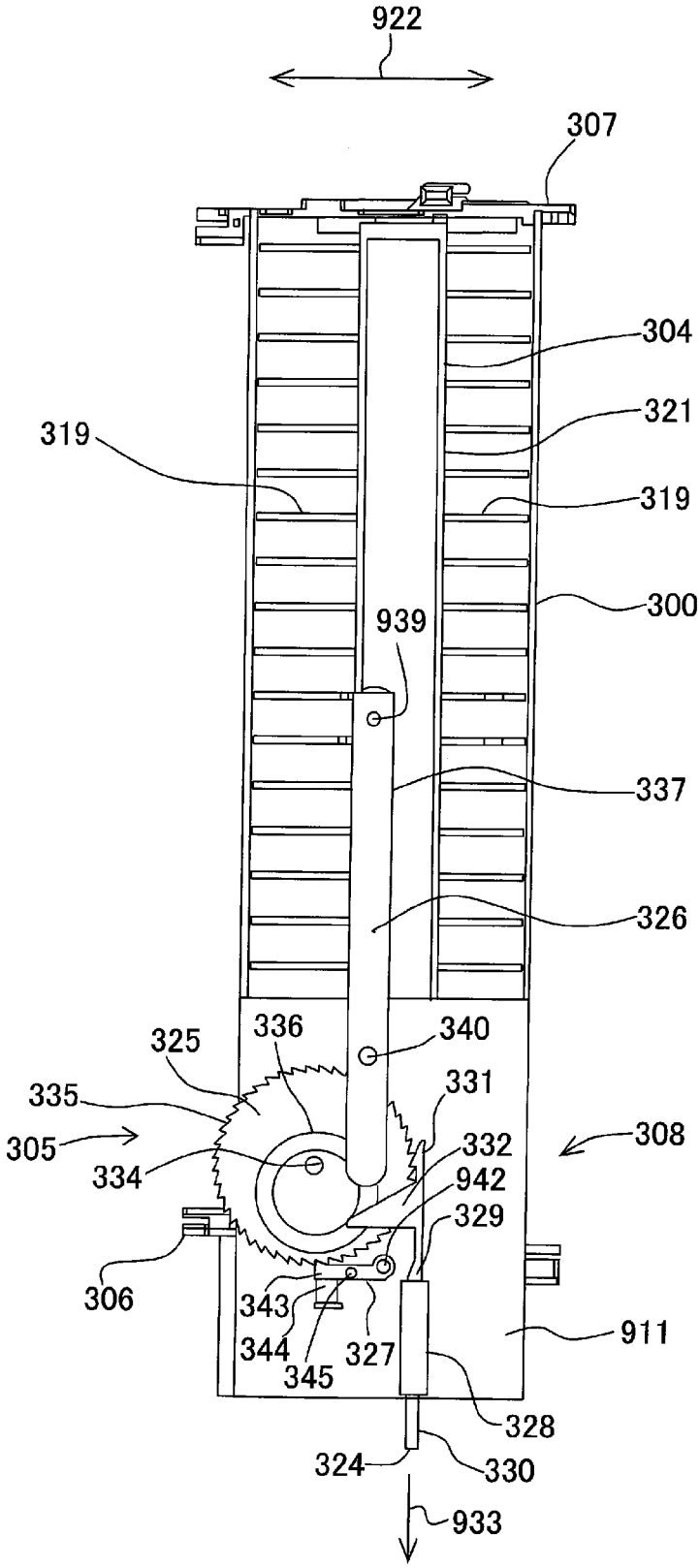
FIG. 33 shows a bottom view illustrating the multifunction machine according to the third embodiment of the present invention.

FIG. 28 shows a magnified perspective view illustrating main components shown in FIG. 27, which shows the magnified perspective view illustrating the platen 342. FIG. 29 shows a front view illustrating the platen 342. FIGS. 30 and 31 show views as viewed in directions of arrows XXX and XXXI shown in FIG. 29 respectively. FIG. 32 shows a perspective view as viewed from the bottom surface side of the platen 342. FIG. 33 shows a bottom view illustrating the platen 342.

As described above, the platen 342 is arranged opposingly to the ink-jet recording head 39 (at the lower position as shown in FIG. 3) to support the recording paper to be transported (see FIGS. 3 and 27). As shown in FIG. 28, the platen 342 has a thin-walled plate-shaped form which is slender and rectangular as a whole. The platen 342 is arranged so that the longitudinal direction thereof extends in the main scanning direction. In FIG. 28, the direction of the arrow 301 is the transport direction. The recording paper is transported in the direction of this arrow.

The platen 342 includes a frame 300, first fixed ribs 302 (first printing paper support section) and second fixed ribs 303 (second printing paper support section) which are provided on the frame 300, movable ribs 304 (movable support section) which are provided slidably for the frame 300, and a driving mechanism 305 (movable rib-driving mechanism) which drives the movable ribs 304 to slide as described later on.

The frame 300 is composed of, for example, synthetic resin or steel plate, which constitutes the skeleton of the platen 342. The frame 300 is formed to have a substantially C-shaped cross-sectional shape (so-called the channel form). Brackets 306, 307 are provided at the proximal end and the forward end of the frame 300 respectively. The brackets 306, 307 are formed integrally with the frame 300. The frame 300 is fastened and fixed to the multifunction machine 310 by the aid of the brackets 306, 307 (see FIGS. 3 and 27).

A driving mechanism attachment section 308 is provided at the proximal end of the frame 300. As shown in FIGS. 28 and 32, the driving mechanism attachment section 308 is provided to extend at the proximal end of the frame 300. The driving mechanism attachment section 308 includes an upper plate 910 which is provided on the side of the upper surface 309 of the frame 300, and a lower plate 911 which is provided on the side of the lower surface of the frame 300. Both of the upper plate 910 and the lower plate 911 are rectangular, which are formed integrally with the frame 300. The lower plate 911 supports the driving mechanism 305 as described in detail later on.

The first fixed ribs 302, the second fixed ribs 303, and slits 319 are provided on the upper surface 309 of the frame 300. As shown in FIG. 28, the first fixed ribs 302 and the second fixed ribs 330 are composed of rectangular thin-walled plate-shaped members, and they are provided upstandingly on the upper surface 309. The movable ribs 304 are fitted into the slits 319 to protrude upwardly from the slits 319.

Specifically, as shown in FIG. 32, the movable ribs 304 are provided with a base 320 which is formed to be box-shaped, and rectangular thin-walled plate-shaped members 321. The movable rib 304 may be composed of synthetic resin or metal. The base 320 is constructed as a channel member having a C-shaped cross section, which is fitted into the frame 300. Although not shown in FIG. 32, the base 320 is slidably supported by the frame 300 at the both ends in the main scanning direction. Therefore, the base 320 is smoothly slidable in the transport direction (direction of the arrow 922 shown in FIG. 33) at the inside of the frame 300.

The thin-walled plate-shaped members 321 are provided on the upper surface of the base 320. The thin-walled plate-shaped members 321 are formed integrally with the base 320. The thin-walled plate-shaped members 321 are rectangular, and they pass through the slits 319 to protrude upwardly from the upper surface 309 of the frame 300. A plurality of the thin-walled plate-shaped members 321 are provided on the upper surface of the base 320. Specifically, the plurality of thin-walled plate-shaped members 321 are provided and aligned at predetermined intervals or spacing distances in the main scanning direction on the upper surface of the base 320. The predetermined spacing distance corresponds to the pitch of the slits 319. Therefore, the plurality of thin-walled plate-shaped members 321 protrude upwardly from the respective slits 319.

Corner portions 322, 323 of the movable rib 304 are subjected to the chamfering processing in the same manner as the first fixed rib 302 and the second fixed rib 303, and thus a pair of inclined surfaces are formed. In this embodiment, the inclined surfaces are formed at the corner portions 322, 323 of the movable rib 304 disposed on the both sides in the transport direction. However, it is enough that the inclined surface is formed at least at the corner portion 322 disposed on the upstream side in the transport direction. The function and the effect, which are obtained by the chamfering processing applied to the corner portions 322, 323 of the movable rib 304 as described above, will be described later on.

The driving mechanism 305 is provided to allow the movable ribs 304 to slide in the transport direction. As shown in FIG. 32, the driving mechanism 305 includes an input member 324, a rotary plate 325, and a swinging member 326. This embodiment is further provided with an unillustrated spring member and a rotation-restricting member 327 to restrict the rotation of the rotary plate 325 as described later on. The spring member is constructed, for example, as a spiral spring, which is arranged between the upper plate 910 and the lower plate 911. The spring member is fixed to the upper plate 910 or the lower plate 911 and the rotary plate 325, and the spring member is deformed in accordance with the rotation of the rotary plate 325. Therefore, the spring member accumulates the strain energy depending on the angle of rotation when the rotary plate 325 is rotated in the predetermined direction. When the strain energy is released from the spring member, the rotary plate 325 is rotated in the opposite direction.

As shown in FIG. 32, the input member 324 is formed to be substantially L-shaped, which is provided with a first arm 329 and a second arm 330. The input member 324 is arranged outside the printing area in the main scanning direction (see FIG. 27). The input member 324 is retained by a retaining section 328 which is provided on the lower surface of the lower plate 911. The retaining section 328 is formed to have a cylindrical form with a rectangular cross section in this embodiment. The first arm 329 of the input member 324 is slidably inserted into the retaining section 328. As shown in FIGS. 32 and 33, an engaging pawl 331 is formed at the forward end of the first arm 329. Further, a restriction release arm 332 is provided on the proximal end side of the engaging pawl 331 (on the side of the second arm 330). The restriction release arm 332 releases the rotary plate 325 from the restriction of rotation as described later on. On the other hand, the second arm 330 is continued to the proximal end of the first arm 329, and the second arm 330 is perpendicular to the first arm 329. That is, as shown in FIG. 32, the second arm 330 extends upwardly by a predetermined distance from the upper plate 910 of the driving mechanism attachment section 308. When the recording head 39 is subjected to the sliding movement, the scanning carriage 38 presses the second arm 330 in the direction of the arrow 933 (in the main scanning direction). Although not shown in FIG. 32, an urging spring is arranged in the retaining section 328. The input member 324 is elastically urged by the elastic force of the urging spring in the direction opposite to the arrow 933. Therefore, when the scanning carriage 38 is separated from the input member 324 after the scanning carriage 38 presses the input member 324 in the direction of the arrow 933, the input member 324 is allowed to slide in the direction opposite to the arrow 933 by means of the urging spring.

The rotary plate 325 is formed to be disk-shaped. The rotary plate 325 is rotatably supported by a rotation center shaft 334. The rotation center shaft 334 is fixed to the frame 300 (specifically to the lower plate 911). The rotation center shaft 334 is inserted into the central portion of the rotary plate 325. A plurality of teeth 335 are continuously formed on the circumferential surface of the rotary plate 325. The teeth 335 are engaged with the engaging pawl 331 of the input member 324. Therefore, when the input member 324 is allowed to slide in the direction of the arrow 933 as described above, the rotary plate 325 is rotated in the rightward direction (see FIG. 33) about the center of the rotation center shaft 334. As described above, the input member 324 is elastically urged in the direction opposite to the direction of the arrow 933. Therefore, when the scanning carriage 38 is moved after the input member 324 is pressed in the direction of the arrow 933, the input member 324 is allowed to slide in the direction opposite to the direction of the arrow 933. Accordingly, the engaging pawl 331 is engaged with the teeth 335 again. Further, the rotary plate 325 is provided with a circular groove 336 (engaging section). The circular groove 336 is formed to be ring-shaped. The center of the circular groove 336 is different from the center of the rotary plate 325. That is, the circular groove 336 is eccentric with respect to the center of the rotary plate 325. The proximal end of the swinging member 326 is engaged with the circular groove 336.

The swinging member 326 includes a main body 337 which is composed of a slender flat plate, an engaging pin 938 which is provided at a proximal end of the main body 337, and an engaging rod 339 which is provided at a forward end. The swinging member 326 may be also composed of synthetic resin or metal. The main body 337 is rotatably supported by a swinging movement center shaft 340. The swinging movement center shaft 340 is fixed to the lower plate 911 of the driving mechanism attachment section 308. The swinging movement center shaft 340 is inserted into the central portion of the main body 337. The engaging pin 938 is provided to protrude upwardly from the main body 337 (see FIG. 32). The engaging pin 938 is fitted into the circular groove 336 of the rotary plate 325. The outer diametral dimension of the engaging pin 938 is adapted to the groove width dimension of the circular groove 336. The engaging pin 938 is capable of performing relative sliding movement without causing any backlash along the circular groove 336. When the engaging pin 938 is relatively moved along the circular groove 336 as described above, the main body 337 is rotated about the center of the swinging movement center shaft 340. That is, the swinging member 326 makes the swinging movement about the center of the swinging movement center shaft 340. Accordingly, the engaging rod 339, which is provided at the forward end of the main body 337, makes the sliding movement in a circular arc-shaped form about the center of the swinging movement center shaft 340. Further, the engaging rod 339 is connected to the base 320 of the movable ribs 304. However, the base 320 is provided with a slotted hole 341 which extends in the longitudinal direction (i.e., in the main scanning direction). The engaging rod 339 is fitted into the slotted hole 341. Further, the outer diametral dimension of the engaging rod 339 is adapted to the inner diametral dimension of the slotted hole 341. The engaging rod 339 does not cause any backlash in any direction other than the scanning direction with respect to the slotted hole 341.

Therefore, when the main body 337 makes the swinging movement as described above, and the engaging rod 339 is allowed to slide in the circular arc-shaped form about the center of the swinging movement center shaft 340, then the base 320 is moved in the transport direction, while the engaging rod 339 is allowed to slide in the main scanning direction along the slotted hole 341. As described above, the both ends of the base 320 in the main scanning direction are slidably supported by the frame 300. Therefore, the base 320 is allowed to smoothly slide in the transport direction (direction of the arrow 922 shown in FIG. 33) on the virtual surface which is parallel to the upper surface 309 at the inside of the frame 300. In other words, when the swinging member 326 makes the swinging movement, the movable ribs 304 are allowed to slide in the transport direction.

An engaging rod, which is engaged with the rotary plate 325, is adopted for the rotation-restricting member 327. As shown in FIG. 33, the rotation-restricting member 327 is rotatably supported by a support pin 942. The support pin 942 is provided upstandingly on the lower plate 911 of the driving mechanism attachment section 308, which is inserted into the proximal end portion of the rotation-restricting member 327. An engaging pawl 343 is formed at the forward end of the rotation-restricting member 327. The engaging pawl 343 is engaged with the teeth 335 of the rotary plate 325. Accordingly, with reference to FIG. 33, the rightward rotation is permitted but the leftward rotation is restricted for the rotary plate 325. The rotation-restricting member 327 is elastically urged toward the rotary plate 325 by a spring 344. Therefore, the rotation-restricting member 327 is engaged with the rotary plate 325 in the normal state, and the rotation of the rotary plate 325 is restricted as described above.

The rotation-restricting member 327 is provided with an abutment pin 345. The abutment pin 345 is provided to protrude on the rotation-restricting member 327, which extends downwardly (see FIG. 32). As described above, the input member 324 is allowed to slide in the direction of the arrow 933. When the input member 324 is allowed to slide to a predetermined restriction release position, the restriction release arm 332 abuts against the abutment pin 345 to press the abutment pin 345 in the direction of the arrow 933. Accordingly, the rotation-restricting member 327 is rotated against the elastic force of the spring 344, and the engaging pawl 343 is separated from the rotary plate 325. Accordingly, the rotary plate 325 is released from the restriction of the rotation.

In this embodiment, the engaging pin 938 of the swinging member 326 is engaged with the circular groove 336. The circular groove 336 is rotated about the center of the rotation center shaft 334 which supports the center of the rotary plate 325. That is, the circular groove 336, which is disposed eccentrically with respect to the rotation center shaft 334, is subjected to the swinging rotation about the center of the rotation center shaft 334. With reference to FIG. 33, the engaging pin 938 is engaged at the rightward position of the circular groove 336. In this situation, the movable ribs 304 are positioned at substantially central portions of the frame 300. As shown in FIG. 28, the movable ribs 304 are positioned between the first fixed ribs 302 and the second fixed ribs 303. The movable ribs 304 are arranged at these positions in the normal state.

With reference to FIG. 33, when the recording head 39 is reciprocatively moved in the main scanning direction, the input member 324 is intermittently pressed by the scanning carriage 38. Accordingly, the rotary plate 325 is intermittently rotated in the rightward direction by every predetermined angle of rotation (i.e., by every angle of rotation corresponding to the rotation feed amount brought about by the teeth 335). When the rotary plate 325 is rotated as described above, the circular groove 336 makes the swinging rotation about the center of the rotation center shaft 334. Therefore, the engaging pin 938, which is engaged with the circular groove 336, is moved in the leftward direction in accordance with the rotation of the rotary plate 325. When the angle of rotation of the rotary plate 325 arrives at 90° (degrees), then the engaging pin 938 begins to move in the rightward direction in accordance with the rotation of the rotary plate 325. The engaging pin 938 is moved in the rightward direction until the angle of rotation of the rotary plate 325 arrives at 270°.

FIGS. 34 and 35 schematically show the relationship between the transport of the recording paper and the movement of the movable ribs.

Figure 34A:
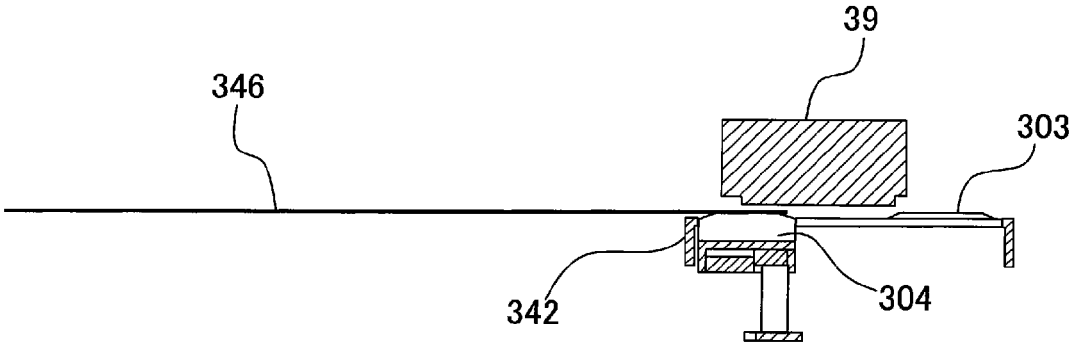
FIGS. 34A to 34C schematically show the relationship between the transport of the recording paper and the movement of movable ribs brought about by the multifunction machine according to the third embodiment of the present invention.

Further detailed description will be made below. In the initial state, the movable ribs 304 are positioned between the first fixed ribs 302 and the second fixed ribs 303 (initial positions). However, as shown in FIG. 34A, when the recording paper 346 is transported to the end on the upstream side in the transport direction of the frame 300 of the platen 342, the movable ribs 304 are moved to the upstream side in the transport direction to receive the recording paper 346. Specifically, as described above (see FIGS. 3 and 5), the recording paper 346 is fed along the transport passage 23, and the recording paper 346 is fed onto the platen 342 by the transport rollers 60 and the press rollers 361. Accordingly, as shown in FIGS. 32 and 33, the CR motor 73 is driven during the feed of the recording paper 346 along the transport passage 23, and the scanning carriage 38 is allowed to slide. Accordingly, the input member 324 is pressed. The rotary plate 325 is rotated in the rightward direction with reference to FIG. 33, and the movable ribs 304 are moved to the upstream side in the transport direction. When the angle of rotation of the rotary plate 325 arrives at 90°, the movable ribs 304 arrive at the first positions to receive the recording paper 346.

Figure 34B:
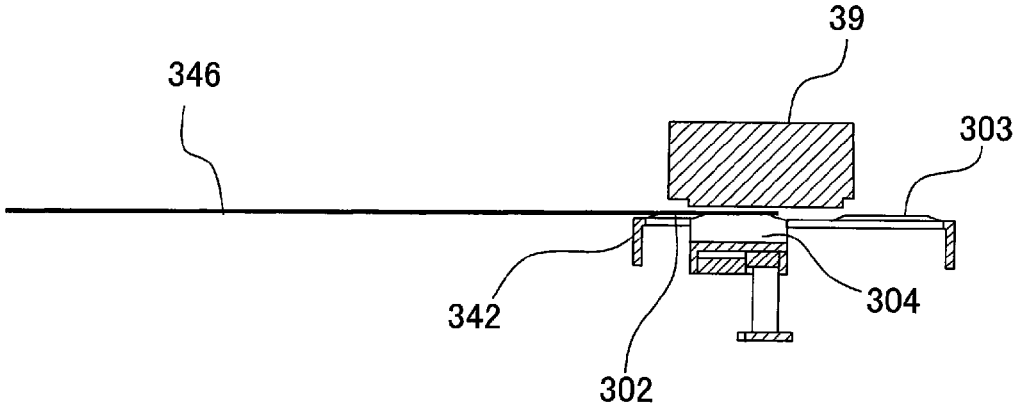
Figure 34C:
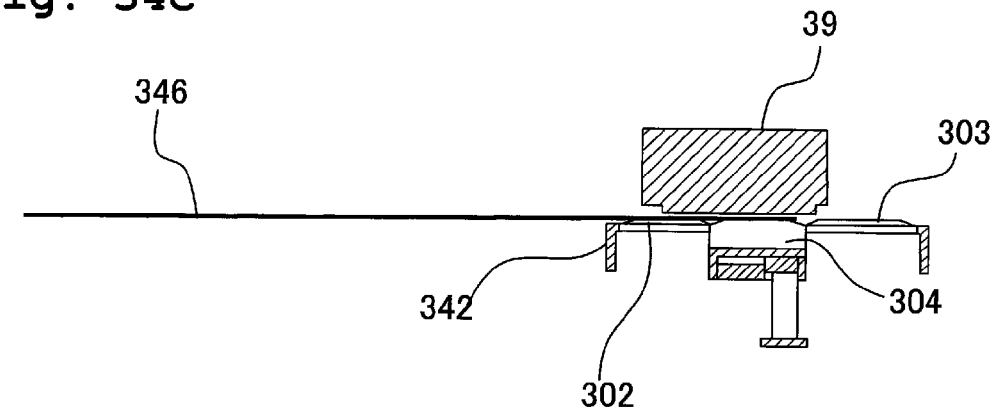

After that, the scanning carriage 38 is allowed to slide in accordance with the image recording, and the input member 324 is pressed. Accordingly, the rotary plate 325 is further rotated in the rightward direction with reference to FIG. 33. In this situation, the circular groove 336 is disposed eccentrically with respect to the rotation center shaft 334 as described above. Therefore, when the rotary plate 325 is further rotated in the rightward direction, the movable ribs 304 are moved to the downstream side in the transport direction while following the recording paper 346 to be supported, while supporting the forward end of the recording paper 346 as shown in FIG. 34B. When the angle of rotation of the rotary plate 325 arrives at 180°, the movable ribs 304 arrive at the initial positions (central portions of the groove 316) from the first positions as shown in FIG. 34C.

Figure 35A:
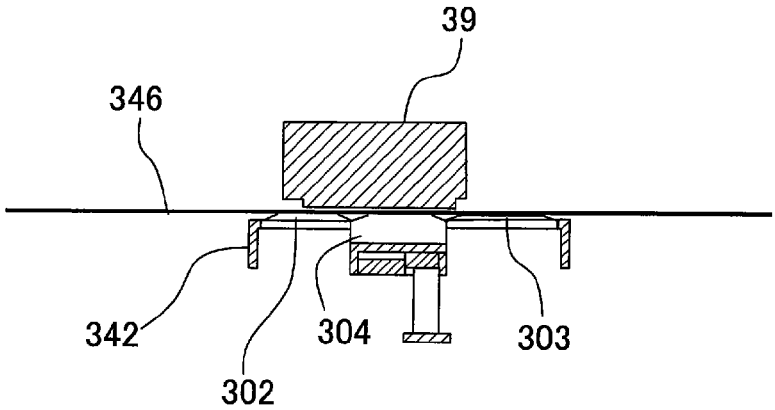
FIGS. 35A to 35C schematically show the relationship between the transport of the recording paper and the movement of the movable ribs brought about by the multifunction machine according to the third embodiment of the present invention.

When the angle of rotation of the rotary plate 325 arrives at 180°, and the movable ribs 304 are moved to the positions between the first fixed ribs 302 and the second fixed ribs 303, then the movable ribs 304 are retained at these positions. However, as shown in FIG. 35A, the image recording is performed while feeding the recording paper 346 in the transport direction. The following means is available to retain the movable ribs 304 while transporting the recording paper 346 as described above. That is, the slide distance of the recording head 39 may be controlled so that the scanning carriage 38, which retains the recording head 39, does not abut against the input member 324.

Figure 35B:
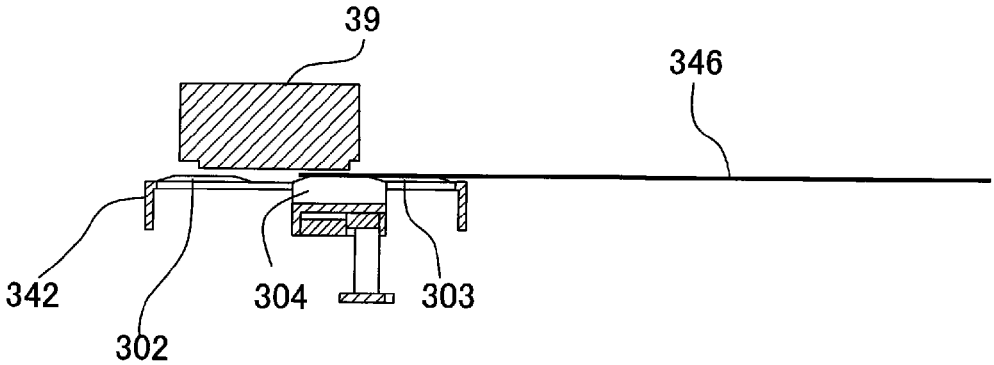
Figure 35C:
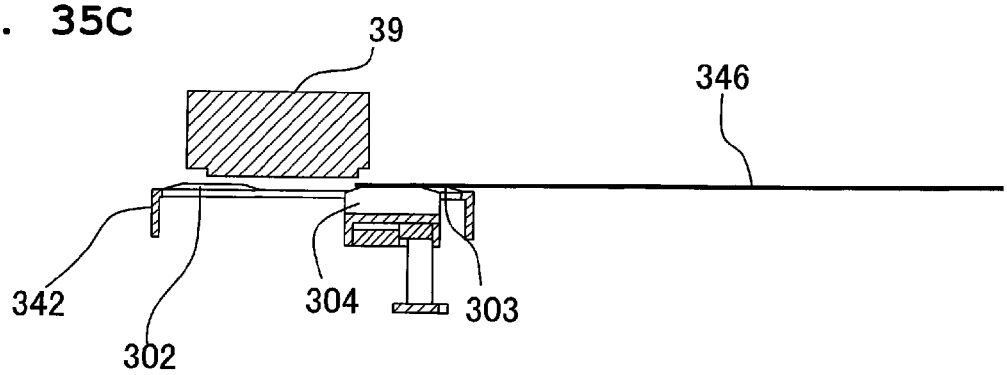

As shown in FIG. 35B, when the recording paper 346 is transported, and the backward end of the recording paper 346 is positioned on the movable ribs 304, then the movable ribs 304 are allowed to slide in the transport direction again. As shown in FIG. 35C, the movable ribs 304 are further moved to the downstream side in the transport direction while following the recording paper 346 while supporting the backward end of the recording paper 346. Specifically, the CR motor 73 (see FIG. 5) is driven, and the scanning carriage 38 is allowed to slide. Accordingly, the input member 324 is pressed, and the rotary plate 325 is rotated in the rightward direction with reference to FIG. 33. Thus, the movable ribs 304 are further moved to the downstream side in the transport direction. When the angle of rotation of the rotary plate 325 arrives at 270°, the movable ribs 304 arrive at the second positions. The following means is available to move the movable ribs 304 again, the movable ribs 304 being positioned between the first fixed ribs 302 and the second fixed ribs 303 (initial positions). That is, the slide distance of the recording head 39 may be controlled so that the scanning carriage 38, which retains the recording head 39, abuts against the input member 324 again.

When the recording paper 346 is discharged, the scanning carriage 38, which retains the recording head 39, allows the input member 324 to slide to the predetermined position (restriction release position). The sliding movement of the scanning carriage 38 is performed by controlling the driving of the CR motor described above (see FIG. 5). Specifically, as shown in FIG. 33, the input member 324 is allowed to slide in the direction of the arrow 933, and the restriction release arm 332 presses the abutment pin 942. Accordingly, the rotation-restricting member 327 is rotated in the leftward direction against the elastic force of the spring 344, and the rotary plate 325 is released from the restriction of rotation. The strain energy is accumulated in the spring member in accordance with the rotation of the rotary plate 325. Therefore, when the rotary plate 325 is released from the restriction of rotation, the strain energy is released. As a result, the rotary plate 325 is rotated in the opposite direction (leftward direction in FIG. 33). The strain energy, which is accumulated in the spring member, results from the rotation of the rotary plate 325. Therefore, when all of the strain energy is released, the rotary plate 325 is rotated by 270° in the leftward direction. That is, the movable ribs 304 are restored to the initial positions again.

In the multifunction machine 310 according to this embodiment, the recording paper 346, which is transported onto the platen 342, is supported by the platen 342. The image is recorded on the recording paper 346 by discharging the ink droplets while allowing the recording head 39 to slide in the main scanning direction. The recording paper 346 is further transported in the transport direction in accordance with the recording of the image. In this situation, as shown in FIGS. 34 and 35, the movable ribs 304 are subjected to the sliding movement (parallel displacement) in the transport direction while supporting the recording paper 346. That is, the end of the recording paper 346 is always supported by the movable ribs 304 during the image recording. Therefore, no warpage is caused in the transport direction. Even when the groove 316 is formed between the first fixed ribs 302 and the second fixed ribs 303 as in this embodiment, the recording paper 346 does not fall toward the groove 316. The constant distance is maintained between the recording paper 346 and the recording head 39. As a result, the high image quality printing is realized.

Specifically, the recording paper 346, which is transported onto the platen 342, is firstly supported by the first fixed ribs 302. Further, the recording paper 346 passes over the groove 316, and the recording paper 346 is fed toward the second fixed ribs 303. The groove 316 can receive the ink droplets discharged from the recording head 39 while exceeding the edge of the recording paper 346 especially when the borderless recording is performed. Accordingly, the back side of the recording paper 346 is prevented from any adhesion of the ink. When the recording paper 346 passes over the groove 316, the movable ribs 304 are allowed to slide in the transport direction while following the recording paper 346 to be transported. That is, the movable ribs 304 support the recording paper 346 while making the sliding movement from the first positions to the second positions. Therefore, the end of the recording paper 346 is always supported by the movable ribs 304 reliably. The end of the recording paper 346 does not enter the groove 316.

Additionally, the width of the groove 316 may be set to be large, because the recording paper 346 is supported by the movable ribs 304. Accordingly, it is possible to allow the recording head 39 to have a large size. Further, even when the recording head 39 is large-sized, the groove 316 can cover the entire ink discharge area 118 of the recording head 39. As a result, an advantage is obtained such that the high speed borderless recording is realized as well.

In particular, the members for supporting the recording paper 346 are the ribs. Therefore, an advantage is obtained such that the members for supporting the recording paper 346 have the extremely simple structure. Further, the recording paper 346 can be transported smoothly, because the contact area is decreased between the recording paper 346 and the first fixed ribs 302, the second fixed ribs 303, and the movable ribs 304.

In this embodiment, the width of the groove 316 is set to be wider than the ink discharge area 118 of the recording head 39 (see FIG. 6). Accordingly, even if the ink droplets are discharged from all of the nozzles (ink discharge ports 53) of the recording head 39 when the recording paper 346 is not arranged on the platen 342, then all of the ink droplets are received by the groove 316. The movable member is not wetted, because the movable member is positioned under the paper. Therefore, when the borderless recording is performed, the image can be recorded on the end of the recording paper 346, while the ink droplets are discharged from all of the nozzles of the recording head 39. That is, the borderless recording is performed at the high velocity. Further, any complicated control is not required in relation to the discharge of the ink droplets from the ink discharge ports 53. Further, in addition to the fact that the cross-sectional shape of the ink discharge port 53 is not necessarily a perfect circle, any minute dust adheres to the inside of the ink discharge port 53 in some cases. Therefore, the ink droplets are sometimes discharged in slightly oblique directions without being discharged straight from the ink discharge ports 53. Even in such situations, the ink droplets are not adhered to the outside of the groove 316, because the width of the groove 316 is set to be wider than the ink discharge area 118 of the recording head 39. As a result, the back surface of the recording paper 346 is reliably prevented from being dirtied by the ink.

Further, in this embodiment, the chamfering processing is applied to the corner portions 322, 323 of the movable ribs 304 (see FIG. 28). The inclined surfaces are formed at the corner portions 322, 323. Accordingly, even when the end of the recording paper 346 having passed over the first fixed ribs 302 abuts against the corner portions 322 of the movable ribs 304, the end of the recording paper 346 is smoothly guided to the upper surfaces of the movable ribs 304. Therefore, the smooth transport of the recording paper 346 is not inhibited by the provision of the movable ribs 304. Similarly, the chamfering processing is also applied to the respective corner portions 312 to 315 of the first fixed ribs 302 and the second fixed ribs 303, and these portions are constructed as the inclined surfaces. Therefore, even when the recording paper 346 abuts against the corner portions 312 to 315 during the transport, the smooth transport of the recording paper 346 is not inhibited.

In this embodiment, the driving mechanism 305 is provided as described above. Accordingly, as shown in FIGS. 34 and 35, when the recording paper 346 is transported to the platen 342, then the movable ribs 304 are once moved to the upstream side in the transport direction to receive the recording paper 346, and then the movable ribs 304 are allowed to slide to the downstream side in the transport direction while supporting the end of the recording paper 346 in accordance with the transport of the recording paper 346. Accordingly, the following advantage is obtained. That is, the end of the recording paper 346 is reliably supported by the movable ribs 304, and the end of the recording paper 364 is reliably prevented from any invasion into the groove 316 during the transport.

Further, the driving mechanism 305 is operated such that the scanning carriage 38, which is subjected to the sliding movement by the CR motor 73 (see FIG. 5), allows the input member 324 to slide as described above, and the sliding movement of the input member 324 is converted into the sliding movement of the movable ribs 304 by the aid of the rotary plate 325 and the swinging member 326. That is, an advantage is obtained such that the correct transport of the recording paper 346 is not inhibited, because the LF motor 71 is not the direct driving source of the movable ribs 304. In this embodiment, the driving source of the movable ribs 304 is the CR motor 73. However, the CR motor 73 effects the pressing action on the input member 324 in the area disposed outside the scanning range of the scanning carriage 38 (i.e., the area disposed outside the image recording range). Therefore, the correct transport of the recording paper 346 is secured within the image recording range. However, it is a matter of course that the CR motor 73 or the LF motor 71 may be adopted as the direct driving source of the movable ribs 304, on condition that the correct transport of the recording paper 346 is secured.

Additionally, in this embodiment, the rotation of the rotary plate 325 is restricted by the rotation-restricting member 327. In this embodiment, as shown in FIGS. 32 and 33, the input member 324 and the rotation-restricting member 327 constitute a ratchet mechanism which rotates the rotary plate 325 in only the rightward direction as viewed in FIG. 33. Therefore, every time when the recording head 39 makes the reciprocating motion, the rotary plate 325 is rotated in the rightward direction, and the movable ribs 304 are reliably moved in the direction as described above to support the recording paper 346. In this arrangement, the sliding movement of the recording head 39 is controlled by the control unit 64 to effect the following adjustment. That is, the rotary plate 325 may be rotated every time when the recording head 39 makes the reciprocating movement once. Alternatively, the rotary plate 325 may be rotated every time when the recording head 39 makes the reciprocating movement a plurality of times.

The spring member is arranged between the upper plate 910 and the lower plate 911 as described above. Therefore, the spring member is strained in accordance with the rotation of the rotary plate 325, and the strain energy is accumulated depending on the angle of rotation of the rotary plate 325. However, the input member 324 is allowed to slide to the restriction release position, because the sliding movement of the recording head 39 is controlled by the control unit 64. Accordingly, the rotary plate 325 is released from the restriction of rotation, and the free rotation of the rotary plate 325 is permitted. That is, the strain energy, which is accumulated in the spring member, is released, and thus the rotary plate 325 is rotated in the leftward direction. As a result, the movable ribs 304 are restored to the initial positions (positions shown in FIG. 28). As described above, the means for restoring the movable ribs 304 to the initial positions has the extremely simple structure without utilizing the CR motor 73 and the LF motor 71. Therefore, an advantage is obtained such that the correct transport of the recording paper 346 is not inhibited.

The movement of the movable ribs 304 as described above is especially required when the borderless recording is performed on the recording paper 346. However, when the borderless recording is not performed, the movement of the movable ribs 304 is unnecessary. As described above, the movable ribs 304 wait at the positions shown in FIG. 28 in the normal state. Therefore, when the borderless recording is not performed, the movable ribs 304 may be fixed at the positions shown in FIG. 28 without being driven. In this situation, the following means is available to fix the movable ribs 304. That is, the sliding movement of the recording head 39 may be adjusted by the control unit 64. That is, it is enough that the CR motor 73 is driven so that the scanning carriage 38 makes no contact with the input member 324.

Fourth Embodiment

Next, a fourth embodiment of the present invention will be explained. A multifunction machine 410 according to this embodiment will be explained below with reference to FIGS. 36 to 43. Those other than portions of the multifunction machine 410 explained below are basically the same as those of the multifunction machine explained in the third embodiment, any explanation of which will be omitted.

Figure 36:
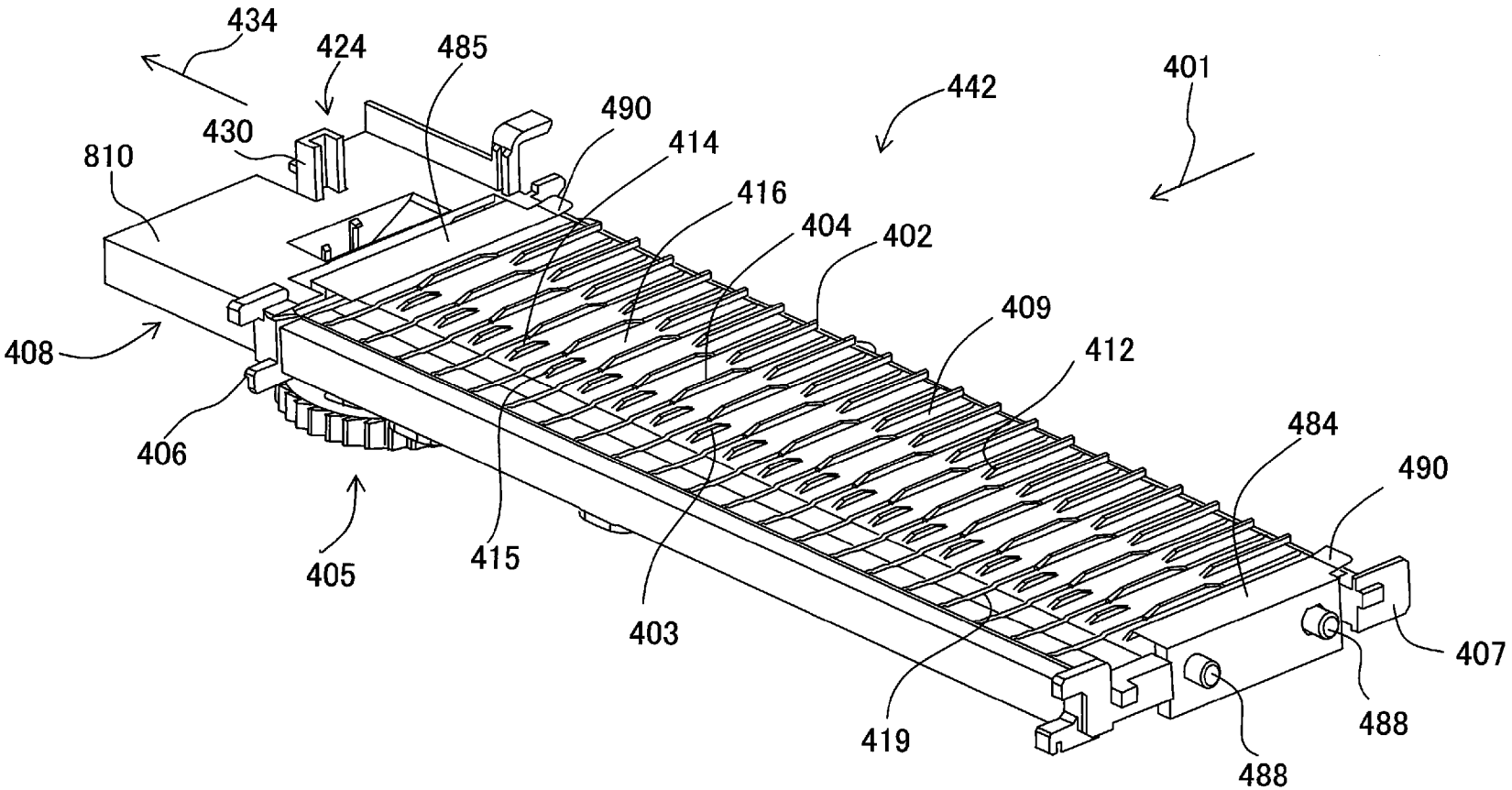
FIG. 36 shows a magnified perspective view illustrating main components shown in FIG. 27.
Figure 37:
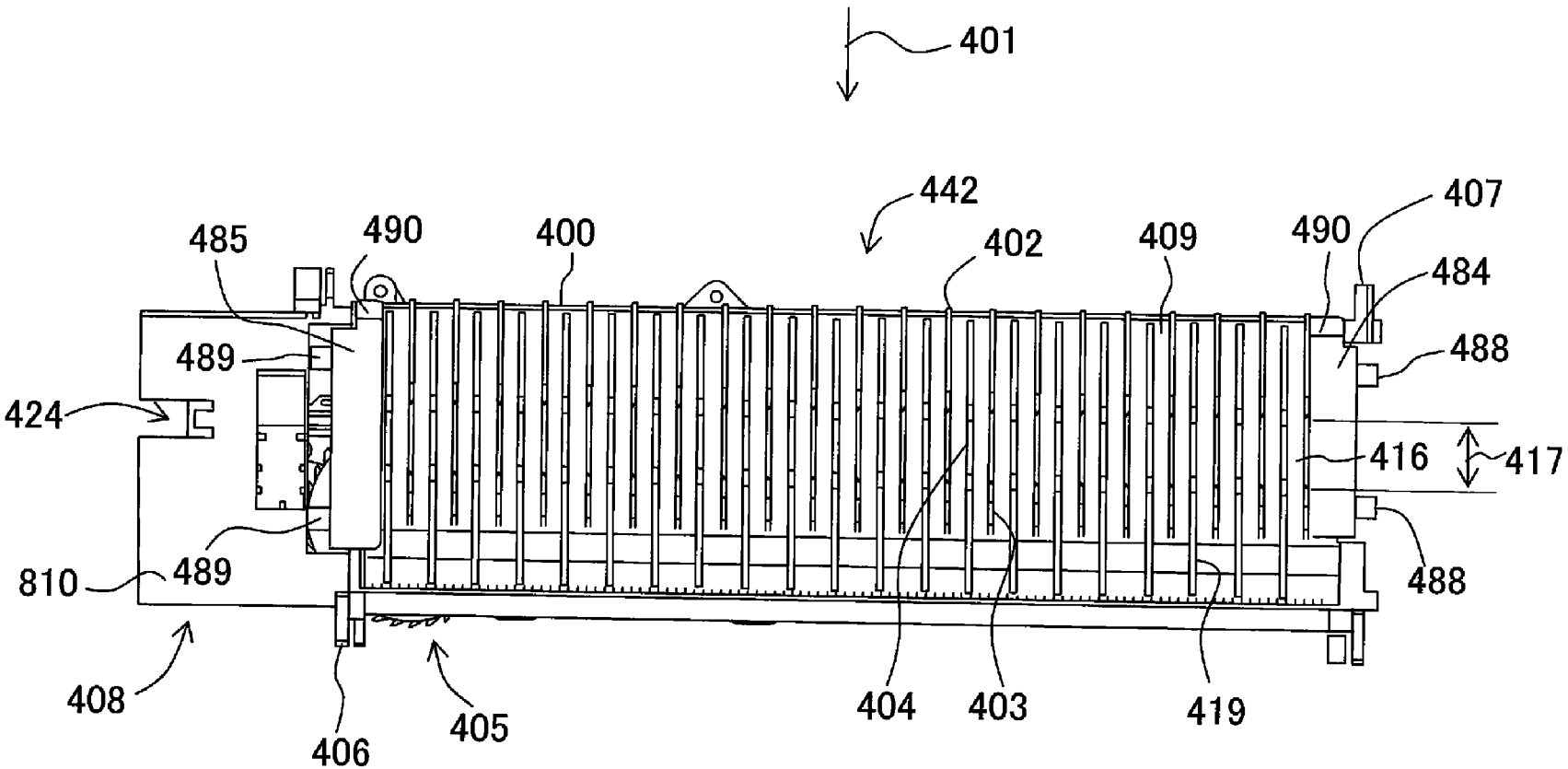
FIG. 37 shows a plan view illustrating a platen of a multifunction machine according to a fourth embodiment of the present invention.
Figure 38:
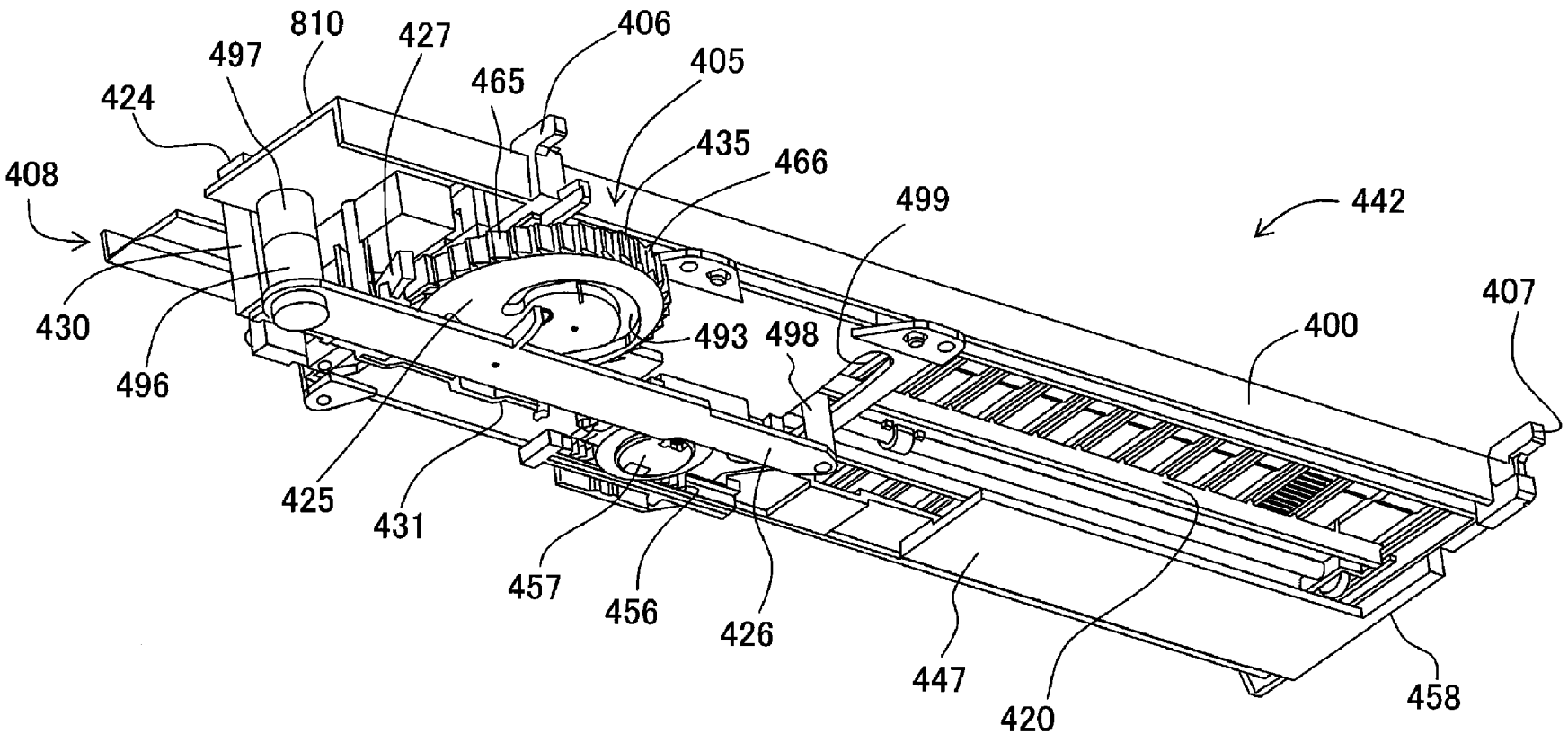
FIG. 38 shows a perspective view as viewed from a bottom surface side illustrating the platen of the multifunction machine according to the fourth embodiment of the present invention.
Figure 39:
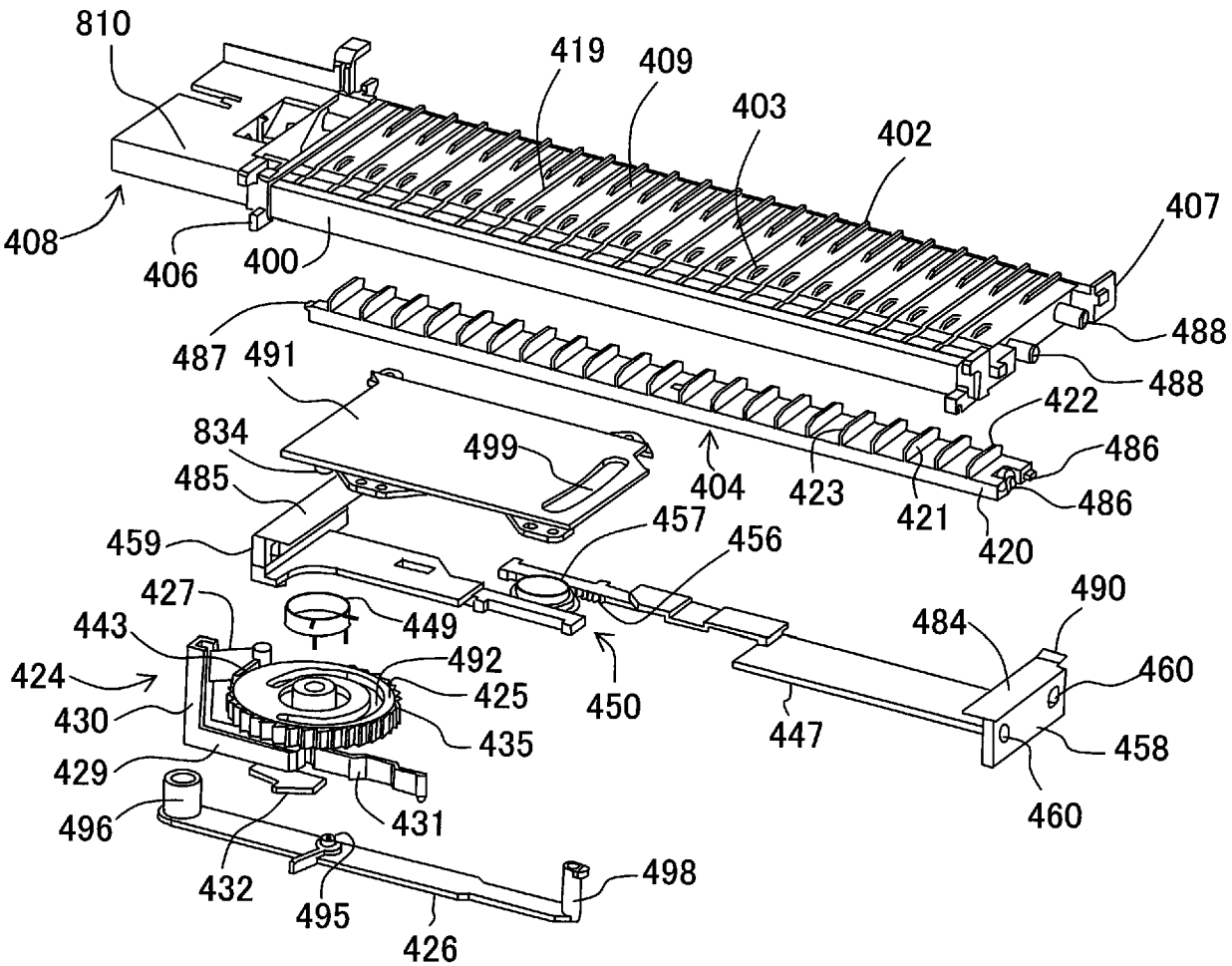
FIG. 39 shows an exploded perspective view illustrating the platen of the multifunction machine according to the fourth embodiment of the present invention.
Figure 40:
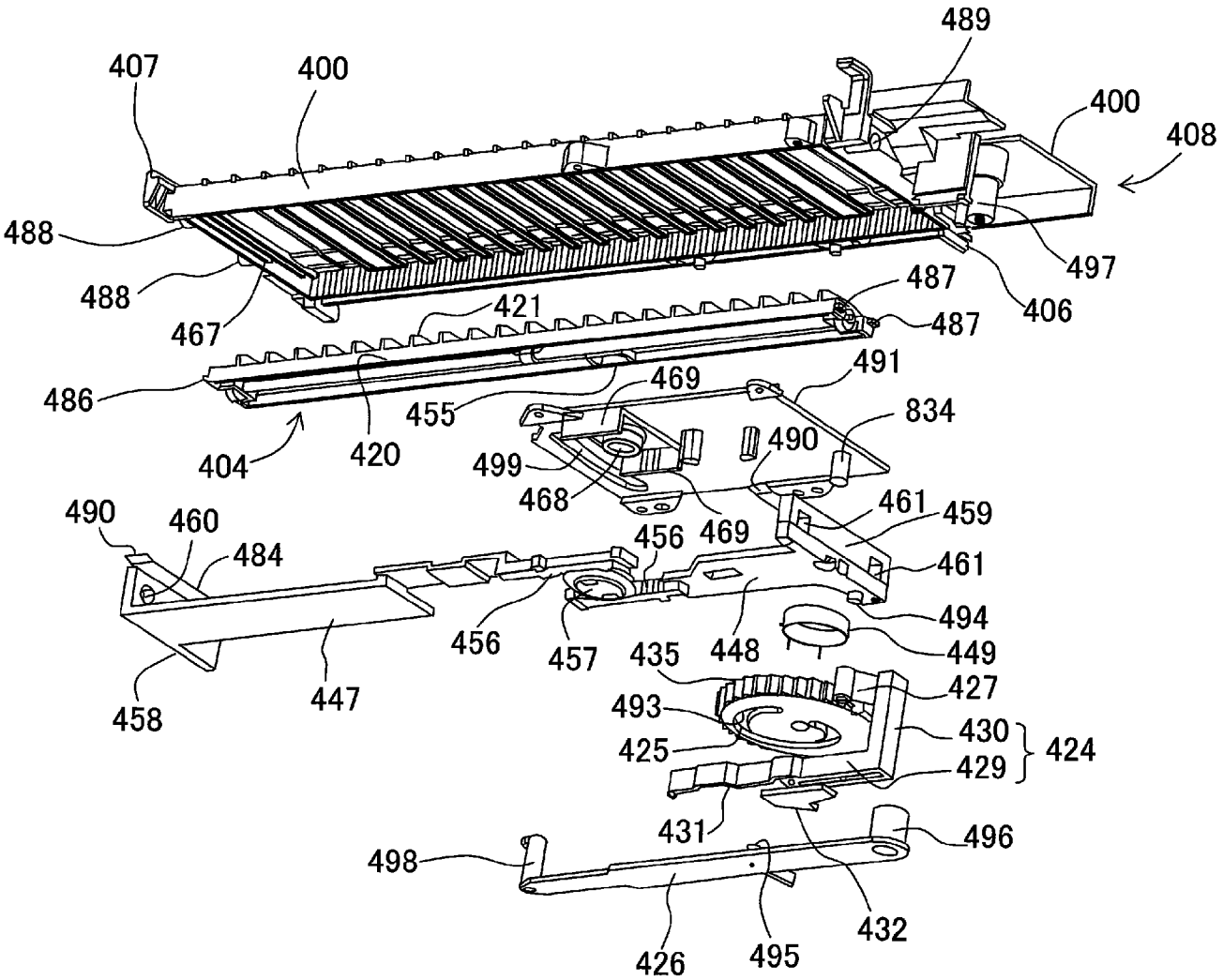
FIG. 40 shows an exploded perspective view illustrating the platen of the multifunction machine according to the fourth embodiment of the present invention.

FIG. 36 shows a magnified perspective view illustrating a platen 442 of the multifunction machine 410 according to this embodiment. FIG. 37 shows a plan view illustrating the platen 442. FIG. 38 shows a perspective view as viewed from the bottom surface side of the platen 442. FIGS. 39 and 40 show exploded perspective views illustrating the platen 442.

The platen 442 is arranged under a recording head 439 while being opposed to the recording head 439. The recording paper to be transported is placed on the upper surface 409 of the platen 442. As shown in FIG. 36, the platen 442 has a thin-walled plate-shaped form which is slender and rectangular as a whole. The platen 442 is arranged so that the longitudinal direction thereof extends in the main scanning direction. In FIG. 36, the direction of the arrow 401 is the transport direction. The recording paper is transported in the direction of the arrow 401.

The platen 442 includes a frame 400, first fixed ribs 402 and second fixed ribs 403 which are provided on the frame 400, movable ribs 404 which are provided slidably for the frame 400, a pair of restricting members 484, 485 which are arranged at the both ends of the platen 442, and a driving mechanism 405 (retracting mechanism) which allows the movable ribs 404 to slide as described later on and which retracts the restricting members 484, 485 as described later on.

The frame 400 is composed of, for example, synthetic resin or steel plate, which constitutes the skeleton of the platen 442. The frame 400 is formed to have a substantially C-shaped cross-sectional shape (so-called the channel type). Brackets 406, 407 are provided at the proximal end and the forward end of the frame 400 respectively. The brackets 406, 407 are formed integrally with the frame 400. The frame 400 is fastened and fixed to the frame of the multifunction machine 410 by the aid of the brackets 406, 407.

A driving mechanism attachment section 408 is provided for the frame 400. As shown in FIGS. 36 to 38, the driving mechanism attachment section 408 is provided to extend from the frame 400. The driving mechanism attachment section 408 includes an attachment plate 810 which is provided continuously to the upper surface 409 of the frame 400. The attachment plate 810 is rectangular, which is formed integrally with the frame 400. The attachment plate 810 supports the driving mechanism 405. The driving mechanism 405 will be described in detail later on.

The first fixed ribs 402 and the second fixed ribs 403 are provided on the upper surface 409 of the frame 400 in the same manner as in the third embodiment. However, in this embodiment, only one corner portion 412 of each of the first fixed ribs 402 is chamfered. The length of the second fixed rib is shorter than that of the first fixed rib.

As shown in FIGS. 39 and 40, projections 488, 489 are provided on the both end surfaces of the frame 400, i.e., on the end surfaces in the main scanning direction. The projections 488, 489 are formed integrally with the frame 400. The projections 488, 489 are fitted to a sliding member 447 and a sliding member 448 respectively as described later on. Therefore, the sliding members 447, 448 are capable of smoothly making the sliding movement in the scanning direction along the projections 488, 489. The restricting members 484, 485 are attached to the sliding members 447, 448, which make the sliding movement together with the sliding members 447, 448.

As shown in FIGS. 36 to 38, a plurality of slits 419 are provided through the upper surface 409 of the frame 400. The slits 419 extend in the transport direction of the recording paper. That is, the slits 419 are provided through the upper surface 409, which extend from the end on the upstream side to the end on the downstream side in the transport direction of the recording paper. The respective slits 419 are formed to make the penetration between the mutually adjoining first fixed ribs 402 and between the mutually adjoining second fixed ribs 403. The movable ribs 404 are fitted into the slits 419, and they protrude upwardly from the slits 419, i.e., toward the recording head 39.

Specifically, as shown in FIG. 39, the movable ribs 404 are provided with a base 420 which is formed to be box-shaped, and rectangular thin-walled plate-shaped members 421. The movable rib 404 may be composed of synthetic resin or metal. The base 420 is a member having a C-shaped cross section, which is fitted into the frame 400. Both ends 486, 487 of the base 420 in the main scanning direction are slidably supported by the frame 400. Specifically, the both ends 486, 487 of the base 420 are composed of engaging plates which are provided to protrude outwardly. The both ends 486, 487 are fitted into engaging grooves 467 (see FIG. 40) provided inside the frame 400. Therefore, the base 420 is smoothly slidable in the transport direction at the inside of the frame 400.

The thin-walled plate-shaped members 421 are provided on the upper surface of the base 420. The thin-walled plate-shaped members 421 are formed integrally with the base 420. The thin-walled plate-shaped members 421 are rectangular, and they pass through the slits 419 to protrude upwardly from the upper surface 409 of the frame 400. In this embodiment, a plurality of the thin-walled plate-shaped members 421 are provided on the upper surface of the base 420. Specifically, the respective thin-walled plate-shaped members 421 are provided and aligned at predetermined spacing distances or intervals in the main scanning direction on the upper surface of the base 420. The predetermined spacing distance corresponds to the pitch of the slits 419. Therefore, the plurality of thin-walled plate-shaped members 421 protrude upwardly from the respective slits 419.

Corner portions 422, 423 of the thin-walled plate-shaped members 421 are subjected to the chamfering processing in the same manner as the first fixed rib 402 and the second fixed rib 403, and thus a pair of inclined surfaces are formed. In this embodiment, the inclined surfaces are formed at the corner portions 422, 423 of the movable rib 404 disposed on the both sides in the transport direction. However, it is enough that the inclined surface is formed at least at the corner portion 422 disposed on the upstream side in the transport direction. The function and the effect, which are obtained by the chamfering processing applied to the corner portions 422, 423 of the movable rib 404, will be described later on.

As shown in FIG. 36, the restricting members 484, 485 are arranged at the both ends of the frame 400 in the main scanning direction. The respective restricting members 484, 485 have an identical shape, which are composed of, for example, stainless steel plates. Each of the restricting members 484, 485 is composed of the slender flat plate which extends in the transport direction. The respective restricting members 484, 485 are arranged between the upper surface 409 of the frame 400 and the lower surface 441 of the recording head 39 (see FIG. 6). The gap between the upper surface 409 and each of the restricting members 484, 485 is set to be about 1.4 mm. The distance (distance in the main scanning direction) between the restricting member 484 and the restricting member 485 corresponds to the regular paper of the A4 size. When the recording paper of this size is transported onto the upper surface 409, the edges of the recording paper in the transport direction are overlapped with the restricting members 484, 485. The overlap dimension is set to be about 1.5 mm, which corresponds to the dimension of the area in which the printing is not performed when the bordered recording is performed on the recording paper, i.e., the blank space or margin. The recording head 39 is allowed to slide in the main scanning direction along the groove 416 so that the recording head 39 traverses central portions of the restricting members 484, 485, i.e., over the groove 416. Forward ends 490 of the restricting members 484, 485, i.e., the portions disposed on the upstream side in the transport direction as compared with the area of the sliding movement of the recording head 39 are bent obliquely upwardly. Therefore, the forward ends 490 rise upwardly as compared with the position of the lower surface 441 of the recording head 39. The function and the effect, which are obtained by providing the restricting members 484, 485 as described above, will be described later on.

The driving mechanism 405 is provided in order that the movable ribs 404 are allowed to slide in the transport direction as described above and the restricting members 484, 485 are moved in the main scanning direction to retract them from the positions over the upper surface 409 of the platen 442. As shown in FIGS. 39 and 40, the driving mechanism 405 includes an input member 424, a rotary plate 425, a swinging member 426, and sliding members 447, 448. In this embodiment, there are further provided a rotation-restricting member 427 which restricts the rotation of the rotary plate 425 as described later on, a spiral spring 449 (spring member) which is connected to the rotary plate 425, and a partition wall member 491 which supports the base 420 and which positions the base 420 in the frame 400. The spiral spring 449 is deformed in accordance with the rotation of the rotary plate 425. The spring member accumulates the strain energy depending on the angle of rotation when the rotary plate 425 is rotated in a predetermined direction, i.e., in the counterclockwise direction with reference to FIG. 39. Therefore, when the strain energy is released from the spiral spring 449, the rotary plate 425 is rotated in a direction opposite to the predetermined direction, i.e., in the clockwise direction with reference to FIG. 39.

The input member 424 is formed to be substantially L-shaped, which is provided with a first arm 429 and a second arm 430. The input member 424 is arranged outside the printing area in the main scanning direction (see FIG. 5). The input member 424 is supported by the attachment plate 810 (see FIG. 36). Accordingly, the input member 424 is capable of making the sliding movement in the direction of the arrow 434 shown in FIG. 36. As shown in FIG. 39, an engaging pawl 431 is formed at the forward end of the first arm 429. The engaging pawl 431 is formed to be thin-walled plate-shaped, which extends in the longitudinal direction of the first arm 429. The engaging pawl 431 is elastically deformable in the direction perpendicular to the longitudinal direction, i.e., in the wall thickness direction. Further, a restriction release arm 432 is provided on the proximal end side of the engaging pawl 431. The free rotation of the rotary plate 425 is restricted by the rotation-restricting member 427. However, the restriction release arm 432 releases the rotary plate 425 from the restriction of rotation as described later on.

On the other hand, the second arm 430 is continued to the proximal end of the first arm 429, and the second arm 430 is perpendicular to the first arm 429. That is, as shown in FIG. 36, the second arm 430 extends upwardly by a predetermined distance from the attachment plate 810 of the driving mechanism attachment section 408. When the recording head 39 is subjected to the sliding movement, the scanning carriage 38 presses the second arm 430 in the direction of the arrow 434 (in the main scanning direction). An unillustrated elastic member is connected to the input member 424. Accordingly, the input member 424 is always elastically urged in the direction opposite to the arrow 434. Therefore, when the scanning carriage 38 is separated from the input member 424 after the scanning carriage 38 presses the input member 424 in the direction of the arrow 434, the input member 424 is restored in the direction opposite to the arrow 434 by means of the elastic member.

Figure 41:
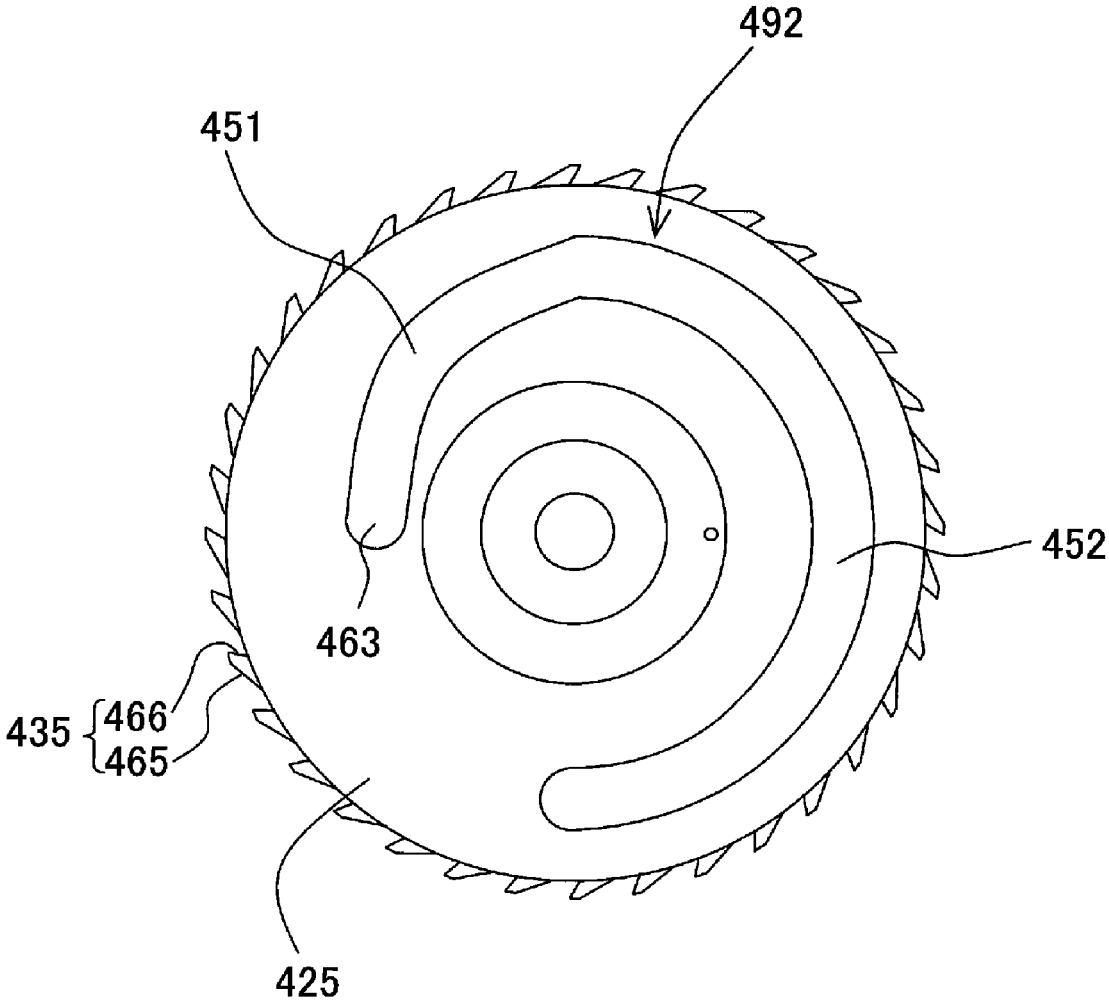
FIG. 41 shows a plan view illustrating a rotary plate of the platen of the multifunction machine according to the fourth embodiment of the present invention.
Figure 42:
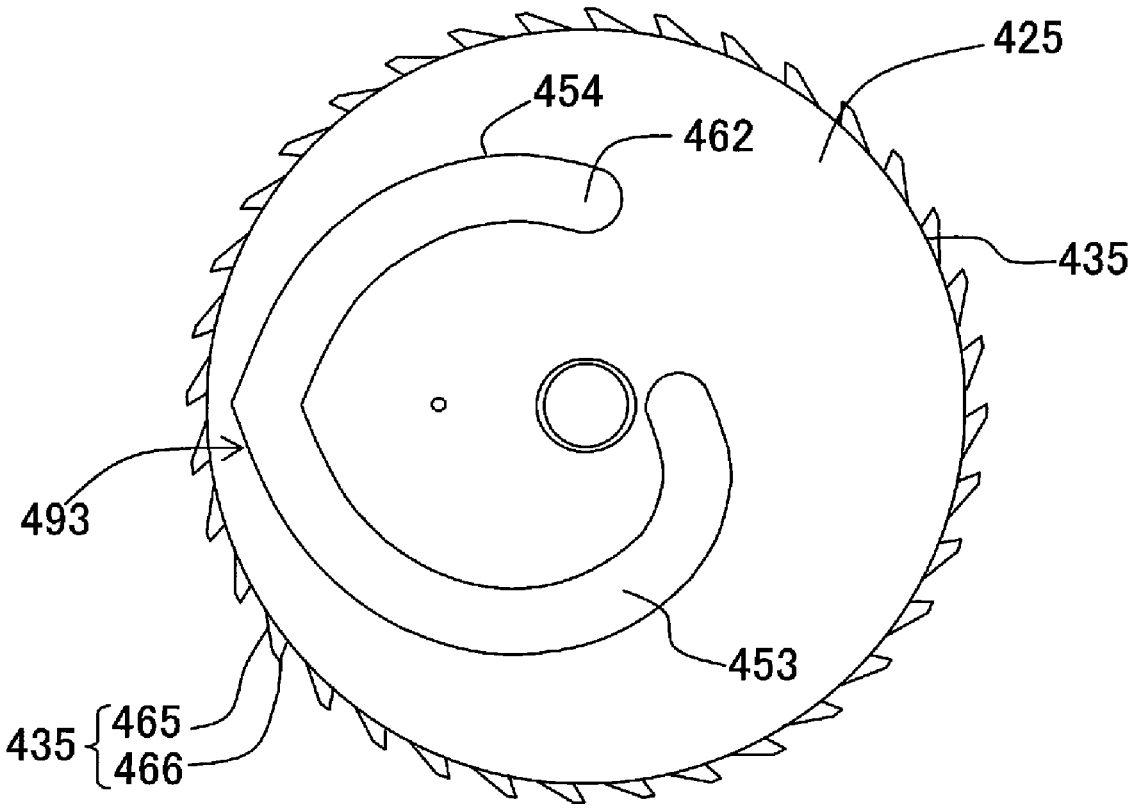
FIG. 42 shows a bottom view illustrating the platen of the multifunction machine according to the fourth embodiment of the present invention.

FIG. 41 shows a plan view illustrating the rotary plate 425, and FIG. 42 shows a bottom view illustrating the rotary plate 425.

The rotary plate 425 is formed to be disk-shaped. As shown in FIG. 40, a rotation center shaft 834 is provided to protrude on the lower surface of the partition wall member 491. The rotary plate 425 is fitted into the rotation center shaft 834, and it is rotatably supported thereby. In this embodiment, the rotation center shaft 834 is fitted to the center of the rotary plate 425. A plurality of teeth 435 are continuously formed on the circumferential surface of the rotary plate 425. The teeth 435 are engaged with the engaging pawl 431 of the input member 424. As shown in FIG. 40, the engaging pawl 431 is engaged with the teeth 435 of the rotary plate 425 disposed on the front side. As shown in FIGS. 38 and 42, the tooth 435 includes a guide surface 465 which extends outwardly while being inclined in the direction opposite to the direction of rotation from the circumferential surface of the rotary plate 425, and a restricting surface 466 which extends from the forward end of the guide surface 465 inwardly in the radial direction of the rotary plate 425. The engaging pawl 431 abuts against the restricting surface 466. Therefore, when the input member 424 is allowed to slide in the direction of the arrow 434 (see FIG. 36) as described above, the engaging pawl 431 pulls the restricting surface 466. Accordingly, as shown in FIG. 39, the rotary plate 425 is rotated in the counterclockwise direction about the center of the rotation center shaft 434. The input member 424 is elastically urged in the direction opposite to the direction of the arrow 434 as described above. Therefore, when the scanning carriage 38 is moved after the input member 424 is pressed in the direction of the arrow 434, the input member 424 is allowed to slide in the direction opposite to the direction of the arrow 434. Accordingly, the engaging pawl 431 makes the sliding movement on the guide surface 465 while being elastically deformed. When the engaging pawl 431 abuts against the restricting surface 466 of the teeth 435 adjacent to the restricting surface 466, the engaging pawl 431 is restored from the elastic deformation. After that, when the input member 424 is further allowed to slide, the rotary plate 425 is intermittently rotated.

As shown in FIGS. 39 and 40, an engaging groove 492 is provided on the surface of the rotary plate 425. The engaging groove 492 is formed to have a curved shape, which includes a curvature change section 451 in which the curvature is progressively changed, and a circular arc section 452 which is continued thereto. The sliding member 448 is engaged with the engaging groove 492. Specifically, a pin 494 (see FIG. 40), which is provided to protrude on the sliding member 448, is fitted to the engaging groove 492. The pin 494 is slidable along the engaging groove 492. Therefore, when the rotary plate 425 is rotated, the pin 494 makes approach and separation with respect to the center of the rotary plate 425.

As shown in FIGS. 40 and 42, an engaging groove 493 is provided on the back surface of the rotary plate 425. The engaging groove 493 is also formed to have a curved shape. The engaging groove 493 includes a first curvature change section 453 in which the radius of curvature from the center of the rotary plate 425 is progressively increased, and a second curvature change section 454 which is continued thereto and in which the radius of curvature is progressively decreased. The central portion of the swinging member 426 is engaged with the engaging groove 493. Specifically, a pin 495 (see FIG. 39), which is provided to protrude on the central portion of the swinging member 426, is fitted into the engaging groove 493. The pin 495 is slidable along the engaging groove 493. Therefore, when the rotary plate 425 is rotated, the pin 495 makes approach and separation with respect to the center of the rotary plate 425.

A proximal end 496 of the swinging member 426 is rotatably connected to a swinging movement center shaft 497 provided on the attachment plate 810. A forward end 498 of the swinging member 426 penetrates through the partition wall member 491, and the forward end 498 is connected to a bearing section 455 of the base 420 (see FIG. 40). The bearing section 455 extends in the longitudinal direction of the base 420, which permits the sliding movement of the base 420 in the longitudinal direction while retaining the forward end 498 of the swinging member 426. The partition wall member 491 is provided with a circular arc-shaped slotted hole 499 through which the forward end 498 penetrates. Therefore, even when the rotary plate 425 is rotated, and the swinging member 426 makes the swinging movement about the center of the swinging movement center shaft 497, then the swinging member 426 moves the base 420 without causing any interference with the partition wall member 491. The base 420 is slidable in the transport direction along the frame 400 as described above. Therefore, when the swinging member 426 makes the swinging movement, the base 420 is allowed to slide in the transport direction along the frame 400 while following the swinging movement of the swinging member 426. In other words, the movable ribs 404 are allowed to slide in the transport direction.

As shown in FIG. 40, the pin 494 of the sliding member 448 is fitted into the engaging groove 492. Therefore, when the rotary plate 425 is rotated, the pin 494 is moved in the direction to make separation from the other sliding member 447. In this embodiment, a rack and pinion mechanism 450 is provided between the sliding members 447, 448 which are arranged opposingly. Specifically, racks 456 are formed on the sliding member 447 and the sliding member 448 respectively. The racks 456 are arranged opposingly. A pinion gear 457 is arranged to make engagement with the respective racks 456. The pinion gear 457 is fitted and retained in a rotatable state by a gear-retaining section 468 which is provided to protrude on the lower surface of the partition wall member 491. A pair of guide plates 469 are provided on the partition wall member 491. The portions of the sliding members 447, 448, at which the racks 456 are formed, are supported by the guide plates 469, and the sliding movement is effected while being guided by the guide plates 469. Therefore, when the sliding member 448 makes approach or separation with respect to the sliding member 447, the sliding member 447 is also allowed to slide toward the sliding member 448 by the aid of the rack and pinion mechanism 450. In other words, the both make approach to one another and separation from each other.

An end 458 of the sliding member 447 and an end 459 of the sliding member 448 are bent upwardly. Each of the ends 458, 459 is formed to be flat plate-shaped. The end 458 is provided with through-holes 460, and the end 459 is provided with through-holes 461. The projections 488, which are provided for the frame 400, are fitted into the through-holes 460 of the end 458. The projections 489, which are provided for the frame 400, are fitted into the through-holes 461 of the end 459. Therefore, the sliding members 447, 448 are arranged to hold the frame 400 in the main scanning direction. The upper ends of the respective ends 458, 459 are positioned upwardly as compared with the upper surface 409 of the frame 400. The restricting members 484, 485 are fixed to the upper ends of the ends 458, 459 respectively. Therefore, when the sliding members 447, 448 make mutual approach and separation, the restricting members 484, 485 also make mutual approach and separation over the frame 400. That is, when the restricting members 484, 485 make approach to one another, they are overlapped with the edges of the recording paper to be transported (edges in the transport direction). On the other hand, when the restricting members 484, 485 make separation from each other, they are retracted from the frame 400 so that the overlap is not caused.

As shown in FIGS. 39 and 40, the rotation-restricting member 427 is a plate-shaped member to make engagement with the rotary plate 425. The rotation-restricting member 427 is rotatably supported by an unillustrated support pin. An engaging pawl 443 is formed at the forward end of the rotation-restricting member 427. The engaging pawl 443 is engaged with the teeth 435 of the rotary plate 425. Accordingly, with reference to FIG. 39, the rotary plate 425 is permitted for the rotation in the counterclockwise direction, but the rotary plate 425 is restricted for the rotation in the clockwise direction. The rotation-restricting member 427 is elastically urged toward the rotary plate 425. Therefore, the engaging pawl 443 is engaged with the rotary plate 425 in the normal state, and the rotary plate 425 always undergoes the restriction of rotation as described above.

As described above, the input member 424 is allowed to slide in the direction of the arrow 434 (see FIG. 36). However, when the input member 424 is allowed to slide to a predetermined restriction release position, the restriction release arm 432 abuts against the rotation-restricting member 427 to effect the pressing action in the direction of the arrow 434. Accordingly, the engaging pawl 443 of the rotation-restricting member 427 is separated from the rotary plate 425. As a result, the rotary plate 425 is released from the restriction of rotation.

In this embodiment, the pin 495 of the swinging member 426 is engaged with the engaging groove 493 (see FIG. 40). The engaging groove 493 is rotated about the center of the rotation center shaft 834 which supports the center of the rotary plate 425. That is, the engaging groove 493, which is disposed eccentrically with respect to the rotation center shaft 834, is rotated about the center of the rotation center shaft 834. Usually, the pin 495 is set so that the pin 495 is positioned at the end 462 of the first curvature change section 453 of the engaging groove 493 with reference to FIG. 42. In this situation, the movable ribs 404 are positioned at the substantially central portions of the frame 400. As shown in FIG. 36, the movable ribs 404 are positioned between the first fixed ribs 402 and the second fixed ribs 403. The pin 494 of the sliding member 448 is engaged with the engaging groove 492 (see FIG. 39). The engaging groove 492 is rotated about the center of the rotation center shaft 834. That is, the engaging groove 492, which is disposed eccentrically with respect to the rotation center shaft 834, is rotated about the center of the rotation center shaft 834. Usually, the pin 494 is set so that the pin 494 is positioned at the end 463 of the curvature change section 451 of the engaging groove 492 with reference to FIG. 41. In this situation, the sliding members 447, 448 make approach to one another. Therefore, as shown in FIG. 36, the restricting members 484, 485 are overlapped with the upper surface 409 of the frame 400.

The arrangement of the control unit 64 of the multifunction machine 410 of this embodiment is equivalent to the arrangement shown in FIG. 8 in relation to the first embodiment.

In the multifunction machine 410 according to this embodiment, the mode of the image recording is selected by operating the operation panel 20. That is, the so-called bordered recording and the borderless recording can be arbitrarily selected by operating the operation panel 20 by a user. When the recording mode is set with the operation panel 20, the signal, which instructs the recording mode, is transmitted from ASIC 70 to CPU 65. CPU 65 receives the signal to give the instruction to the driving circuit 74 and the driving circuit 75 in order to drive the CR motor 73 and the recording head 39. Specifically, when the setting of the borderless recording is made, the CR motor 73 is driven so that the scanning carriage 38 presses the input member 424.

As shown in FIG. 26, the control unit 64 is composed of a main board 982. For example, the recording signal is transmitted from the main board 982 to the recording head 39 via a flat cable 83. The flat cable 83 has a thin band-shaped form in which a conductor to transmit the electric signal is insulated by covering the conductor with a synthetic resin film such as a polyester film. The flat cable 83 electrically connects the main board 982 and the control board (not shown) of the recording head 39. The flat cable 83 is led from the scanning carriage 38 in the direction of the reciprocating movement, and it is bent to have a substantially U-shaped form in the vertical direction. The substantially U-shaped portion is not fixed to any other member, in which the posture is changed while following the reciprocating movement of the scanning carriage 38.

When the recording mode is set to the borderless recording in the multifunction machine 410 of this embodiment, then the recording head 39 is subjected to the reciprocating movement in the main scanning direction, and the input member 424 is pressed intermittently or continuously by the scanning carriage 38 (see FIG. 36). Accordingly, as shown in FIG. 39, the rotary plate 425 is rotated intermittently in the counterclockwise direction by every predetermined angle of rotation, i.e., by every angle of rotation corresponding to the rotary feed amount brought about by the teeth 435. When the rotary plate 425 is rotated as described above, the engaging groove 493 is rotated about the center of the rotation center shaft 834 as shown in FIG. 40. Therefore, the pin 495, which is engaged with the engaging groove 493, is moved outwardly in the radial direction in accordance with the rotation of the rotary plate 425 (see FIG. 42). When the angle of rotation of the rotary plate 425 arrives at 90° (degrees), then the engaging pin 495 begins to move in the opposite direction (inwardly in the radial direction) in accordance with the rotation of the rotary plate 425. The engaging pin 495 is moved in the same direction until the angle of rotation of the rotary plate 425 arrives at 270°. As shown in FIG. 40, when the rotary plate 425 is rotated, the engaging groove 492 is rotated about the center of the rotation center shaft 834. Therefore, the pin 494, which is engaged with the engaging groove 492, is moved outwardly in the radial direction in accordance with the rotation of the rotary plate 425 (see FIG. 41). Even when the angle of rotation of the rotary plate 425 exceeds 90°, the engaging pin 494 is not moved in the radial direction irrelevant to the rotation of the rotary plate 425, because the radius of curvature of the circular arc section 452 of the engaging groove 492 is constant.

FIG. 43 shows the movement of the movable ribs 404 and the restricting members 484, 485 during the transport of the recording paper in an order of FIGS. 43A to 43D.

Figure 43A:
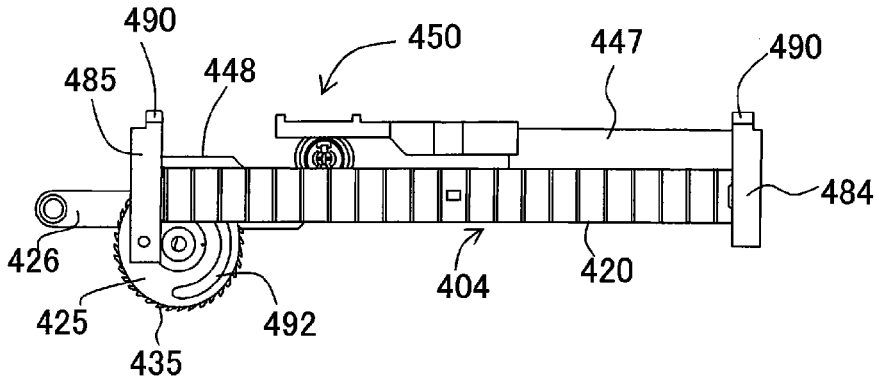
FIG. 43 shows the movement of a restricting member and movable ribs during the transport of the recording paper in an order of FIGS. 43A to 43D.
Figure 43B:
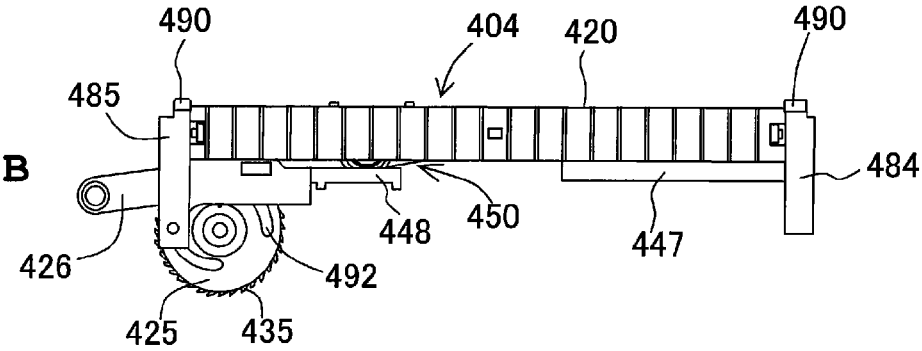

As shown in FIG. 43A and FIG. 36, the movable ribs 404 are positioned between the first fixed ribs 402 and the second fixed ribs 403 (initial positions) in the normal state. However, as shown in FIG. 43B, when the recording paper is transported to the end of the platen 442 on the upstream side in the transport direction, the movable ribs 404 are moved to the upstream side in the transport direction to receive the recording paper. Specifically, as explained in relation to FIG. 3 in the first embodiment, the recording paper is fed along the transport passage 23, and the recording paper is fed onto the platen 442 by means of the transport rollers 60 and the press rollers 361. During the transport of the recording paper along the transport passage 23, the CR motor 73 is driven, and the scanning carriage 38 is allowed to slide. Accordingly, as shown in FIG. 36, the input member 424 is pressed. The rotary plate 425 is rotated in the clockwise direction with reference to FIG. 40, and the movable ribs 404 are moved to the upstream side in the transport direction. When the angle of rotation of the rotary plate 425 arrives at 90°, the movable ribs 404 arrive at the end of the platen 442 on the upstream side in the transport direction to receive the recording paper.

When the rotary plate 425 is rotated as described above, the sliding members 447, 448 make separation from each other as shown in FIGS. 39 and 40. As a result, as shown in FIG. 43B, the pair of restricting members 484, 485 are separated from each other. That is, the respective restricting members 484, 485 are moved in the directions (direction of the arrow 434 shown in FIG. 36) perpendicular to the transport direction of the recording paper, and they are retracted from the positions over the platen 442.

Figure 43C:
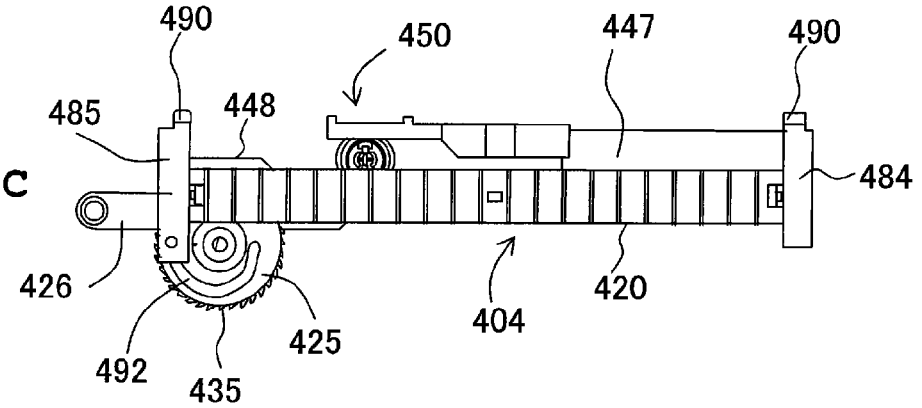

After that, the input member 424 is pressed by the scanning carriage 38 in accordance with the image recording, and the rotary plate 425 is further rotated. Accordingly, the movable ribs 404 are moved to the downstream side in the transport direction while following the recording paper to be transported, while supporting the front end of the recording paper. When the angle of rotation of the rotary plate 425 arrives at 180°, the movable ribs 404 arrive at the initial positions (central portion of the groove 416) as shown in FIG. 43C. In this situation, the image recording is continued while retaining the movable ribs 404 at the initial positions. The following means is available to retain the movable ribs 404 while transporting the recording paper as described above. That is, the slide distance of the recording head 39 may be controlled so that the scanning carriage 38, which retains the recording head 39, does not abut against the input member 424.

Figure 43D:
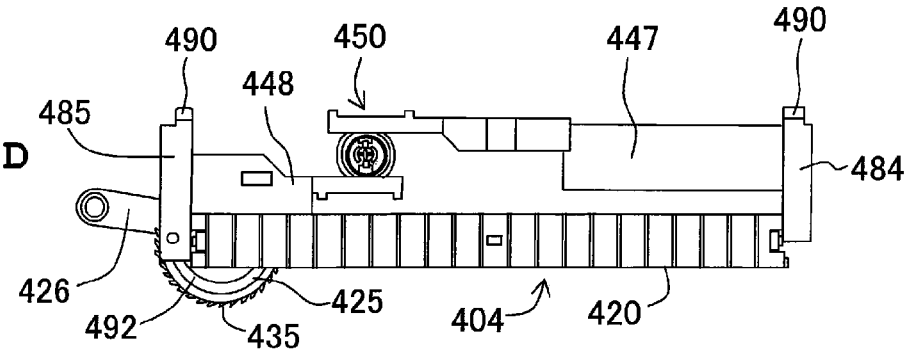

When the backward end of the recording paper is transported onto the movable ribs 404, then the movable ribs 404 are allowed to slide in the transport direction again, and the movable ribs 404 are further moved to the downstream side in the transport direction while following the recording paper to be transported, while supporting the backward end of the recording paper. Specifically, the input member 424 is pressed by the scanning carriage 38. The rotary plate 425 is further rotated, and the movable ribs 404 are further moved to the downstream side in the transport direction. When the angle of rotation of the rotary plate 425 arrives at 270°, the movable ribs 404 arrive at the end on the downstream side in the transport direction as shown in FIG. 43D. The following means is available to move the movable ribs 404 again, the movable ribs 404 being disposed at the initial positions as described above. That is, the slide distance of the recording head 39 may be controlled so that the scanning carriage 38, which retains the recording head 39, abuts against the input member 424 again.

When the recording paper, on which the image recording has been performed, is discharged, the scanning carriage 38, which retains the recording head 39, allows the input member 424 to slide to the restriction release position described above. The sliding movement of the scanning carriage 38 is performed by controlling the driving of the CR motor 73. Specifically, as shown in FIG. 39, the input member 424 is allowed to slide in the direction of the arrow 434 (see FIG. 36), and the restriction release arm 432 releases the engagement between the engaging pawl 443 and the teeth 435 of the rotary plate 425. Accordingly, the rotary plate 425 is released from the restriction of rotation. As described above, the strain energy is accumulated in the spiral spring 449 in accordance with the rotation of the rotary plate 425. Therefore, when the rotary plate 425 is released from the restriction of rotation, the strain energy is released. As a result, the rotary plate 425 is rotated in the opposite direction (clockwise direction with reference to FIG. 39). When all of the strain energy is released, the rotary plate 425 is rotated by 270° in the clockwise direction. The movable ribs 404 are restored to the initial positions again, and the restricting members 484, 485 are overlapped with the upper surface 409 of the platen 442 again.

In the multifunction machine 410 according to this embodiment, the recording paper is transported onto the platen 442, and the predetermined image is recorded on the recording paper by discharging the ink droplets while allowing the recording head 39 to slide in the main scanning direction. When the bordered recording is set with the operation panel 20, then the input member 424 is not operated, and the restricting members 484, 485 are arranged over the platen 442 (see FIG. 36). That is, the restricting members 484, 485 are overlapped with the edges of the recording paper fed onto the platen 442. Therefore, even if the recording paper to be transported causes the initial deformation, and/or even if the cockling phenomenon arises on the recording paper during the recording, then the distance between the recording paper and the recording head 39 is regulated to be within a constant range. On the other hand, when the borderless recording is set with the operation panel 20, the restricting members 484, 485 are retracted from the positions over the platen 442 as shown in FIG. 43. Accordingly, the recording paper, which is transported on the platen 442, is not overlapped with the restricting members 484, 485. Therefore, when the borderless recording is performed, the ink droplets, which are discharged from the recording head 39, reliably arrive at the edges of the recording paper.

As described above, in the multifunction machine 410 according to this embodiment, the distance between the recording paper and the recording head 39 is regulated to be within the constant range when the bordered recording is performed, by providing the restricting members 484, 485. Therefore, even if the initial deformation is caused on the recording paper, and/or even if the cockling phenomenon arises, then it is possible to perform the vivid recording. Further, when the borderless recording is performed, the restricting members 484, 485 are retracted. Accordingly, the discharge of the ink droplets to the edges of the recording paper is not intercepted. Therefore, it is also possible to perform the vivid borderless recording.

In this embodiment, the restricting members 484, 485 are composed of the slender flat plates. Therefore, an advantage is obtained such that the restricting members 484, 485 are structured extremely simply. Further, the forward ends 490 of the restricting members 484, 485 are bent as described above. Accordingly, when the recording paper to be transported onto the platen 442 involves the large initial deformation, for example, even when the deformation is caused to such an extent that the recording paper makes contact with the recording head 39, then the recording paper is guided by the forward ends 490, and the recording paper is reliably inserted into the spaces between the restricting members 484, 485 and the platen 442. Therefore, even when the recording paper is bent and curved, then the contact is avoided between the recording paper and the recording head 39, and the vivid bordered recording is realized.

The movement of the restricting members 484, 485 is realized by the input member 424, the rotary plate 425 which is rotated thereby, and the sliding members 447, 448 which are allowed to slide thereby. That is, the movement of the restricting members 484, 485 is realized by the simple mechanism. Therefore, an advantage is also obtained such that the increase in the production cost of the image-recording unit 24 is suppressed. Additionally, the LF motor 71 is not the direct driving source of the restricting members 484, 485. Therefore, an advantage is also obtained such that the correct transport of the recording paper is not inhibited. In particular, the sliding members 447, 448, which allow the restricting members 484, 485 to slide, make the sliding movement while being guided by the projections 488, 489 (see FIGS. 39 and 40). Accordingly, the sliding members 447, 448 are smoothly moved. Therefore, the restricting members 484, 485 can be also smoothly retracted from and restored to the positions over the platen 442.

Further, in this embodiment, the pair of restricting members 484, 485 are arranged opposingly. Therefore, the pair of opposing edges of the recording paper to be transported are overlapped with the restricting members 484, 485. Accordingly, even when the cockling phenomenon is caused as described above when the bordered recording is performed, the distance between the recording paper and the recording head 39 is reliably regulated to be within the constant range. Therefore, the more advanced vivid bordered recording is realized. Further, the restricting members 484, 485 are equivalently subjected to the approach and the separation in the main scanning direction, because the restricting members 484, 485 are connected to one another by the aid of the rack and pinion mechanism 450. Therefore, an advantage is obtained such that the recording paper transported on the platen 442 and the restricting members 484, 485 are reliably prevented from being overlapped when the borderless recording is performed.

In this embodiment, the movable ribs 404 are restored to the initial positions, and the restricting members 484, 485 are also restored to the positions over the platen 442 after the image recording on the recording paper is completed. Therefore, for example, even when the bordered recording is performed thereafter, the restricting members 484, 485 can be reliably overlapped with the recording paper. Further, even when the borderless recording is continuously performed on the recording paper, the sliding movement is repeated by the movable ribs 404 and the restricting members 484, 485. Therefore, the vivid bordered recording and the vivid borderless recording are continuously performed. Further, the means, which is provided to restore the movable ribs 404 to the initial positions and restore the restricting members 484, 485 to the positions over the platen 442, has the extremely simple structure without utilizing the CR motor 73 and the LF motor 71. Therefore, an advantage is also obtained such that the correct transport of the recording paper is not inhibited.

Additionally, in this embodiment, the rotation of the rotary plate 425 is restricted by the rotation-restricting member 427. In this arrangement, the input member 424 and the rotation-restricting member 427 constitute a ratchet mechanism which rotates the rotary plate 425 in only one direction. Therefore, every time when the recording head 39 makes the reciprocating motion, the rotary plate 425 is rotated in the counterclockwise direction with reference to FIG. 39, and the restricting members 484, 485 are reliably retracted from the positions over the platen 442. In this arrangement, the sliding movement of the recording head 39 is controlled by the control unit 64 to effect the following adjustment. That is, the rotary plate 425 may be rotated every time when the recording head 39 makes the reciprocating movement once. Alternatively, the rotary plate 425 may be rotated every time when the recording head 39 makes the reciprocating movement a plurality of times.

The recording paper is further transported in the transport direction in accordance with the recording of the image. In this situation, as shown in FIG. 43, the movable ribs 404 is subjected to the sliding movement in the transport direction while supporting the recording paper. That is, the forward end and the backward end of the recording paper are always supported by the movable ribs 404 during the image recording. Therefore, no warpage is caused in the transport direction. Even when the groove 416 is formed between the first fixed ribs 402 and the second fixed ribs 403 as in this embodiment, the recording paper does not fall toward the groove 416. The constant distance is maintained between the recording paper and the recording head 39. As a result, the high image quality printing is realized.

Specifically, as shown in FIG. 36, the recording paper, which is transported onto the platen 442, is firstly supported by the first fixed ribs 402. Further, the recording paper passes over the groove 416, and the recording paper is fed toward the second fixed ribs 403. The groove 416 can receive the ink droplets discharged from the recording head 39 while exceeding the edge of the recording paper especially when the borderless recording is performed. Accordingly, the back side of the recording paper is prevented from any adhesion of the ink. When the recording paper passes over the groove 416, the movable ribs 404 are allowed to slide in the transport direction while following the recording paper to be transported. That is, the movable ribs 404 support the recording paper while making the sliding movement. Therefore, the end of the recording paper is always supported by the movable ribs 404 reliably. The end of the recording paper does not enter the groove 416.

Additionally, the width of the groove 416 may be set to be large when the platen 442 is designed, because the recording paper is supported by the movable ribs 404. Accordingly, it is possible to allow the recording head 39 to have a large size. Further, even when the recording head 39 is large-sized, the groove 416 can cover the entire ink discharge area 118 of the recording head 39. As a result, an advantage is obtained such that the high speed borderless recording is realized as well.

In particular, the members for supporting the recording paper are the ribs. Therefore, an advantage is obtained such that the members for supporting the recording paper have the extremely simple structure. Further, the recording paper can be transported smoothly, because the contact area is decreased between the recording paper and the first fixed ribs 402, the second fixed ribs 403, and the movable ribs 404.

As shown in FIG. 43, when the recording paper is transported onto the platen 442, the movable ribs 404 are once moved to receive the recording paper on the upstream side in the transport direction. After that, the movable ribs 404 are allowed to slide to the downstream side in the transport direction while supporting the end of the recording paper in accordance with the transport of the recording paper. Accordingly, the end of the recording paper is reliably supported by the movable ribs 404. An advantage is obtained such that the recording paper is reliably prevented from any invasion into the groove 416 during the transport.

Further, the driving mechanism 415, which drives the movable ribs 404, is operated such that the scanning carriage 38, which is subjected to the sliding movement by the CR motor 73, allows the input member 424 to slide as described above, and the sliding movement of the input member 424 is converted into the sliding movement of the movable ribs 404 by the aid of the rotary plate 425 and the swinging member 426. That is, an advantage is obtained such that the correct transport of the recording paper is not inhibited, because the LF motor 71 is not the direct driving source of the movable ribs 404. In this embodiment, the driving source of the movable ribs 404 is the CR motor 73. However, the CR motor 73 effects the pressing action on the input member 424 in the area disposed outside the scanning range of the scanning carriage 38 (i.e., the area disposed outside the image recording range). Therefore, the correct transport of the recording paper is secured within the image recording range. However, it is a matter of course that the CR motor 73 or the LF motor 71 may be adopted as the direct driving source of the movable ribs 404 and the restricting members 484, 485, on condition that the correct transport of the recording paper is secured.

As described above, the input member 424 and the rotation-restricting member 427 constitute the ratchet mechanism. Accordingly, every time when the recording head 39 makes the reciprocating motion, the rotary plate 425 is rotated, and the movable ribs 404 are reliably moved in the direction as described above to support the recording paper. The sliding movement of the recording head 39 is controlled by the control unit 64 to effect the following adjustment in the same manner as described above. That is, the rotary plate 425 may be rotated every time when the recording head 39 makes the reciprocating movement once, or the rotary plate 425 may be rotated every time when the recording head 39 makes the reciprocating movement a plurality of times.

Additionally, in this embodiment, the driving mechanism 405 is provided with both of the function to allow the movable ribs 404 to slide and the function to retract the restricting members 484, 485. The both functions are interlocked with each other. However, it is a matter of course that the function to allow the movable ribs 404 to slide and the function to retract the restricting members 484, 485 may be constructed distinctly, and the both may be operated independently from each other. In this arrangement, the restricting members 484, 485 may be driven, for example, by an actuator which is electrically operated. In short, it is enough that the restricting members 484, 485 are retracted at the point of time at which the recording paper arrives at the position on the platen 442 so that the restricting members 484, 485 are not overlapped with the recording paper when the borderless recording is performed.

Fifth Embodiment

Next, a fifth embodiment of the present invention will be explained. This embodiment is different from the fourth embodiment in that restricting members themselves are not moved from the frame in the main scanning direction. This embodiment will be explained below with reference to FIGS. 44A to 44C.

Figure 44A:
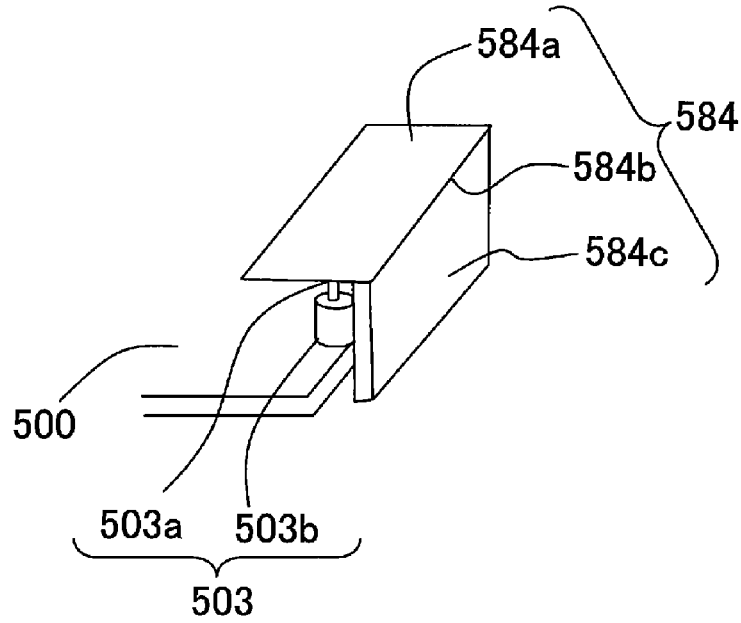
FIG. 44 shows the movement of a restricting member during the transport of the recording paper in an order of FIGS. 44A to 44C, according to a fifth embodiment of the present invention.

As shown in FIG. 44A, the restricting member 584 of this embodiment includes a base 584*b* which is fixed to one end of a frame 500, a hinge 584*c* which is provided at the upper end of the base 584*b*, an upper plate 584*a* which is connected by the aid of the hinge 584*c*, and an actuator 503 which is installed at a side portion of the upper surface of the frame.

Figure 44B:
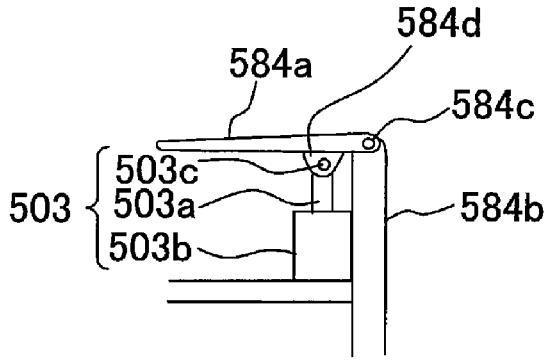

As shown in FIG. 44B, the actuator 503 includes a main actuator body 503*b*, an actuator rod 503*a* which is extendable upwardly from the main body 503*b*, and a pin 503*c* which is provided at the forward end of the actuator rod 503*a*. The pin 503*c* is rotatably accommodated in a hole of a connecting section 584*d* which is provided on the back surface of the upper plate 584*a*.

Figure 44C:
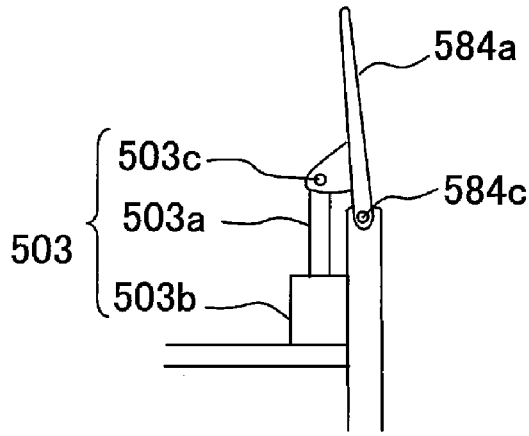

When the borderless printing is performed, the actuator 503 is operated to allow the actuator rod 503*a* to extend upwardly as shown in FIG. 44C. Accordingly, the upper plate 584*a* is rotated about the center of the hinge 584*c*. As a result, the both ends (parts of the groove 416) of the frame 500 are not covered with the upper plates 584*a*. Therefore, the jetted inks are not intercepted by the upper plates.

The actuator 503 is controlled by the control unit 64. Although not shown, another restricting member, which is equivalent to the restricting member 584, is provided at the other end of the frame.

The present invention has been explained as exemplified by the embodiments described above. However, the present invention is not limited to the embodiments. For example, the restricting member, which is used in the fourth or fifth embodiment, can be also used for the multifunction machine explained in each of the first to third embodiments.

What is claimed is:

1. An ink-jet recording apparatus comprising:

a platen which supports recording paper;

a recording head which is arranged opposingly to the platen and which records an image on the recording paper transported onto the platen, by discharging ink droplets; and a movable support section which slidably moves in a transport direction on the platen and supports the recording paper while following the recording paper which is being transported, wherein the platen comprises:

a frame which has an upper surface extending in the transport direction;

a first printing paper support section which is provided to protrude on an upstream side of the upper surface in the transport direction; and a second printing paper support section which is provided to protrude on a downstream side of the upper surface in the transport direction so that a groove, which extends in a main scanning direction, is formed between the first printing paper support section and the second printing paper support section, and wherein: the movable support section is provided slidably in the transport direction between a position adjacent to the first printing paper support section and a position adjacent to the second printing paper support section so that the movable support section follows the recording paper which is being transported in the transport direction.

2. The ink-jet recording apparatus according to claim 1, wherein:

the first printing paper support section has a plurality of first fixed ribs which are provided to protrude on a portion of the upper surface disposed on the upstream side in the transport direction and which are aligned in the main scanning direction;

the second printing paper support section has a plurality of second fixed ribs which are provided to protrude on a portion of the upper surface disposed on the downstream side in the transport direction and which are aligned in the main scanning direction; and the movable support section has a plurality of movable ribs which are provided slidably between first positions at which the movable ribs are positioned between first fixed ribs included in the first fixed ribs and disposed adjacently to one another in the main scanning direction and second positions at which the movable ribs are positioned between second fixed ribs included in the second fixed ribs and disposed adjacently to one another in the main scanning direction.

3. The ink-jet recording apparatus according to claim 1, wherein a width of the groove is set to be wider than an ink discharge area of the recording head.

4. The ink-jet recording apparatus according to claim 1, wherein chamfering processing is applied to a corner portion of the movable support section disposed on the upstream side in the transport direction.

5. The ink-jet recording apparatus according to claim 2, further comprising a movable rib-driving mechanism which arranges the movable ribs at the first positions when the recording paper is transported to an end of the frame disposed on the upstream side in the transport direction and which allows the movable ribs to slide in the transport direction while supporting an end of the recording paper as the recording paper is transported.

6. The ink-jet recording apparatus according to claim 5, wherein the movable rib-driving mechanism includes:

an input member which is subjected to sliding movement in the main scanning direction by the recording head;

a rotary plate which is rotatably supported by a predetermined rotation center shaft provided on the frame and which is rotated around the rotation center shaft in a predetermined direction on the basis of the sliding movement of the input member; and a swinging member which has a central portion swingably supported by a predetermined swinging movement center shaft provided on the frame, a proximal end engaged with an engaging section provided for the rotary plate, and a forward end to be moved in the transport direction on a virtual plane parallel to the upper surface about a center of the swinging movement center shaft on the basis of rotation of the rotary plate, and wherein: the movable support section is attached to the forward end of the swinging member.

7. The ink-jet recording apparatus according to claim 6, further comprising:

a rotation-restricting member which effects restriction for the rotary plate to prevent the rotary plate from rotating in a direction opposite to the predetermined direction, the rotary plate being released from the restriction by allowing the input member to slide to a predetermined restriction release position; and a spring member which is attached to the rotary plate and which accumulates strain energy depending on an angle of rotation of the rotary plate in the predetermined direction.

8. The ink-jet recording apparatus according to claim 6, further comprising a carriage which retains the recording head and which is movable in a direction perpendicular to the transport direction of the recording paper, wherein the input member is urged to slide when the carriage is moved.

9. The ink-jet recording apparatus according to claim 5, wherein the movable rib has a triangular shape, and the printing paper is supported by an apex of the triangular shape.

10. An ink-jet recording apparatus comprising:

a platen which supports recording paper;

a recording head which is arranged opposingly to the platen and which records an image on the recording paper transported onto the platen, by discharging ink droplets;

a movable support section which slidably moves in a transport direction on the platen and supports the recording paper while following the recording paper which is being transported; and a movable support section-driving member which drives the movable support section, wherein the movable support section-driving member includes:

a rotary plate section which is rotatably supported by a predetermined rotation center shaft and which is engaged with an engaging section provided for the movable support section; and a guide groove which is provided on an engaging surface of the rotary plate section engaged with the engaging section of the movable support section and which guides the engaging section of the movable support section in the transport direction between an end of the platen disposed on an upstream side in the transport direction and an end of the platen disposed on a downstream side in the transport direction as the rotary plate section is rotated about a center of rotation of the rotation center shaft.

11. The ink-jet recording apparatus according to claim 10, wherein the movable support section is driven by a motor for transporting the recording paper positioned on the platen in the transport direction.

12. The ink-jet recording apparatus according to claim 10, wherein the rotary plate section is formed to have a disk-shaped form in which the rotation center shaft penetrates through a central portion thereof.

13. The ink-jet recording apparatus according to claim 10, wherein the guide groove is formed along a predetermined locus curve so that the engaging section of the movable support section is allowed to slide toward the end disposed on the upstream side in the transport direction when the recording paper is transported to the end of the platen disposed on the upstream side in the transport direction, while the engaging section of the movable support section is allowed to slide toward the downstream side in the transport direction while supporting an end of the recording paper accompanying transport of the recording paper.

14. The ink-jet recording apparatus according to claim 13, wherein the predetermined locus curve is an Archimedes' spiral.

15. The ink-jet recording apparatus according to claim 14, wherein the Archimedes' spiral is formed bilaterally symmetrically in relation to a center of a virtual reference axis which passes through a center of the rotary plate section and which is formed on the engaging surface.

16. An ink-jet recording apparatus comprising:

a platen which supports recording paper;

a recording head which is arranged opposingly to the platen and which records an image on the recording paper transported onto the platen, by discharging ink droplets;

a movable support section which slidably moves in a transport direction on the platen and supports the recording paper while following the recording paper which is being transported; and a restricting member which restricts a distance between the recording head and the recording paper to be transported so that the distance is within a constant range by overlapping with an edge of the recording paper in the transport direction; and a retracting mechanism which retracts the restricting member in a direction perpendicular to the transport direction so that the restricting member does not overlap with the edge when borderless recording is performed.

17. The ink-jet recording apparatus according to claim 10, further comprising:

a restricting member which restricts a distance between the recording head and the recording paper which is being transported so that the distance is within a constant range by overlapping with an edge of the recording paper in the transport direction; and a retracting mechanism which retracts the restricting member in a direction perpendicular to the transport direction so that the restricting member does not overlap with the edge when borderless recording is performed.

18. The ink-jet recording apparatus according to claim 16, wherein:

the restricting member has a slender flat plate which is arranged between the platen and an ink discharge surface of the recording head and which extends in the transport direction; and a portion of the slender flat plate, which is disposed on an upstream side of a movement area of the recording head in the transport direction, is bent obliquely upwardly so that the portion extends upwardly as compared with the ink discharge surface.

19. The ink-jet recording apparatus according to claim 16, wherein:

the platen includes a frame which has an upper surface for placing the recording paper thereon; and the retracting mechanism includes an input member which is allowed to slide in the direction perpendicular to the transport direction by the recording head;

a rotary plate which is supported rotatably by a predetermined rotation center shaft provided on the frame and which is rotated around the rotation center shaft in a predetermined direction on the basis of sliding movement of the input member; and a sliding member to which the restricting member is connected, which is engaged with an engaging section provided for the rotary plate, and which is allowed to slide in the direction perpendicular to the transport direction on the basis of rotation of the rotary plate.

20. The ink-jet recording apparatus according to claim 16, wherein:

the restricting member is formed as a plurality of restricting members arranged opposingly in the direction perpendicular to the transport direction; and the retracting mechanism includes a rack and pinion mechanism which is provided between a pair of sliding members connected to the restricting members respectively.

21. The ink-jet recording apparatus according to claim 19, wherein the retracting mechanism further includes a rotation-restricting member which effects restriction for the rotary plate to prevent the rotary plate from rotating in a direction opposite to the predetermined direction, the rotary plate being released from the restriction by allowing the input member to slide to a predetermined restriction release position; and a spring member which is attached to the rotary plate and which accumulates strain energy depending on an angle of rotation of the rotary plate in the predetermined direction.

22. The ink-jet recording apparatus according to claim 19, wherein the retracting mechanism further includes a slide guide member which guides sliding movement of the sliding member.

23. The ink-jet recording apparatus according to claim 18, wherein the retracting mechanism further includes an actuator which retracts the restricting member in a direction perpendicular to a surface of the recording paper which is being transported.

24. An ink-jet recording apparatus comprising:

a platen which supports recording paper;

a feeder which transports the recording paper on the platen in a transport direction;

a recording head which is arranged opposingly to the platen and which records an image on the recording paper transported onto the platen, by discharging ink droplets;

a movable support section which supports the recording paper and slidably reciprocates on the platen in the transport direction and a direction opposite the transport direction while the feeder transports the recording paper on the platen in the transport direction; and a movable support section driving mechanism which is attached to the platen and drives the movable support section to reciprocate.

25. An ink-jet recording apparatus comprising:

a platen which supports recording paper;

a feeder which transports the recording paper on the platen in a transport direction;

a recording head which is arranged opposingly to the platen and which records an image on the recording paper transported onto the platen, by discharging ink droplets; and a movable support section which supports the recording paper and slidably reciprocates on the platen in the transport direction and a direction opposite the transport direction while the feeder transports the recording paper on the platen in the transport direction, wherein the movable support section reciprocates within a range between an upstream end of the platen and a downstream end of the platen with respect to the transport direction.

26. The ink-jet recording apparatus according to claim 24, wherein the movable support section is mounted on the platen.

* * * * *